US009656117B2

(12) United States Patent
von Hoffmann et al.

(10) Patent No.: US 9,656,117 B2
(45) Date of Patent: May 23, 2017

(54) WEARABLE RESISTANCE GARMENT WITH POWER MEASUREMENT

(71) Applicant: Tau Orthopedics, LLC, Coto de Caza, CA (US)

(72) Inventors: Gerard von Hoffmann, Coto de Caza, CA (US); Belinko K. Matsuura, Solana Beach, CA (US); David G. Matsuura, Solana Beach, CA (US)

(73) Assignee: TAU Orthopedics, LLC, Rancho Santa Fe, CA (US)

( * ) Notice: Subject to any disclaimer, the term of this patent is extended or adjusted under 35 U.S.C. 154(b) by 0 days.

(21) Appl. No.: 15/078,250

(22) Filed: Mar. 23, 2016

(65) Prior Publication Data

US 2016/0199685 A1 Jul. 14, 2016

Related U.S. Application Data

(63) Continuation-in-part of application No. 15/069,053, filed on Mar. 14, 2016, and a continuation-in-part of (Continued)

(51) Int. Cl.
*A63B 21/02* (2006.01)
*A63B 21/00* (2006.01)
(Continued)

(52) U.S. Cl.
CPC .... *A63B 21/4025* (2015.10); *A63B 21/00845* (2015.10); *A63B 21/4011* (2015.10); *A63B 21/4017* (2015.10); *A63B 21/4039* (2015.10); *A63B 23/0482* (2013.01); *A63B 23/0494* (2013.01); *G06Q 50/01* (2013.01); *A63B 21/008* (2013.01); *A63B 21/0053* (2013.01); *A63B 21/0083* (2013.01); *A63B 21/0087* (2013.01); *A63B 21/00189* (2013.01); *A63B 21/012* (2013.01); *A63B 21/023* (2013.01); *A63B 21/028* (2013.01); *A63B 21/0552* (2013.01); *A63B 21/159* (2013.01); (Continued)

(58) Field of Classification Search
USPC ..... 482/1–148
See application file for complete search history.

(56) References Cited

U.S. PATENT DOCUMENTS 2,664,566 A 1/1954 Mianulli
2,832,334 A 4/1958 Whitelaw
(Continued)

FOREIGN PATENT DOCUMENTS

WO WO 2014/194257 12/2014

*Primary Examiner* — Stephen Crow
(74) *Attorney, Agent, or Firm* — Knobbe, Martens, Olson & Bear, LLP

(57) ABSTRACT

Disclosed is a technical training garment configured for use with modular, interchangeable electronics and resistance modules. The garment provides resistance to movement throughout an angular range of motion and tracks biomechanical parameters such as stride length, stride rate, angular velocity and incremental power expended by the wearer. The garment may be low profile, and worn by a wearer as a primary garment or beneath or over conventional clothing. Alternatively, the device may be worn as a supplemental training tool during conventional training protocols.

32 Claims, 27 Drawing Sheets

Related U.S. Application Data application No. 14/665,947, filed on Mar. 23, 2015, which is a continuation-in-part of application No. 12/951,947, filed on Nov. 22, 2010, now Pat. No. 8,986,177, which is a continuation-in-part of application No. 12/797,718, filed on Jun. 10, 2010, now abandoned, said application No. 14/665,947 is a continuation-in-part of application No. 14/450,228, filed on Aug. 2, 2014, now Pat. No. 9,433,814, which is a continuation-in-part of application No. 14/217,576, filed on Mar. 18, 2014, now Pat. No. 9,327,156, which is a continuation-in-part of application No. 14/192,805, filed on Feb. 27, 2014, now abandoned.

(60) Provisional application No. 61/218,607, filed on Jun. 19, 2009, provisional application No. 62/137,036, filed on Mar. 23, 2015.

(51) Int. Cl.

| | |
|---|---|
| ***A63B 23/04*** | (2006.01) |
| ***G06Q 50/00*** | (2012.01) |
| *A63B 71/06* | (2006.01) |
| *A63B 21/005* | (2006.01) |
| *A63B 21/008* | (2006.01) |
| *A63B 21/012* | (2006.01) |
| *A63B 21/055* | (2006.01) |
| *A63B 23/02* | (2006.01) |
| *A63B 23/12* | (2006.01) |

(52) U.S. Cl.

CPC ..... *A63B 21/4047* (2015.10); *A63B 23/02* (2013.01); *A63B 23/1245* (2013.01); *A63B 23/1281* (2013.01); *A63B 71/0622* (2013.01); *A63B 2071/065* (2013.01); *A63B 2071/0625* (2013.01); *A63B 2071/0655* (2013.01); *A63B 2209/02* (2013.01); *A63B 2209/10* (2013.01); *A63B 2220/44* (2013.01); *A63B 2220/51* (2013.01); *A63B 2225/50* (2013.01); *A63B 2230/202* (2013.01); *A63B 2230/205* (2013.01); *A63B 2230/207* (2013.01); *A63B 2230/42* (2013.01); *A63B 2230/50* (2013.01); *A63B 2230/60* (2013.01); *A63B 2230/65* (2013.01); *A63B 2230/75* (2013.01)

(56) References Cited

U.S. PATENT DOCUMENTS

| | | | | |
|---|---|---|---|---|
| 4,065,814 | A | 1/1978 | Fox | |
| 4,485,808 | A | 12/1984 | Hepburn | |
| 4,621,620 | A | 11/1986 | Anderson | |
| 4,657,000 | A | 4/1987 | Hepburn | |
| 4,829,989 | A | 5/1989 | Deamer et al. | |
| 4,875,677 | A | 10/1989 | Tetreault | |
| 4,910,802 | A | 3/1990 | Malloy | |
| 4,947,835 | A | 8/1990 | Hepburn et al. | |
| 5,052,379 | A | 10/1991 | Airy et al. | |
| 5,176,600 | A | 1/1993 | Wilkinson | |
| 5,201,074 | A | 4/1993 | Dicker | |
| 5,263,923 | A | 11/1993 | Fujimoto | |
| 5,282,460 | A | 2/1994 | Boldt | |
| 5,306,222 | A | 4/1994 | Wilkinson | |
| 5,308,305 | A | 5/1994 | Romney | |
| 5,337,737 | A | 8/1994 | Rubin et al. | |
| 5,399,154 | A | 3/1995 | Kipnis et al. | |
| 5,465,428 | A | 11/1995 | Earl | |
| 5,472,412 | A | 12/1995 | Knoth | |
| 5,527,244 | A | 6/1996 | Waller et al. | |
| 5,553,322 | A | 9/1996 | Cebo-Johnson | |
| 5,662,595 | A | 9/1997 | Chesher et al. | |
| 5,685,811 | A | 11/1997 | McShane et al. | |
| 5,720,042 | A | 2/1998 | Wilkinson | |
| 5,749,840 | A | 5/1998 | Mitchell et al. | |
| 5,788,618 | A * | 8/1998 | Joutras | A43B 1/0054 482/114 |
| 5,792,034 | A | 8/1998 | Kozlovsky | |
| RE35,940 | E | 10/1998 | Heinz et al. | |
| 5,842,959 | A | 12/1998 | Wilkinson | |
| 5,857,947 | A * | 1/1999 | Dicker | A63B 21/4025 2/69.5 |
| 5,867,827 | A | 2/1999 | Wilkinson | |
| 5,875,491 | A | 3/1999 | Wilkinson | |
| 5,937,441 | A | 8/1999 | Raines | |
| 5,960,474 | A | 10/1999 | Dicker et al. | |
| 5,976,063 | A | 11/1999 | Joutras et al. | |
| 5,978,966 | A | 11/1999 | Dicker et al. | |
| 5,993,362 | A | 11/1999 | Ghobadi | |
| 6,039,677 | A | 3/2000 | Spletzer | |
| 6,129,638 | A | 10/2000 | Davis | |
| 6,176,816 | B1 | 1/2001 | Dicker et al. | |
| 6,186,970 | B1 | 2/2001 | Fujii et al. | |
| 6,210,354 | B1 | 4/2001 | Ousdal | |
| 6,231,488 | B1 | 5/2001 | Dicker et al. | |
| 6,314,580 | B1 | 11/2001 | Greenberg et al. | |
| 6,397,496 | B1 | 6/2002 | Seymour | |
| 6,409,693 | B1 | 6/2002 | Brannigan | |
| 6,430,752 | B1 | 8/2002 | Bay | |
| 6,440,094 | B1 | 8/2002 | Maas | |
| 6,656,097 | B2 | 12/2003 | Karecki | |
| 6,666,801 | B1 | 12/2003 | Michalow | |
| 6,757,916 | B2 | 7/2004 | Mah et al. | |
| 6,834,752 | B2 | 12/2004 | Irby et al. | |
| 6,872,187 | B1 | 3/2005 | Stark et al. | |
| 6,954,968 | B1 | 10/2005 | Sitbon | |
| 7,048,098 | B1 | 5/2006 | Moradian | |
| 7,087,003 | B1 | 8/2006 | Katterjohn | |
| 7,153,246 | B2 | 12/2006 | Koscielny et al. | |
| 7,235,038 | B2 | 6/2007 | Liao | |
| 7,278,954 | B2 * | 10/2007 | Kawai | A61H 3/00 482/1 |
| 7,431,707 | B2 * | 10/2008 | Ikeuchi | A61F 5/0102 602/16 |
| 7,599,806 | B2 | 10/2009 | Hauschildt | |
| 7,608,026 | B1 | 10/2009 | Nicassio | |
| 7,652,386 | B2 | 1/2010 | Donelan et al. | |
| 7,659,636 | B2 | 2/2010 | Donelan et al. | |
| 7,682,322 | B2 | 3/2010 | Engelman | |
| 7,744,511 | B2 | 6/2010 | Grigoriev | |
| 7,758,481 | B2 | 7/2010 | Drennan | |
| 7,845,023 | B2 | 12/2010 | Swatee | |
| 7,849,518 | B2 | 12/2010 | Moore et al. | |
| 7,857,774 | B2 * | 12/2010 | Sankai | A61H 3/008 601/35 |
| 7,860,607 | B2 * | 12/2010 | Kawai | A61B 5/1038 600/595 |
| 7,861,319 | B2 | 1/2011 | Torry | |
| 7,874,970 | B2 | 1/2011 | Glisan | |
| 7,931,571 | B2 | 4/2011 | Bernardoni | |
| 7,947,004 | B2 * | 5/2011 | Kazerooni | A61B 5/1038 602/16 |
| 8,043,243 | B2 | 10/2011 | Nathanson et al. | |
| 8,060,945 | B2 | 11/2011 | Adarraga | |
| 8,063,644 | B2 | 11/2011 | Rezvani et al. | |
| 8,096,965 | B2 * | 1/2012 | Goffer | B25J 9/0006 602/16 |
| 8,171,570 | B2 | 5/2012 | Adarraga | |
| 8,273,001 | B2 | 9/2012 | Karecki et al. | |
| 8,312,646 | B2 | 11/2012 | Meschter et al. | |
| 8,409,117 | B2 | 4/2013 | Cheng et al. | |
| 8,454,637 | B2 | 6/2013 | Aggerholm et al. | |
| 8,544,114 | B2 | 10/2013 | Williams et al. | |
| 8,555,415 | B2 | 10/2013 | Bradstreet et al. | |
| 8,663,133 | B2 | 3/2014 | Johnson et al. | |
| 8,762,077 | B2 | 6/2014 | Redmond et al. | |
| 8,864,846 | B2 * | 10/2014 | Herr | A61F 2/66 623/25 |
| 8,951,136 | B1 | 2/2015 | Booher | |
| 8,986,177 | B2 | 3/2015 | von Hoffmann et al. | |
| 9,192,806 | B2 | 11/2015 | Mial | |

(56) References Cited

U.S. PATENT DOCUMENTS 9,198,821 B2 * 12/2015 Unluhisarcikli ..... A61H 3/00
9,204,811 B2 * 12/2015 Wright ..... A61B 5/0002
9,216,131 B2 * 12/2015 Nakashima ..... A61H 3/00
9,221,177 B2 * 12/2015 Herr ..... B25J 9/1694
9,327,156 B2 5/2016 von Hoffmann et al.
9,333,097 B2 * 5/2016 Herr ..... A61F 2/60
9,333,644 B2 * 5/2016 Angold ..... B25J 9/0006
9,339,396 B2 * 5/2016 Wilkinson ..... B25J 19/0091
9,351,900 B2 * 5/2016 Walsh ..... A61H 1/024
9,375,603 B2 6/2016 Matsuura et al.
9,433,814 B2 * 9/2016 von Hoffmann .. A63B 21/4011
9,445,931 B2 * 9/2016 Imaida ..... A61F 5/01
9,498,401 B2 * 11/2016 Herr ..... A61H 1/0255
2001/0029224 A1 10/2001 Karecki
2004/0040064 A1 * 3/2004 Mah ..... B64D 10/00 2/2.14
2004/0116260 A1 6/2004 Drennan
2005/0101887 A1 5/2005 Stark et al.
2005/0148915 A1 7/2005 Nathanson et al.
2005/0239602 A1 10/2005 Cordova et al.
2005/0255975 A1 11/2005 Horn
2005/0261113 A1 11/2005 Wilkinson
2005/0275416 A1 * 12/2005 Hervieux ..... A41D 13/1281 324/663
2006/0000478 A1 1/2006 Taylor
2006/0016649 A1 1/2006 Gordaninejad et al.
2006/0046910 A1 3/2006 Rastegar et al.
2006/0046913 A1 3/2006 Squittieri
2006/0079825 A1 4/2006 Hilton et al.
2006/0096818 A1 5/2006 Moradian
2006/0272071 A1 12/2006 Mickle
2006/0287621 A1 * 12/2006 Atkinson ..... A61H 9/0078 601/151
2007/0010772 A1 1/2007 Ryan
2007/0016120 A1 1/2007 Latronica et al.
2007/0032359 A1 2/2007 Toronto
2007/0100265 A1 5/2007 Gamada
2007/0123997 A1 5/2007 Herr et al.
2007/0135279 A1 6/2007 Purdy et al.
2007/0219074 A1 9/2007 Pride
2007/0245835 A1 10/2007 Hauschildt
2008/0009771 A1 1/2008 Perry et al.
2008/0026917 A1 1/2008 Campana
2008/0108918 A1 5/2008 Joutras et al.
2008/0218310 A1 * 9/2008 Alten ..... A43B 5/00 340/5.8
2009/0253325 A1 10/2009 Brookstein et al.
2009/0281394 A1 * 11/2009 Russell ..... A61B 5/0002 600/301
2010/0041527 A1 2/2010 Miller
2010/0075557 A1 3/2010 Shteiyer
2010/0077527 A1 4/2010 Lee et al.
2010/0144490 A1 6/2010 Purdy et al.
2010/0193304 A1 8/2010 Böse et al.
2010/0223717 A1 9/2010 Foy et al.
2010/0248915 A1 9/2010 Gibson-Horn
2010/0267525 A1 10/2010 Tanner
2010/0323859 A1 12/2010 von Hoffmann
2011/0010001 A1 1/2011 Chung et al.
2011/0040216 A1 * 2/2011 Herr ..... A61F 2/60 601/34
2011/0111932 A1 5/2011 von Hoffmann et al.
2011/0126335 A1 6/2011 Schultz
2011/0224585 A1 9/2011 Hall
2011/0231986 A1 9/2011 Waldie et al.
2011/0247127 A1 10/2011 Pou
2011/0266323 A1 11/2011 Kazerooni et al.
2011/0314590 A1 12/2011 Perron et al.
2012/0094811 A1 4/2012 Karecki
2012/0116258 A1 5/2012 Lee
2012/0136231 A1 * 5/2012 Markel ..... A61B 5/0015 600/388
2012/0225755 A1 9/2012 Lloyd
2013/0085040 A1 4/2013 Bowers
2013/0130874 A1 5/2013 Richardson et al.
2013/0150218 A1 6/2013 Mial
2013/0190147 A1 7/2013 Luo et al.
2013/0198625 A1 * 8/2013 Anderson ..... G06F 3/016 715/701
2013/0207889 A1 8/2013 Chang et al.
2013/0247330 A1 9/2013 Daul et al.
2013/0260968 A1 10/2013 Shkolnik
2013/0298301 A1 11/2013 Petrakis et al.
2013/0338472 A1 * 12/2013 Macia Barber .... A61B 5/04085 600/388
2014/0068973 A1 3/2014 Krupenkin et al.
2014/0100493 A1 * 4/2014 Craig ..... A61H 3/00 601/35
2014/0109282 A1 4/2014 White et al.
2014/0135593 A1 5/2014 Jayalth et al.
2014/0173934 A1 6/2014 Bell
2014/0200121 A1 7/2014 von Hoffmann et al.
2014/0207030 A1 7/2014 Hall
2014/0222943 A1 8/2014 Oleson et al.
2014/0238153 A1 8/2014 Wood et al.
2014/0265677 A1 9/2014 Orand
2014/0278125 A1 9/2014 Balakrishnan et al.
2014/0278229 A1 9/2014 Hong et al.
2014/0296761 A1 10/2014 Yamamoto et al.
2014/0303538 A1 * 10/2014 Baym ..... A61F 2/30 602/23
2014/0313049 A1 10/2014 Doherty
2014/0336020 A1 11/2014 von Hoffmann et al.
2014/0358053 A1 12/2014 Triolo et al.
2014/0358193 A1 12/2014 Lyons et al.
2014/0358473 A1 12/2014 Goel et al.
2014/0364771 A1 12/2014 Pitts et al.
2014/0379275 A1 12/2014 Yuen et al.
2015/0031970 A1 1/2015 Lain
2015/0057128 A1 2/2015 Ishii
2015/0148619 A1 * 5/2015 Berg ..... A61B 5/0024 600/301
2015/0177083 A1 6/2015 Redmond
2015/0190250 A1 * 7/2015 Braun ..... A61F 2/60 623/25
2015/0190669 A1 * 7/2015 Matsuura ..... A63B 21/02 482/8
2015/0230719 A1 * 8/2015 Berg ..... A61B 5/04 600/388
2015/0258360 A1 9/2015 von Hoffmann et al.
2015/0258362 A1 * 9/2015 Cornish ..... A63B 21/0004 482/124
2015/0351991 A1 * 12/2015 Amundson ..... A61H 3/00 623/24
2016/0038783 A1 2/2016 Matsuura et al.
2016/0062333 A1 * 3/2016 Jayaraman ..... G05B 19/042 700/11
2016/0101338 A1 * 4/2016 Daniels ..... A63B 69/34 482/8
2016/0107309 A1 * 4/2016 Walsh ..... B25J 9/0006 248/550
2016/0128632 A1 * 5/2016 Wiebe ..... A61B 5/6804 340/870.07

* cited by examiner

WEARABLE RESISTANCE GARMENT WITH POWER MEASUREMENT

CROSS-REFERENCE TO RELATED APPLICATIONS

This application is a continuation-in-part of U.S. patent application Ser. No. 15/069,053, filed Mar. 14, 2016. This application is also a continuation-in-part of U.S. patent application Ser. No. 14/665,947, filed Mar. 23, 2015, which is a continuation-in-part of U.S. patent application Ser. No. 12/951,947, filed on Nov. 22, 2010, now U.S. Pat. No. 8,986,177, which is a continuation-in-part of U.S. patent application Ser. No. 12/797,718, filed on Jun. 10, 2010 which claims the benefit of U.S. Provisional Application No. 61/218,607, filed Jun. 19, 2009. U.S. patent application Ser. No. 14/665,947, filed Mar. 23, 2015 is also a continuation-in-part of U.S. patent application Ser. No. 14/450,228 filed Aug. 2, 2014, which is a continuation in part of U.S. patent application Ser. No. 14/217,576 filed Mar. 18, 2014, which is a continuation in part of U.S. patent application Ser. No. 14/192,805 filed Feb. 27, 2014. This application also claims the benefit of U.S. Provisional Application No. 62/137,036, filed Mar. 23, 2015. The entireties of all of the foregoing applications are hereby incorporated by reference herein.

BACKGROUND OF THE INVENTION

Resistance training, sometimes known as weight training or strength training, is a specialized method of conditioning designed to increase muscle strength, muscle endurance, tone and muscle power. Resistance training refers to the use of any one or a combination of training methods which may include resistance machines, dumbbells, barbells, body weight, and rubber tubing.

The goal of resistance training, according to the American Sports Medicine Institute (ASMI), is to "gradually and progressively overload the musculoskeletal system so it gets stronger." This is accomplished by exerting effort against a specific opposing force such as that generated by elastic resistance (i.e. resistance to being stretched or bent). Exercises are isotonic if a body part is moving against the force. Exercises are isometric if a body part is holding still against the force. Resistance exercise is used to develop the strength and size of skeletal muscles. Full range of motion is important in resistance training because muscle overload occurs only at the specific joint angles where the muscle is worked. Properly performed, resistance training can provide significant functional benefits and improvement in overall health and well-being.

Research shows that regular resistance training will strengthen and tone muscles and increase bone mass. Resistance training should not be confused with weightlifting, power lifting or bodybuilding, which are competitive sports involving different types of strength training with non-elastic forces such as gravity (weight training or plyometrics) an immovable resistance (isometrics, usually the body's own muscles or a structural feature such as a door frame).

Whether or not increased strength is an objective, repetitive resistance training can also be utilized to elevate aerobic metabolism, for the purpose of weight loss, and to enhance muscle tone.

Resistance exercise equipment has therefore developed into a popular tool used for conditioning, strength training, muscle building, and weight loss. Various types of resistance exercise equipment are known, such as free weights, exercise machines, and resistance exercise bands or tubing.

Various limitations exist with the prior art exercise devices. For example, many types of exercise equipment, such as free weights and most exercise machines, are not portable. With respect to exercise bands and tubing, they may need to be attached to a stationary object, such as a closed door or a heavy piece of furniture, and require sufficient space. This becomes a problem when, for example, the user wishes to perform resistance exercises in a location where such stationary objects or sufficient space are not readily found.

Resistance bands are also limited to a single resistance profile in which the amount of resistance changes as a function of angular displacement of the joint under load. This may result in under working the muscles at the front end of a motion cycle, and over working the muscles at the back end of the cycle. Conventional elastic devices also provide a unidirectional bias that varies in intensity throughout an angular range but not in direction. Such devices thus cannot work both the flexor and extensor muscles of a given motion segment without adjustment, and may be uncomfortable due to the constant bias even in the absence of motion.

A need therefore exists for low profile resistance based wearable toning garments that may be used on their own without the need to employ other types of equipment, that free the wearer for other simultaneous activities, and that can apply a non-elastic load throughout both a flexion and extension range of motion.

SUMMARY OF THE INVENTION

There is provided in accordance with one aspect of the present invention, a technical garment configured to receive a modular, interchangeable resistance element. The garment comprises a waist portion with right and left lateral sides, and right and left legs. A first connector is carried by the right lateral side and a second connector is carried by the left lateral side of the garment.

A left hip resistance unit is carried by the garment such that movement of the left leg portion relative to the waist portion is resisted by the left hip resistance unit, and a right hip resistance unit carried by the garment such that movement of the right leg portion relative to the waist portion is resisted by the right hip resistance unit. A first (e.g., left) sensor and optionally also a second (e.g., right) right sensor are also provided, wherein the left and right sensors each measure force exerted by a wearer against the respective left and right resistance units throughout a range of motion. The sensors may comprise force sensors, proximity sensors, or other sensors for generating data from which power or incremental power or change in power can be determined. The left and right resistance units may each impose a resistance of at least about 5 inch pounds, or at least about 10 inch pounds, or at least about 15 inch pounds.

At least one of the sensors is configured to measure force applied against the resistance unit during extension. At least one of the sensors is configured to measure force applied against the resistance unit during flexion. At least a left and a right sensors may be configured to measure force applied against the respective resistance units during extension. At least a left and a right sensor may be configured to measure force applied against the respective resistance units during flexion.

The system may additionally include a sensor for determining angular velocity of the leg throughout the range of motion. The system may also include electronics for capturing data related to stride length, stride rate, stride count and/or angular position of at least one of the left and right leg. The system may additionally include a processor, for determining at least one performance metric such as incremental power or change in power exerted throughout the range of motion. A transmitter may be provided, for transmitting raw or processed data to a remote device, such as force data, angular velocity data or other biomechanical or biometric data.

The training system may additionally comprise a left knee resistance unit and a right knee resistance unit. The left and right hip resistance units may comprise rotatable viscous dampers. The system may be configured to impose a first level of resistance to movement across a hip and a second level of resistance across a knee, and the first level is greater than the second level. The resistance units may be removably carried by the garment. Each resistance unit may comprises a housing and a femoral lever extending from the housing. Each force sensor may be in force transmitting contact with a femoral lever or a rotational component of the resistance unit.

There is also provided a wearable resistance and power measurement system, comprising: a wearable support, a resistance element carried by the support; a sensor for sensing force exerted by the wearer; a processing module for processing sensed force data; and a transmitter for transmitting data to a remote device. The transmitter may be an ANT+ configured transmitter. The processing module may be configured to determine power exerted to overcome resistance imposed by the resistance element. At least some of the electronics may be carried in an electronics module, which may be removably connected to the resistance unit.

Further features and advantages of the present invention will become apparent to those of skill in the art in view of the detailed description of preferred embodiments which follows, when considered together with attached drawings and claims.

DETAILED DESCRIPTION OF THE PREFERRED EMBODIMENT

Figure 1:
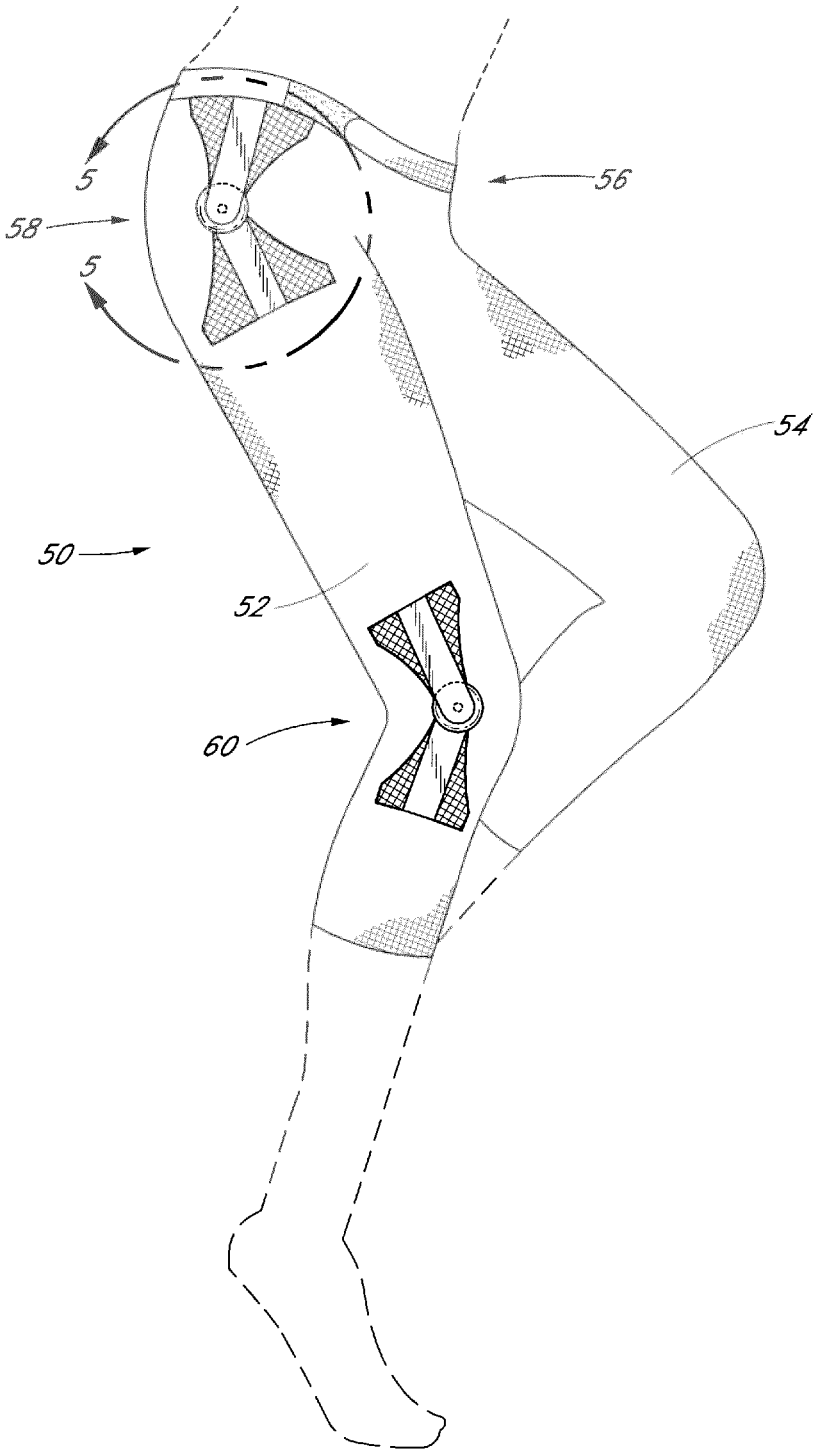
FIG. 1 is a side elevational view of a toning garment showing a right hip and a right knee resistance unit.

Detailed descriptions of the preferred embodiments are provided herein. It is to be understood, however, that the present invention may be embodied in various other forms. Therefore, specific details disclosed herein are not to be interpreted as limiting, but rather as a basis for the claims and as a representative basis for teaching one skilled in the art to employ the present invention in virtually any appropriately detailed system, structure or manner.

In general, the devices in accordance with the present invention are designed to provide resistance to motion between a first region and a second region of the body such as across a simple or complex joint, (e.g., hip, knee, shoulder, elbow, etc.), throughout an angular range of motion. The resistance can be either unidirectional, to isolate a single muscle or muscle group, or preferably bidirectional to exercise opposing muscle pairs or muscle groups. Optionally, the device will be user adjustable or interchangeable to select uni or bidirectional resistance, and/or different resistance levels.

The specific levels of resistance will vary depending upon the targeted muscle group, and typically also between flexion and extension across the same muscle group and the training or toning goal. Also wearer to wearer customization can be accomplished, to accommodate different training objectives. In general, resistances of at least about 10, and often at least about 15 or 18 or 20 or more inch-pounds will be used in heavy toning or strength building applications on both flexion and extension. All torque ratings described herein represent the torque measured at 40 degrees per second, which is an angular velocity that approximates walking.

Toning garments intended for long term wear or lighter toning may have lower resistance, with extension normally equal to or greater than flexion. Torque provided by a resistance element intended for the hip for toning garments may be at least about 4 in-lbs., sometimes at least about 6 or 8 or 10 or more in-lbs. depending upon the desired result, measured at 40 degrees per second. Torque will typically be less than about 20 in-lbs., and often less than about 16 or 14 in-lbs. In some implementations, torque will be within the range of from about 2-5 in-lbs for a 'light' toning element; within the range of from about 5-8 in-lbs for a 'medium' toning element; and within the range of from about 8-12 or 15 in-lbs for a 'heavy' toning element.

Devices specifically configured for rehabilitation (following stroke, traumatic injury or surgical procedure) may have the same or lower threshold values as desired.

Resistance experienced by the wearer is generated by a resistance element having a housing and a lever rotatable about a pivot point with respect to the housing. Rotation of the lever with respect to the housing encounters a preset level of rotational resistance generated by the internal operation of the resistance element.

The lever is secured within the leg of the garment so that it moves with the wearer's leg throughout the stride relative to a pivot point on the upper, lateral side of the hip. During a normal stride, the femur rotates about a transverse axis of rotation which extends from side to side through the approximately spherical right and left femoral heads, as they rotate within the corresponding right and left complementary acetabular cups in the pelvis. The pivot point on each of the right and left sides of the garment aligns approximately with that natural axis of rotation.

A connector is attached to the garment approximately at the pivot point and secured to prevent rotation of the connector. As long as the connector is restrained from rotating relative to the wearer's waist, the wearer will experience resistance imparted by the resistance element throughout the stride cycle. However, if the resistance exceeds a predetermined rating for a given garment, torque from the wearer's stride may cause the connector to rotate, by stretching the fabric in a twisting pattern concentrically about the axis of rotation. Twisting of the connector about its axis will absorb torque generated by the resistance element, thereby reducing the resistance perceived by the wearer, and the effectiveness of the system.

In view of the foregoing, the connector is secured with respect to the garment in a manner that will not permit it to rotate during use of a resistance element for which the garment is rated. Thus, there is an interplay between the stretch of the garment, the maximum anticipated torque applied by the wearer, and the manner in which the resistance element is secured to the garment. A connector mounted on a non-stretch garment, a garment fabricated with non-stretch panels or straps, or a harness constructed with non-stretch materials may be able to function under substantial applied loads without failure. Garments with higher stretch fabric and/or lower tensile strength to failure levels will only support relatively lower applied torque levels, unless supplemented with lower stretch filaments, lower stretch fabrics or other reinforcement straps or materials as will be appreciated by those of skill in the art.

In general, a garment 'failure' point is considered to have been achieved when the amount of rotational torque applied to the connector will rotate the connector (by stretching/deforming the garment) at least about 15 degrees, while the garment is being worn by a person or equivalent three dimensional fixture that stretches the garment within the range intended by the manufacturer (the garment is of the appropriate size for the wearer or fixture). Preferably, the connector will rotate no more than about 10 degrees, or no more than about 5 degrees, or optimally no more than about 3 degrees upon application of the maximum rated torque for that garment.

A light weight toning garment, for example, depending upon the garment stretch characteristics, may be able to withstand application of at least about 6 or 8 or 10 inch pounds of torque, before rotation of the connector through an angle of 5 degrees or other specified rating. A higher resistance garment may be able to withstand application of at least about 10 or 12 or 14 inch pounds of torque, before exceeding its rating. More athletic garments or harnesses, with woven nylon or leather straps for example, can be configured to withstand applied torques of at least about 20 or 25 or 30 or more inch pounds, depending upon the intended performance. Optimization of the foregoing variables for a particular product can be accomplished by those of skill in the art in view of the disclosure herein, to obtain a garment and resistance unit pairing that meet the desired performance characteristics.

Referring to FIG. 1, there is illustrated a toning garment 50 in accordance with the present invention. The toning garment 50 includes a right leg 52, a left leg 54, and a waist 56. As for all garments disclosed herein, the toning garment 50 will preferably be bilaterally symmetrical. Accordingly, only a single side will be discussed in detail herein.

Figure 25:
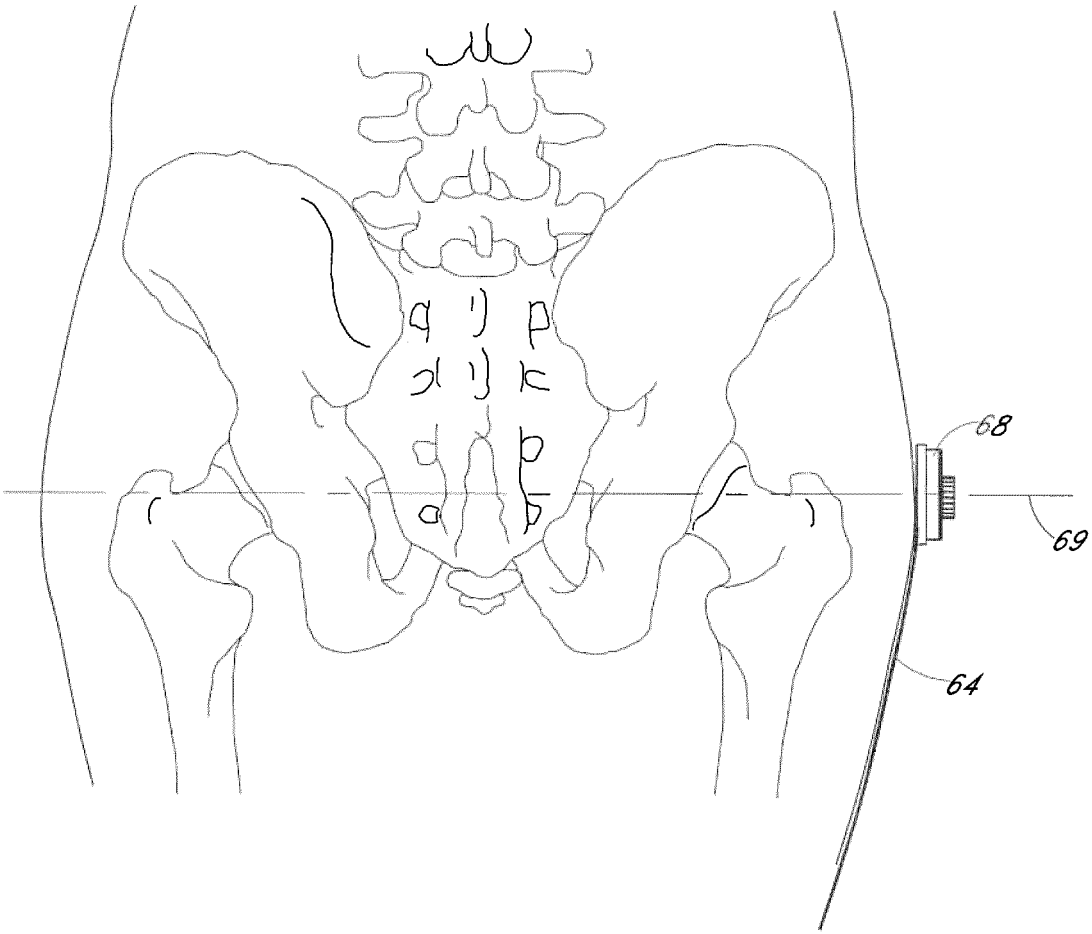
FIG. 25 is a posterior elevational view of a human pelvis, showing the axis of AP plane rotation relative to the iliac crest and a right side resistance unit of the present invention in an as worn orientation.

In the illustrated embodiment, the right leg 52 is provided with a hip resistance unit 58. Right leg 52 is additionally provided with a knee resistance unit 60. Each leg of the toning garment 50 may be provided with either the hip resistance unit 58 or the knee resistance unit 60, with or without the other. The left and right hip resistance units will preferably have an axis of rotation that is functionally aligned with a transverse axis of rotation which extends through the wearer's left and right hip axes of rotation. See, e.g., FIG. 25. Functional alignment includes precise alignment (coaxial) however due to the different fit that will be achieved from wearer to wearer, precise alignment may not always occur. Due to the stretchability of the garment, minor misalignment may self correct or not present adverse performance. Similarly, the knee resistance units, if present, will preferably have an axis of rotation that is functionally aligned with the transverse axis of rotation that extends through the center of rotation of each knee.

Figure 2:
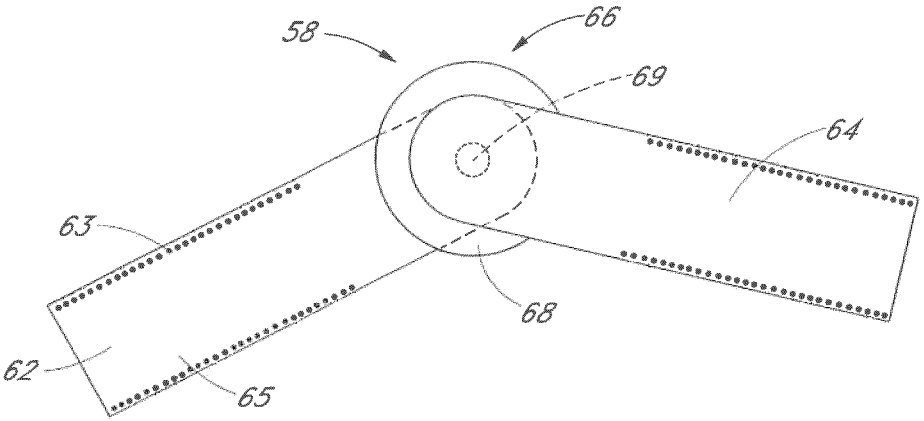
FIG. 2 is a plan view of a toning garment resistance unit.

Referring to FIG. 2, the hip resistance unit 58 will be described in further detail. The left and right hip resistance units, and both the right and left leg knee resistance unit 60 may be constructed in a similar manner although may impart different torque levels.

The hip resistance unit 58 is provided with a first attachment such as a first lever 62, and a second attachment such as a second lever 64 connected by a pivotable connection 66. The pivotable connection 66 comprises a resistance element 68 which provides resistance to angular movement between a primary longitudinal axis of first lever 62 and a primary longitudinal axis of second lever 64. In the as worn orientation, the axis of rotation 69 is preferably substantially aligned with an axis of rotation of the joint with which the resistance element is associated.

A lever as used herein refers to a structure that mechanically links a docking plate, connector, housing or resistance element to a portion of the garment or wearer at or above or below the resistance unit, so that movement of the wearer is resisted by the resistance unit and applies a torque to the point of attachment to the garment without undesirable stretching or wrinkling of the garment. The lever may take a conventional form, as illustrated in FIG. 2, and comprise an elongate element having a length generally at least about 2 inches, in some embodiments at least about 4 or 6 or 8 inches to provide better leverage and attachment force distribution. The element may a have a width of at least about 0.25 inches, and in some embodiments at least about 0.5 inches or 1.0 inches or 2 inches or more but normally less than about 3 inches or 2.5 inches. The thickness may be less than about 0.25 inches, preferably less than about 0.125 inches and in some embodiments less than about 0.050 inches to maintain a low profile that can be concealed within or underneath the fabric of the garment. The lever may comprise a two part telescoping element, with a rod axially movably carried by a support such as a tube, as is discussed further below. The lever may comprise any of a variety of washable, non-corrosive materials such as nylon, Teflon, polyethylene, PEBAX, PEEK or others known in the art. Preferably the lever arm has sufficient structural integrity to transmit force in the anterior—posterior direction in the case of hip and knee resistance units, but is flexible in the medial—lateral direction to enable the garment to follow the contours of the body. See, e.g., FIG. 25.

The inferior and superior lever arms may be similar to each other for a resistance unit mounted at the knee. For a resistance unit mounted at the hip, the lever arms may be distinct. For example, the inferior lever arm at the hip may conveniently comprise an elongated femoral lever, such as that illustrated in FIG. 1 or 16, in which the axial length of the lever is at least about two times, and may be at least about three times or five times its width. This lever arm can extend down the lateral side of the leg, secured by the garment approximately parallel to the femur.

The superior lever arm may have a vertical component extending upward in the coronal plane towards the waist, with a bend or "T" so that a superior component extends in a transverse direction, either partially or completely circumferentially around the waist of the wearer. The transverse component may comprise a stretch fabric or relatively inelastic belt with a buckle or fastener. The superior lever may take the form of a "V" with the connector at the bottom (apex) of the V and the legs of the V stitched or otherwise bonded to the waist.

Alternatively, the superior lever arm may comprise a fabric, polymeric, or metal (e.g. Nitinol mesh) force transfer patch, such as a circular, square, rectangular, oval, "T" or other shape which can be secured to the rotational damper or a docking station for receiving the rotational damper, and also secured to the garment or the wearer or formed as an integral part of the garment, in a manner that resists rotation of the damper with respect to the garment during movement of the inferior lever. Thus, "lever" as used herein is a force transfer structure which resists rotation of the dock and is not limited to the species of a conventional elongate arm.

Figure 8:
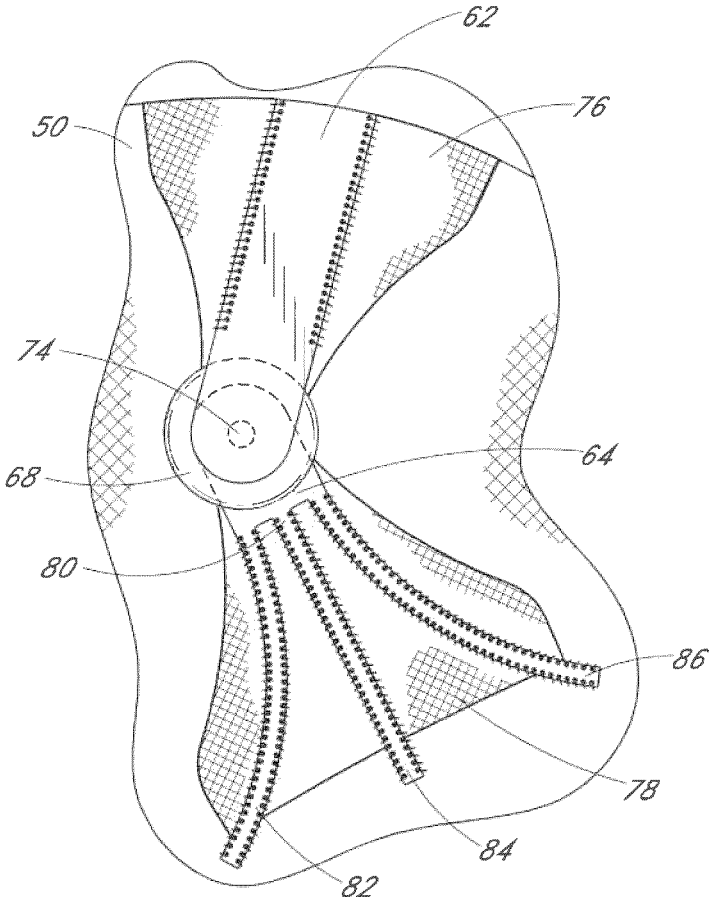
FIG. 8 is a resistance unit secured to a garment, showing an alternative reinforced femoral attachment configuration.

Either the superior or inferior lever may comprise a docketing platform for attachment to the resistance unit, and a plurality of two or three or four or more legs such as straps that are secured such as by stitching or adhesive bonding to the garment. See FIG. 8 in which a dock 80 supports at least an anterior element 82, a medial element 84 and a posterior element 86. Each of the elements is preferably relatively inflexible in the anterior—posterior direction, but flexible in the medial—lateral direction to enable the anterior element 82 to wrap at least partially around the side and optionally around the front of the leg. The posterior element 86 preferably wraps at least partially around the posterior side of the leg. The lever elements can be configured as a system of straps. The elements can comprise one or more strands or technical fabric supports, sufficient to transmit the forces involved in a given garment and resistance unit system.

Figure 5:
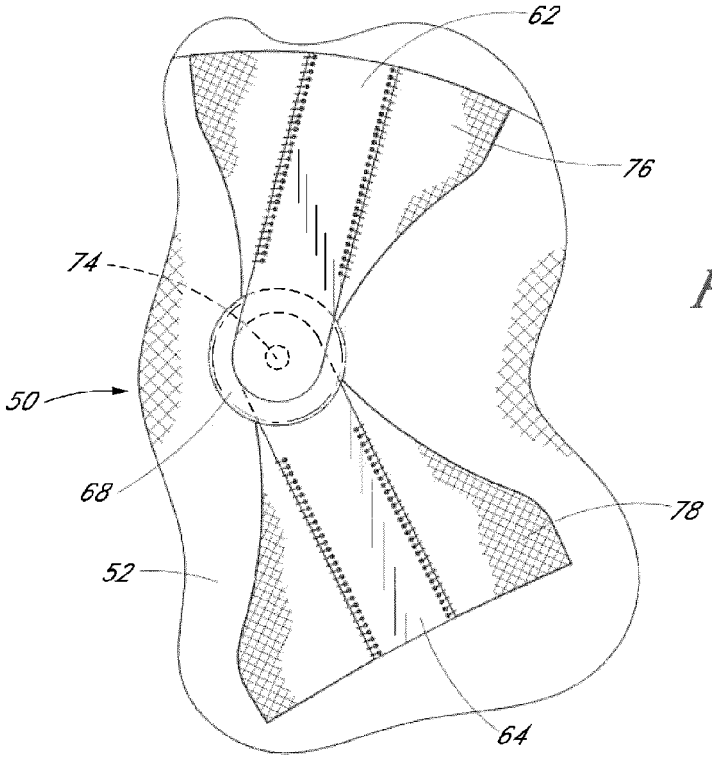
FIG. 5 is a resistance unit as in FIG. 2, attached to a garment with force distribution layers.
Figure 6:
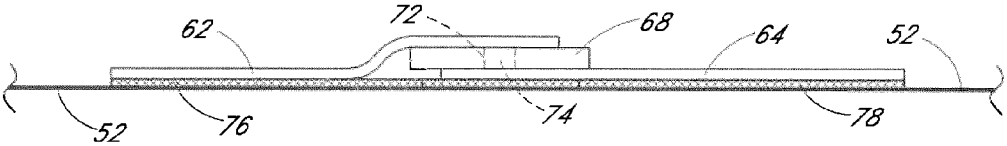
FIG. 6 is a side elevational view of the resistance unit and garment assembly of FIG. 5.

The hip resistance unit 58 may be secured to the toning garment 50 in any of a variety of ways. Referring to FIGS. 2 and 5, the first lever 62 is provided with at least a first set of apertures 63 and optionally a second set of apertures 65 to receive a filament such as a polymeric or fabric thread, for sewing the hip resistance unit 58 to the garment. Stitching may alternatively be accomplished by piercing the first lever 62 directly with the sewing needle, without the need for apertures 63 or 65. Alternatively, the first lever 62 can be secured to the garment using any of a variety of fastening techniques, such as adhesive bonding, grommets or others known in the art.

Since torque equals force times radius or length, a lever is convenient to distribute force to the garment. The inferior lever can extend inferiorly along the coronal plane, along a portion of the length of the femur. The longitudinal axis of the first, superior attachment at the hip may be transverse to the longitudinal axis of the second lever 64 at the midpoint of its range of motion, such that the first lever is aligned like a belt, circumferentially extending along a portion of or approximately parallel to the wearer's waist displaced superiorly from the axis of rotation of the wearer's hip. Normally the hip axis of rotation will be offset inferiorly by at least about 3 inches, and often 5 inches or more from the iliac crest, which approximates the top of the belt line for many wearers. Alternatively, the housing of the resistance element or docking platform may be sewn or adhesively bonded or otherwise attached directly to reinforced fabric at the hip such as by circular weaving or stitching techniques known in the art.

The resistance element 68 may be any of the resistance elements disclosed in U.S. patent application Ser. No. 14/665,947 filed Mar. 23, 2015, now published as U.S. 2015/0190669, the disclosure of which is hereby incorporated by reference in its entirety herein. In one embodiment, resistance element 68 may comprise a rotary damper containing a fluid such as air, water or a viscous media such as silicone oil. The rotary damper may be rated to provide anywhere within the range of from about 0.1 inch pounds to about 50 inch pounds torque at a rotational velocity of 40 degrees per second depending upon the joint or other motion segment to be loaded and desired intensity. Typical torque ranges are disclosed elsewhere herein.

Resistance imposed at the knee will generally be less than at the hip. Values of generally no more than about 85% or 50% or 35% of the torque at the hip may be desirable in a toning garment at the knee, measured at 40 degrees per second. As discussed elsewhere herein, the resistance element at any given joint can provide the same or different resistance (including zero) upon flexion or extension.

Figure 3:
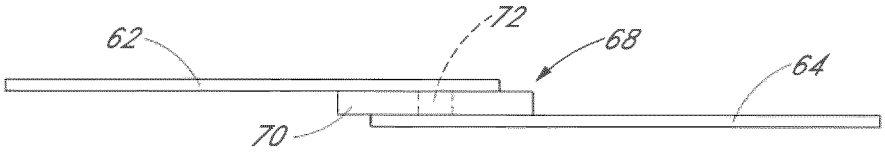
FIG. 3 is a side elevational view of the resistance unit of FIG. 2.
Figure 4:
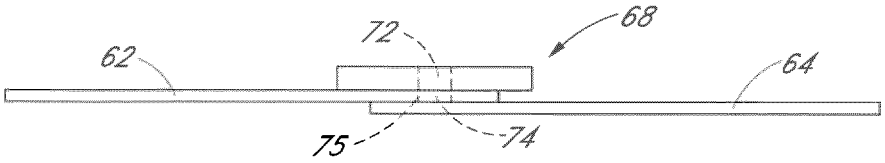
FIG. 4 is a side elevational view of an alternate configuration of the resistance unit of FIG. 2.

Referring to FIGS. 3-4, the resistance element 68 may comprise a generally disc shaped housing, having a diameter of less than about 4 or 3 or 2.5 inches, and a thickness in an axial direction of less than about 0.75 and preferably less than about 0.5 inches. A connector 72 is rotatably carried by the housing 70. Connector 72 may be a post or an aperture, having a non-circular (e.g. square, hexagonal, triangular, circular with at least one spline or flat side) keyed cross-section such that a complementary post or aperture may be axially positioned in engagement with the connector 72, to transmit rotational torque.

Referring to FIGS. 3-4, the resistance element 68 housing 70 may be secured to either the first lever 62 or the second lever 64 or neither, as is described below. The connector 72 may be secured to the other of the first lever 62 and second lever 64. Resistance element 68 thus provides resistance to motion of the first lever 62 with respect to the second lever 64, throughout an angular range of motion about the axis of rotation 70.

In an alternative configuration, the levers may be mounted on the same side of the resistance element 68 to provide an overall lower profile. Referring to FIG. 4, second lever 64 is provided with a connector 72 in the form of a post for rotationally engaging the connector on resistance element 68 which is in the form of a complementary aperture. Post 74 extends through an aperture 75 in the first lever 62. Aperture 75 has a diameter that exceeds the maximum transverse dimension of the post 74, such that post 74 may rotate without imposing any force on first lever 62. The housing of resistance element 68 is immovably secured with respect to first lever 62 such as by adhesive bonding, molding, interference snap fit or other immovable connection.

Referring to FIG. 5, a hip or knee resistance unit 68 is illustrated as secured to a garment 50 although the following description also applies to resistance elements at the elbow, wrist, ankle or knee. Depending upon the configuration of the lever arms, the stretchability of the fabric, and the level of resistance imposed by resistance element 68, one or more reinforcement or force transfer or dissipation features may be necessary to transfer sufficient force between the lever arm and the garment, while minimizing stretching or wrinkling of the garment. In the illustrated embodiment, first lever 62 is additionally provided with a first force dissipation layer 76. Force dissipation layer 76 may comprise any of a variety of meshes or fabrics, such as those disclosed previously in US 2015/0190669 and below in connection with FIG. 14.

Figure 14:
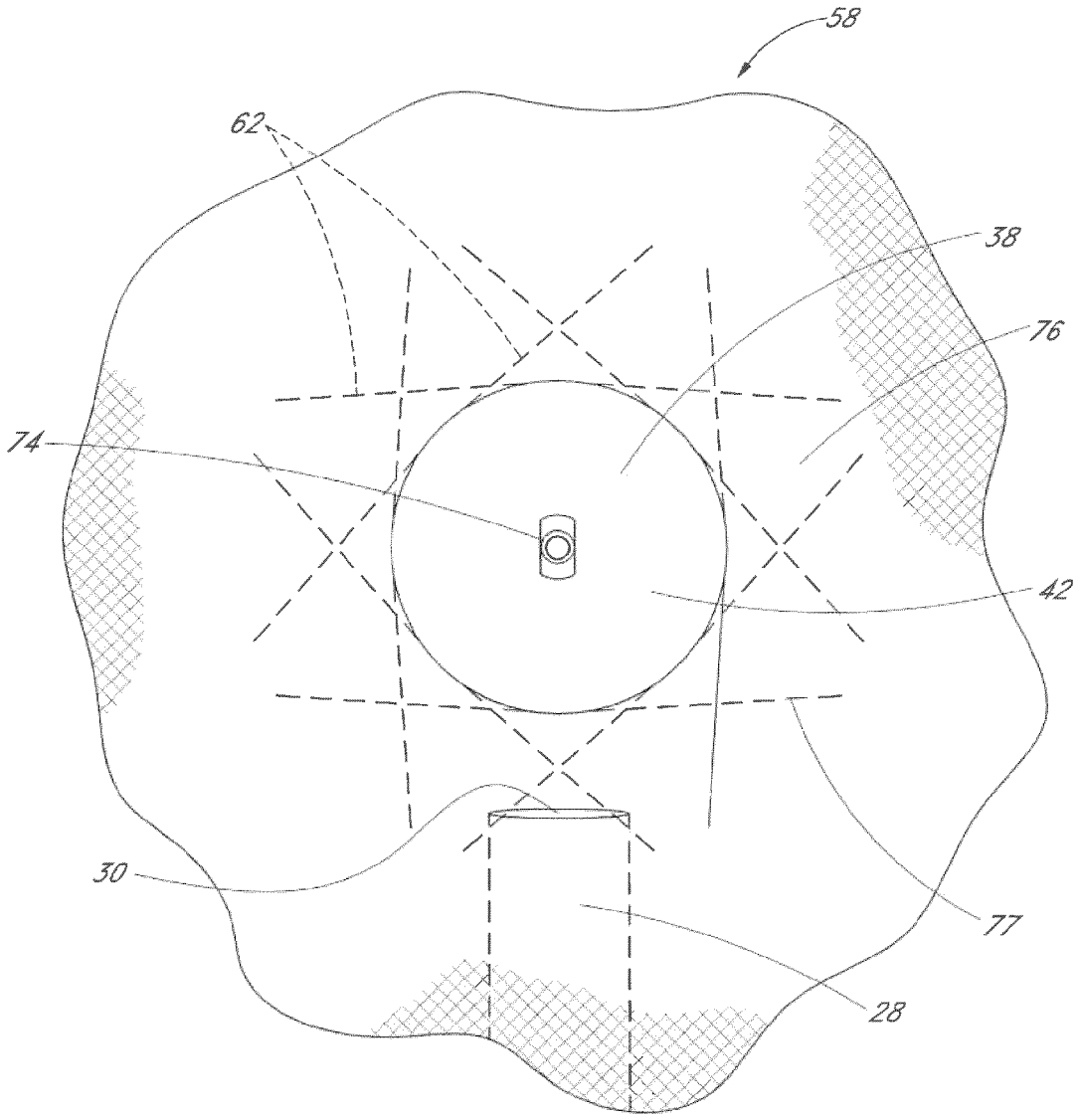
FIG. 14 is a detail view taken along the line 14-14 in FIG. 13.

In one implementation, the fabric comprises one or more strands of yarn or filament 77 having a vector extending in the as worn anterior posterior direction which exhibits relatively low stretch. See FIG. 14. A plurality of strands 77 can be woven in an orientation that is approximately at a tangent to at least about 2 or 4 or 8 or 10 or more points on a concentric circle around the rotational axis of the resistance element or force transfer layer to optimize resistance to rotation of the housing relative to the garment. Force dissipation layer 76 may be attached to the edges and/or lateral and/or medial surfaces of first lever 62 or the damper housing or docking platform for receiving a damper such as by stitching, adhesives or other fastener, and extend in the anterior posterior direction beyond the edges of the first lever 62 to provide an attachment zone both anteriorly and posteriorly of the first lever 62. In the embodiment of FIG. 14, the force dissipation layer is the lever, securing the damper against rotation with respect to the adjacent fabric overlying the axis of rotation. The attachment zones may be secured to the underlying garment by stitching, adhesives or both, or straps, strands or other fasteners known in the art.

The first force dissipation layer 76 may extend beneath, within the same plane, or across the outside (lateral) surface of the first lever 62, entrapping the first lever 62 between the force dissipation layer 76 and the garment 50. Alternatively, the force transfer layer may function as a lever.

The force dissipation layer (whether an overlay or the actual sidewall of the garment) may be molded mesh or a technical fabric weave, comprising any of a variety of strands identified in US 2015/0190669 previously incorporated by reference herein. Preferably the fabric has stretch resistance along at least one axis, which can be aligned with an axis under tension during flexion or extension due to the resistance element (e.g. the AP plane). The fabric may exhibit a higher level of stretch along other axes. The fabric also preferably exhibits low weight, high breathability and high flexibility. Some suitable fabrics include shoe upper fabric from running shoes including, for example, that disclosed in US patent publication No. 2014/0173934 to Bell, the disclosure of which is incorporated by reference in its entirety herein. Additional multilayer fabrics having good flexibility, and stretch resistance along one axis and higher stretch along a transverse or nonparallel axis, useful for the force dissipation layer are disclosed in U.S. Pat. No. 8,555,415 to Brandstreet et al; U.S. Pat. No. 8,312,646 to Meschter et al; and U.S. Pat. No. 7,849,518 to Moore et al., the disclosures of each of which are incorporated in their entireties herein by reference. Typically, the force transfer layer will have lower stretch along at least one axis than the stretch of the underlying garment.

Figure 9:
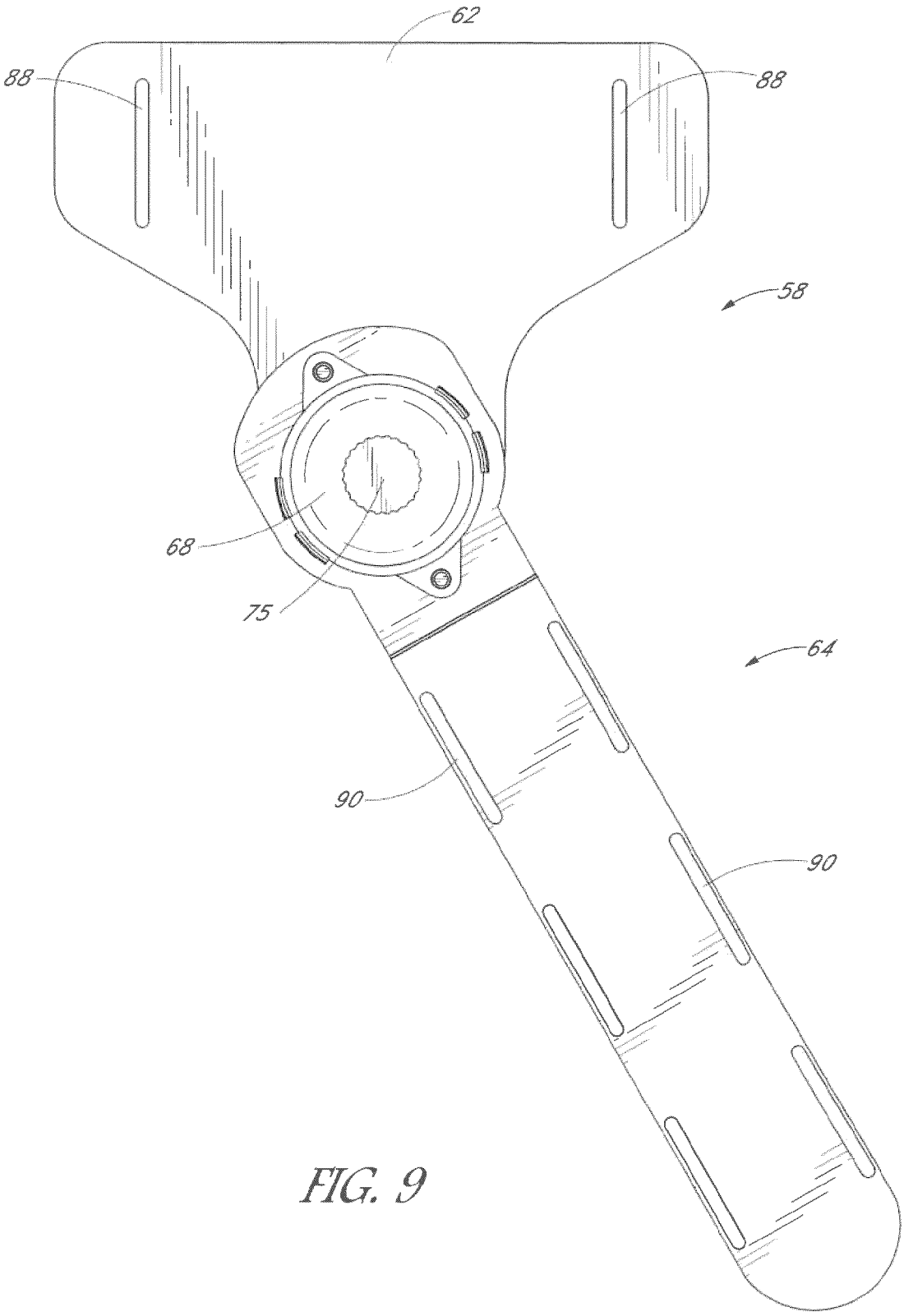
FIG. 9 is a side elevational view of a resistance unit having a superior connector, an inferior, femoral connector and a resistance element.

Referring to FIG. 9, there is illustrated a resistance unit 58 comprising a first lever 62 configured for attachment to the garment or to the wearer to at least approximately align the rotational axis of the resistance element with the hip, as discussed below. First lever 62 may be provided with any of a variety of attachment structures such as a force dissipation layer, straps, Velcro or at least one and typically two or more slots, snaps or other attachments 88 for connection to a strap, belt or other fastener associated with the garment. First lever 62 may comprise any of a variety of polymeric or metal sheets or mesh membranes, printed, molded or machined parts or fabrics disclosed elsewhere herein, which may be bonded or stitched directly to the garment, or held by a belt to the outside of the garment.

Figure 7:
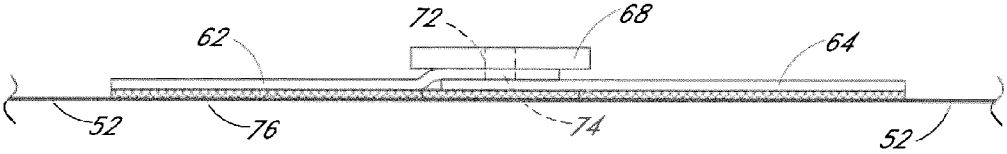
FIG. 7 is a side elevational view of an alternate configuration of the resistance unit and garment assembly of FIG. 5.

Lever 62 is pivotably connected to a second lever 64 by way of resistance element 68 as has been described. Resistance element 68 may comprise any of a variety of resistance elements, such as friction brakes, malleable materials, clutches, or rotary viscous dampers as has been discussed. Resistance element 68 may be securely permanently or removably mounted to the second lever arm 64 (as illustrated) or to first lever arm 62 or both. A post 74 (FIG. 7) is secured to the first lever arm 62, and extends through a complementary aperture in the resistance element 68. In this manner, rotation of the second lever 64 about the rotational axis of resistance element 68 with respect to the first lever 62 experiences the resistance provided by resistance element 68. Second lever 64 may be provided with a force dissipation layer and/or one or two or three or four or more inferior connectors 90. As illustrated, inferior connectors 90 may be apertures such as slots for receiving a strap or filament for securement to the pant leg or the leg of the wearer.

Preferably, a quick release 75 is provided, to engage and disengage the resistance element, and or enable disassembly into component parts. Quick release 75 is illustrated as a knob which may be rotatable, or axially movable between a first and a second position to engage or disengage the damper. Any of a variety of quick release mechanisms maybe utilized, such as a threaded engagement, or a pin or flange which can rotate into engagement behind a corresponding flange or slot. Quick release 75 allows rapid removal of the damper, or the damper and femoral lever arm, as is discussed in more detail below.

Figure 10:
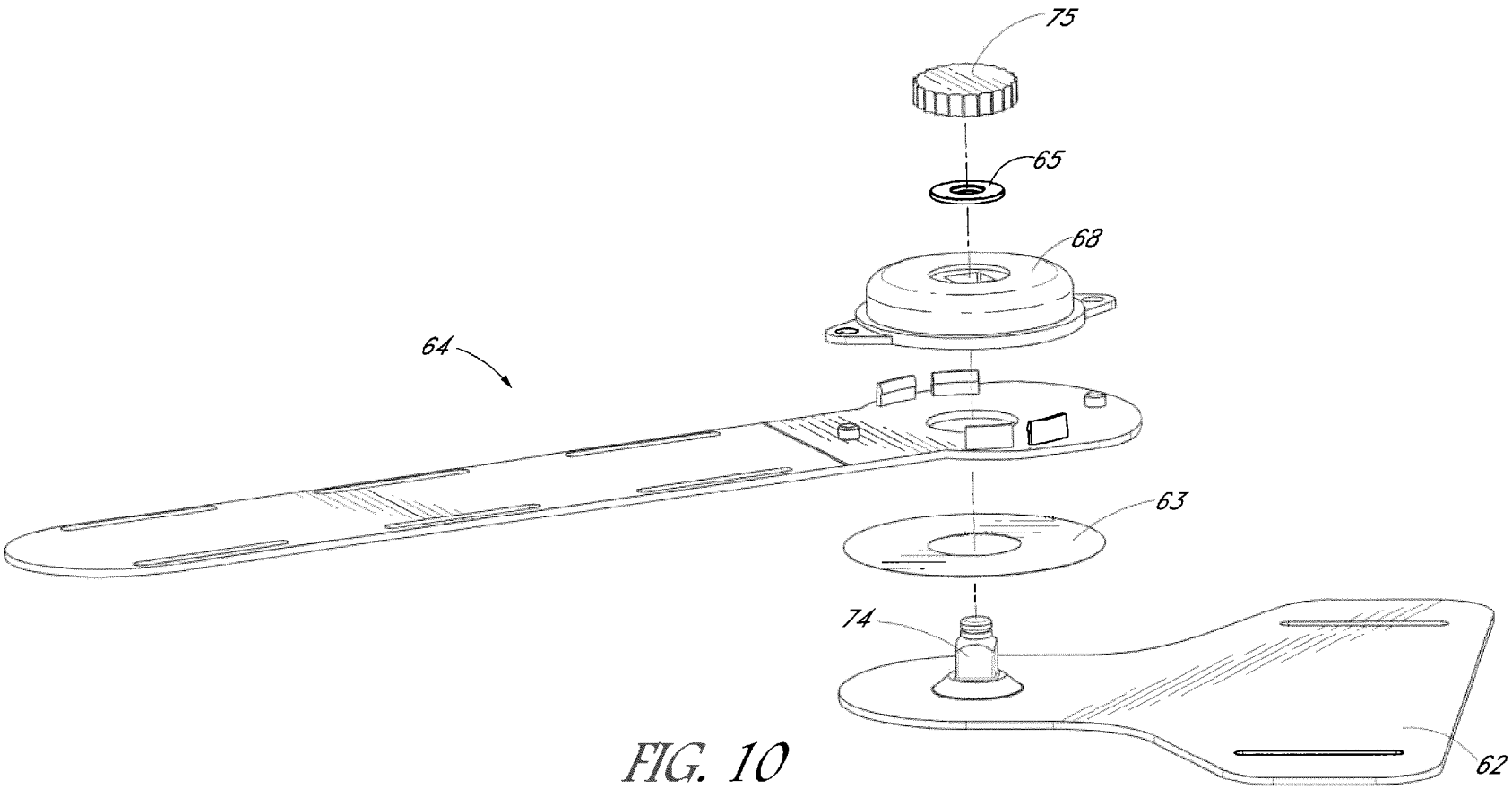
FIG. 10 is an exploded view of the resistance unit of FIG. 9.

Referring to FIG. 10, an exploded view illustrates the first lever 62 having post 74 secured thereto such that rotation of the post is transferred to the lever 62. A friction modifier 63 such as a washer or membrane that may comprise a friction reducing material such as a lubricious polymer (e.g., PTFE) may be provided to separate the first lever 62 from second level 64. Alternatively the friction modifier 63 may be a friction enhancer, such as one or two or more washers having a friction enhancing surface texture, which create resistance to movement and can therefore supplement or replace the rotational damper.

Connectors 65 may be provided for locking the construct together. Connectors 65 may comprise one or more locking rings, nuts, pins or other structure. Preferably, a quick release mechanism 75 such as a quick release lever, rotatable knob or snap fit that allows the wearer to quickly engage or disengage the resistance unit 58 into component subassemblies, as will be described.

Skeletal motion at the hip during normal activities including walking involves complex, multidirectional movement of the femoral head within the acetabular cup. However when viewed to isolate out the single component of movement in the anterior—posterior ("AP") plane, the femur swings forward and back like a pendulum, pivoting about a rotational axis 69 (FIG. 25) which extends laterally through the approximate centers of the roughly spherical left and right femoral head.

Many of the resistance elements disclosed herein exhibit a fixed axis of rotation. Ideally, the exercise garment of the present invention of the type having a fixed rotational axis can be worn by a wearer such that the rotational axis of the resistance element is coincident with the rotational axis 69 of the femur. However, due to a combination of factors including the stretch of the fabric and dissimilarities from wearer to wearer in the contour of the soft tissue between the femur and the garment, the two rotational axes may not perfectly align. An imaginary straight-line in the AP plane which connects the anatomical rotational axis and the rotational axis of the resistance element defines a non-zero offset in the case of misalignment between the two axes of rotation which has the effect of a piston like pulling or pushing the second lever 64 along its longitudinal axis relative to the femur throughout the stride cycle. If force in all directions from the second lever 64 is effectively transmitted to the garment, this axial reciprocal movement of the second level 64 with respect to the wearer and garment through the offset distance 26 may cause a variety of undesirable results, including chafing of the garment up and down against the leg, wrinkling, buckling or damaging the fabric of the garment and/or the material of the second lever 64.

It may therefore be desirable to decouple axial movement of the second lever 64 from the garment, while maintaining a high degree of force transmission between the second lever 64 and the garment in the AP plane.

Figure 13:
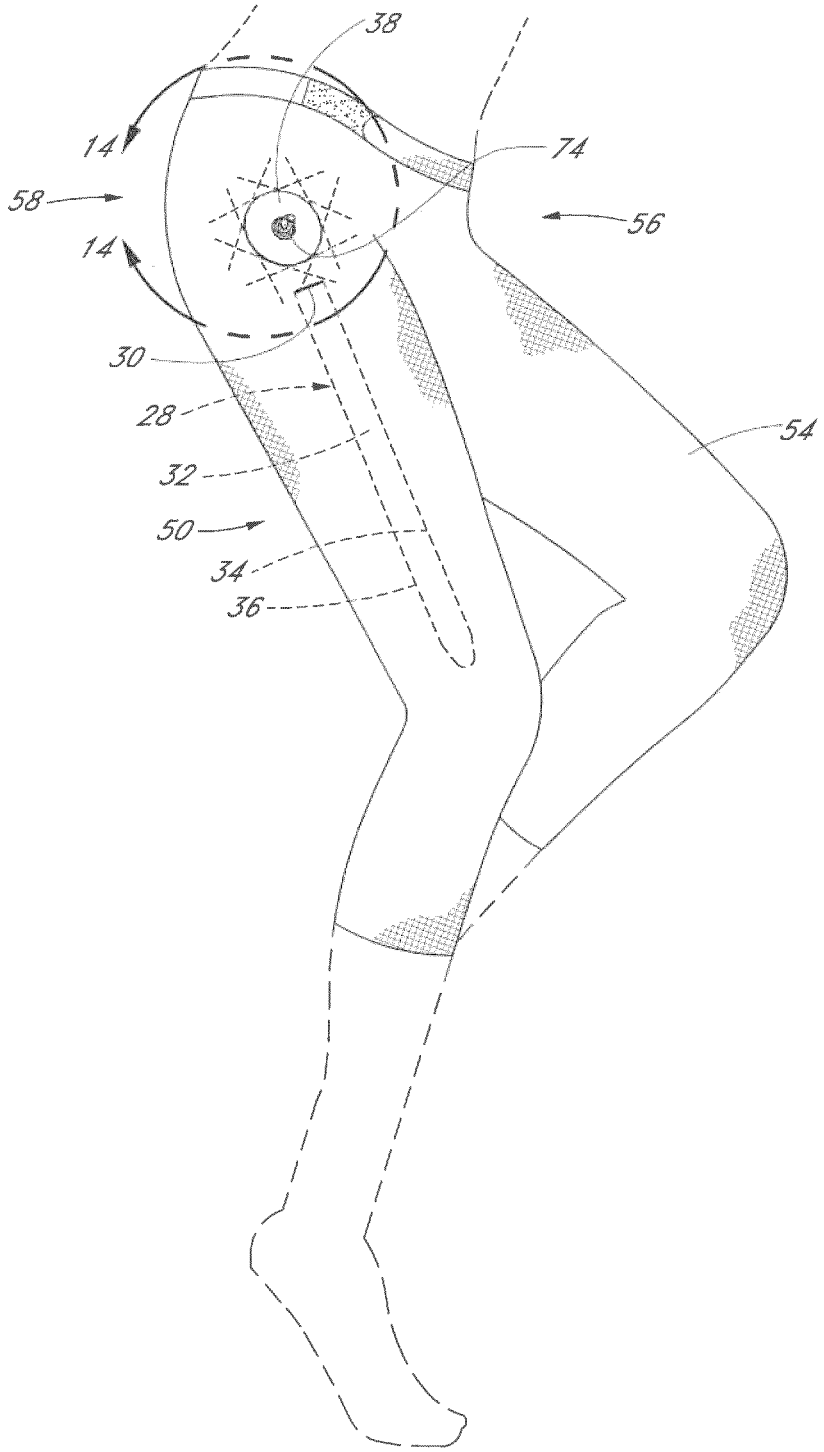
FIG. 13 is a side elevational view of a lower body garment, having a resistance unit docking station aligned with the hip.

Referring to FIG. 13, one convenient structure for accomplishing the foregoing is to provide an elongated pocket 28 extending in an inferior superior direction along the lateral side of each leg of the garment. The pocket 28 comprises an opening 30 at a superior end thereof, providing access to an elongate cavity, for removably receiving the second lever 64. An anterior limit 34 of the pocket 28 and a posterior limit 36 of the pocket 28 are dimensioned relative to the width of the second lever 64 to provide a snug fit against relative AP movement, but which permits axial sliding of the second lever 64 along its longitudinal axis within the pocket. The axial length of the pocket exceeds the axial length of the second level 64, thereby enabling the second level 64 to reciprocate up and down within the pocket 28 without transmitting inferior superior axis movement to the garment.

The axial length of the pocket 28 is preferably at least about 4 inches, and in some implementations it is at least about 6 inches or 8 inches or more in length, depending upon the garment size, fabric stretch and resistance level of the resistance unit. The length of the pocket will preferably exceed the length of the associated lever by an amount sufficient to compensate for the likely offset between the rotational axis of the hip and the rotational axis of the damper. Typically, that offset will be no more than about 2 inches, and preferably no more than about 1 inch or 0.5 inches.

The lever 64 will preferably axially reciprocate within the pocket 28 with minimal friction. For this purpose, the lever may be constructed from or coated with a lubricious material. In addition, the interior surface of the pocket preferably comprises a material with a low coefficient of friction with respect to the surface of the lever. The interior of the pocket 28 may be provided with one or two or five or 10 or more axially extending filaments or raised ridges, to reduce the contact surface area between the lever 64 and the pocket 28. The interior of the pocket 28 may be lined either partially or completely with a membrane having a low friction surface. Thus, a pocket liner comprising any of a variety of materials such as nylon, PTFE, polyethylene terephthalate, PEEK, metal films or other materials may be utilized depending upon the intended performance characteristics.

The inside width of the pocket is preferably dimensioned such that the lever is not able to move significantly in the AP plane with respect to the pocket. The width of the pocket with the lever installed therefore preferably only exceeds the width of the lever by a sufficient amount to permit the desired axial movement of the lever without transferring axial movement to the garment. The width may be adjustable between a larger width such as for inserting the lever, and a smaller width for efficient lateral force transfer. That may be accomplished by fabricating the pocket from compression fabric so that it stretches to receive the lever. Alternatively, a zipper may be advanced along the length of the pocket to bring two parallel edges closer together, with straps connected to the pant leg on one side of the pocket and connectable (e.g., with Velcro) to the pant leg on an opposite side of the pocket.

Alternatively, the resistance unit 58 can be provided with any of a variety of axial expansion dampers, positioned between the rotational axis of resistance element 68 and a portion of the second lever 64 which is immovably secured to the garment. Axial extension dampers may include first and second side by side or concentric telescoping components, which through relative axial sliding motion allow the second lever 64 or other attachment point to the garment to reciprocally lengthen and shorten. See, e.g., FIGS. 27-29 discussed below. Alternative structures such as springs, collapsible diamond shaped cells, etc., can allow axial shortening and lengthening of the second lever 64 between the rotational axis and the point of attachment to the garment so that axial reciprocating movement of the femoral lever is not transmitted to the garment. The proximal end of the lever may be provided with an adjustable attachment element such as an elongate, axially extending slot which receives a complementary attachment element such as a post on the damper having two opposing flat sides so that the lever can reciprocate axially but remain rotationally keyed to the post.

Referring to FIG. 13, there is illustrated a garment having a docking station 38 for releasably receiving a resistance module 68. As illustrated in FIG. 14, the docking station 38 comprises a platform 42 for receiving a damper or other resistance module. The platform 42 comprises at least one connector 74, for connecting with the resistance module. The connector may be a post or an aperture, for keyed connection with a corresponding connector on the damper or other resistance module. The platform 42 or connector 74 may be provided with a quick release feature 44, for releasably engaging a complementary quick release control such as a lever, button or rotatable knob as has been discussed.

Figure 11:
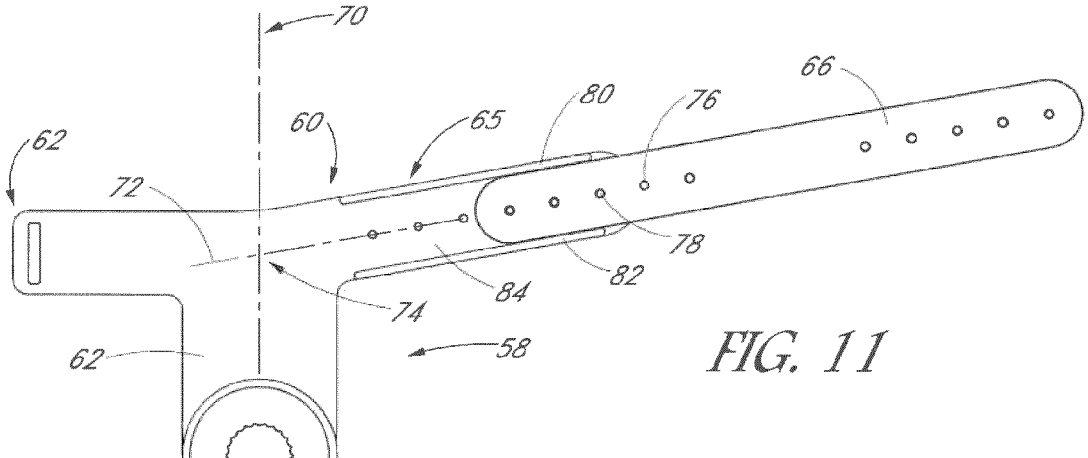
FIG. 11 is a side elevational view of a left side resistance unit, having a posterior connector for connection to a right side resistance unit.

Referring to FIG. 11, there is illustrated a left side resistance unit 58 in the form of a harness or belt, or subassembly that can be attached to or integrated into a compression pant, athletic training short or pant, or other garment. The right side is omitted for clarity. The resistance unit 58 comprises a femoral lever 64 and a resistance element 68 as has been described. In this illustration, the first lever 62 is in the form of an approximately "T" or "Y" shaped hip support 60, configured to minimize the risk of rotation of the resistance element 68 with respect to the wearer. Hip support 60 comprises an anterior connector 62, such as a buckle or strap or other fastener for fastening across the anterior of the wearer's waist. The hip support 60 additionally comprises a posterior connector 65, for connection to or across the posterior side of the wearer or garment. In the illustrated embodiment, posterior connector 65 is adjustably connected to a posterior strap 66. The posterior strap 66 may be configured to extend across the posterior of the wearer and to connect to a right side resistance unit 58, such that the hip support 60 is connected to both the right and left resistance units 58, encircling at least a portion and preferably all of the waist of the wearer in the as worn configuration.

The axis of rotation of the resistance element 68 is displaced inferiorly from the wearer's waist line along an inferior—superior axis 70 by at least about 2 or 3 or 4 or more inches. The posterior connector 65 extends along a longitudinal axis 72 which intersects with the axis 70 at an angle 74. The angle 74 causes the axis 72 to deviate from perpendicular to axis 70 by at least about 2°, and in some embodiments at least about 3° or 5° or more.

The posterior strap 66 may be adjustably connected to the posterior connector 65. In one implementation, one of the posterior strap 66 or connector 65 is provided with a plurality of apertures 76. The other is provided with at least one post 78. In an alternate embodiment, the two components may be secured by Velcro, or a buckle. In a further implementation, the strap 66 is slidably engaged with the posterior connector 65. This may be accomplished, for example, by providing a first raised rail 80 and a second raised rail 82 defining a recess 84 there between within which the posterior strap 66 can slide. Posterior connector 65 may be retained within the recess 84 such as by a flange on one or both of the rails 80 and 82, or by connecting the rails 80 and 82 to form an enclosure for receiving posterior strap 66. Enclosure may be formed by a plastic restraint, integrally formed with the posterior connector 65, or by a fabric enclosure. Alternatively, the posterior strap 66 comprises a fabric or elastic such as a belt or waist band on a pant.

The components of the hip support 60 may comprise polymeric sheet or membranes, various technical fabrics as has been described elsewhere herein, or combinations of the two, in order to optimize comfort, fit and structural integrity of the connection of the hip support 62 to the wearer. Any portions or all of the hip support may be distinct structures attached to or worn over the top or under the garment, or may be structural fabric and components woven or sewn into the garment.

Preferably, the hip support 60 is constructed largely in fabric, such that it has sufficient flexibility and durability to be comfortable, durable, and able to withstand normal washing and drying cycles. In a preferred embodiment, the first lever 62 is provided with a docking station for removably receiving and engaging the resistance element 68 and second lever 64.

Figure 12:
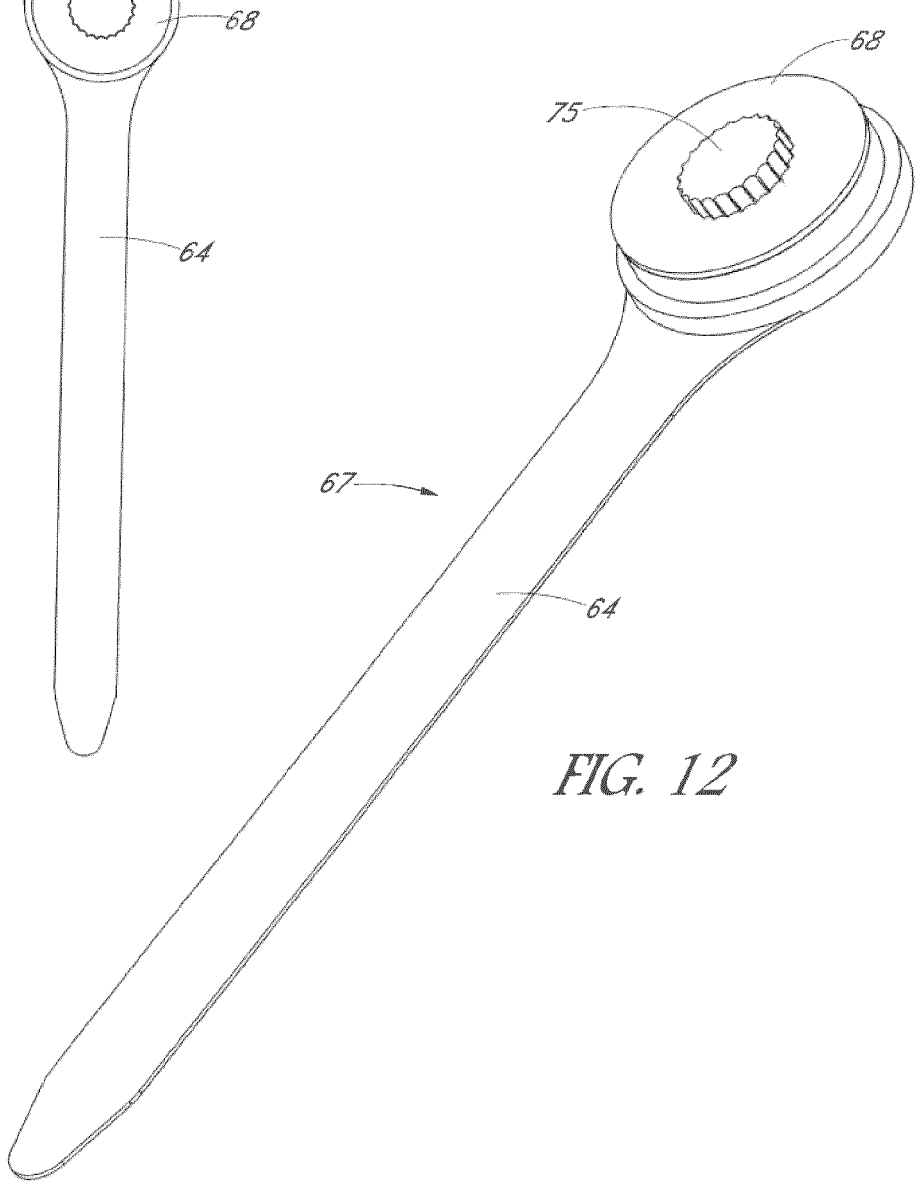
FIG. 12 is a perspective view of a detachable, modular resistance unit, having a resistance element and a femoral lever arm.

Thus, referring to FIG. 12, a modular detachable femoral resistance unit 67 may be provided. The femoral unit 67 may comprise one or both of the second lever 64 and the resistance element 68. In the illustrated embodiment, resistance element 68 is bonded or otherwise secured to or integrally molded with the second lever arm 64 to provide an integral modular femoral resistance unit 67.

Figure 15:
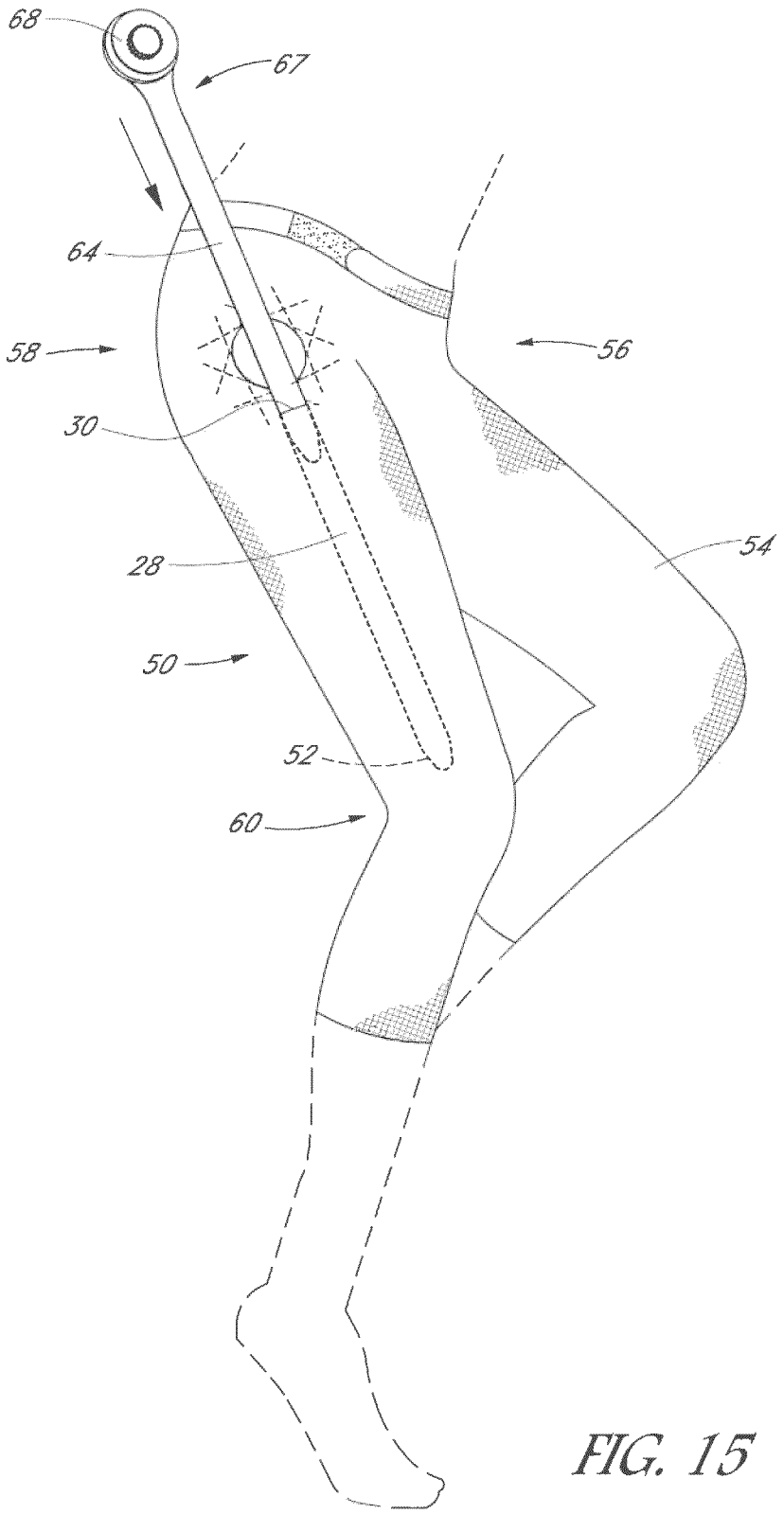
FIG. 15 is a garment as in FIG. 13, with a removable modular resistance unit partially assembled with the garment.
Figure 16:
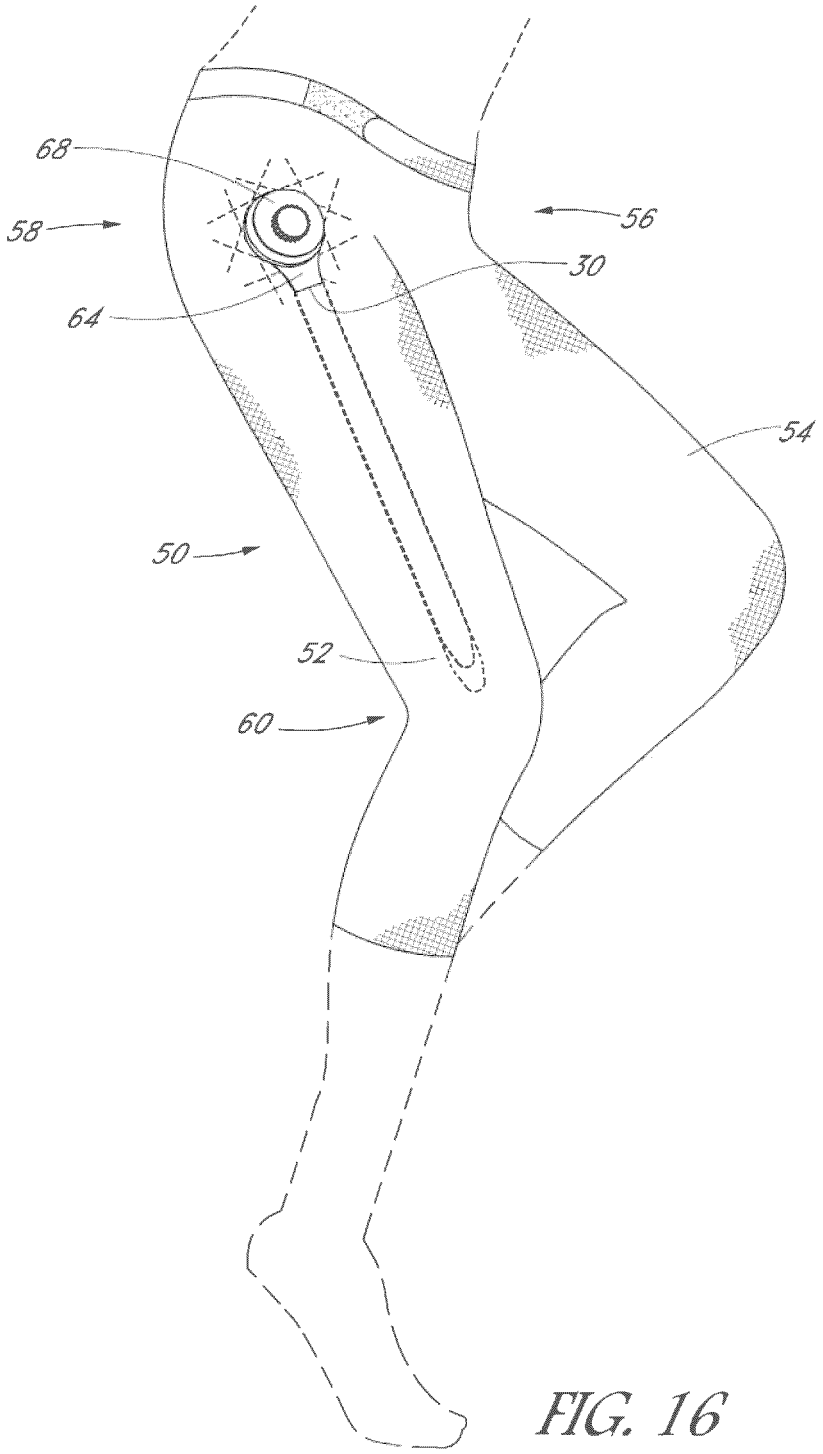
FIG. 16 is a garment as in FIG. 15, with the removable modular resistance unit fully installed, and engaged with the docking station.

Referring to FIGS. 15 and 16, this configuration allows the wearer to put the garment on with just any of the hip docking platforms disclosed herein secured thereto. Once the garment is on, the second lever 64 may be inserted within the femoral attachment element such as pocket 28 running down the lateral side of the leg or otherwise removably secured to the garment or the wearer's leg. The resistance element 68 is then aligned with the docking platform on first lever 62, seated and coupled thereto. This may be accomplished by advancing a first connector such as the aperture on resistance element 68 over a second, complementary connector such as the post on first lever 62 to achieve rotational engagement, and locking the resistance element 68 into place using any of a variety of quick lock or release features. These include interference (snap) fit, or any of a variety of twist connectors, locking pins or levers or others known in the art.

The modular femoral resistance unit 67 may be uncoupled from the docking station such as by manipulating the quick release control, and removed from the garment to permit removing the garment from the wearer, and or placing the garment in the wash. In addition, a wearer may be provided with a plurality of matched pairs of modular femoral resistance units, each pair having matched resistance elements 68 with a different level of resistance from another pair. This modularity enables the wearer to select the desired level of resistance depending upon a given use environment, as well as to facilitate washing, and optimizing the useful life of whichever components of the detachable component resistance toning system have the greatest useful life. Additional details of suitable resistance elements are disclosed in US 2015/0190669, previously incorporated by reference herein.

The training garment preferably comprises at least one stretch panel for providing a snug fit and optional compression. The panel may exhibit stretch in at least a circumferential direction around the leg and waist such as a four way stretch denim. Stretch panels may comprise any of a variety of fabrics disclosed elsewhere herein. The panel may include woven textile having yarns at least partially formed from any of polyamide, polyester, nylon, spandex, wool, silk, or cotton materials, for example. More particularly, the yarns may be eighty percent polyamide and twenty percent spandex in some configurations. When formed from a combination of polyamide and spandex, for example, the stretch woven textile may exhibit at least thirty percent stretch prior to tensile failure, but may also exhibit at least fifty percent or at least eighty percent stretch prior to tensile failure. In some configurations of the garment, the stretch in stretch woven textile may equal or exceed one-hundred percent prior to tensile failure. The optimal amount of stretch will normally be the maximum stretch that still allows the wearer to move comfortably with minimal or no rotation of the docking platform relative to the wearer's hip under normal walking or running conditions, using a resistance unit that is rated for the particular garment. Too much stretch in a direction of force imposed by the resistance unit will allow the docking station to rotate thereby stretching the fabric rather than transfer all of the wearer's motion to the resistance unit.

Figure 17:
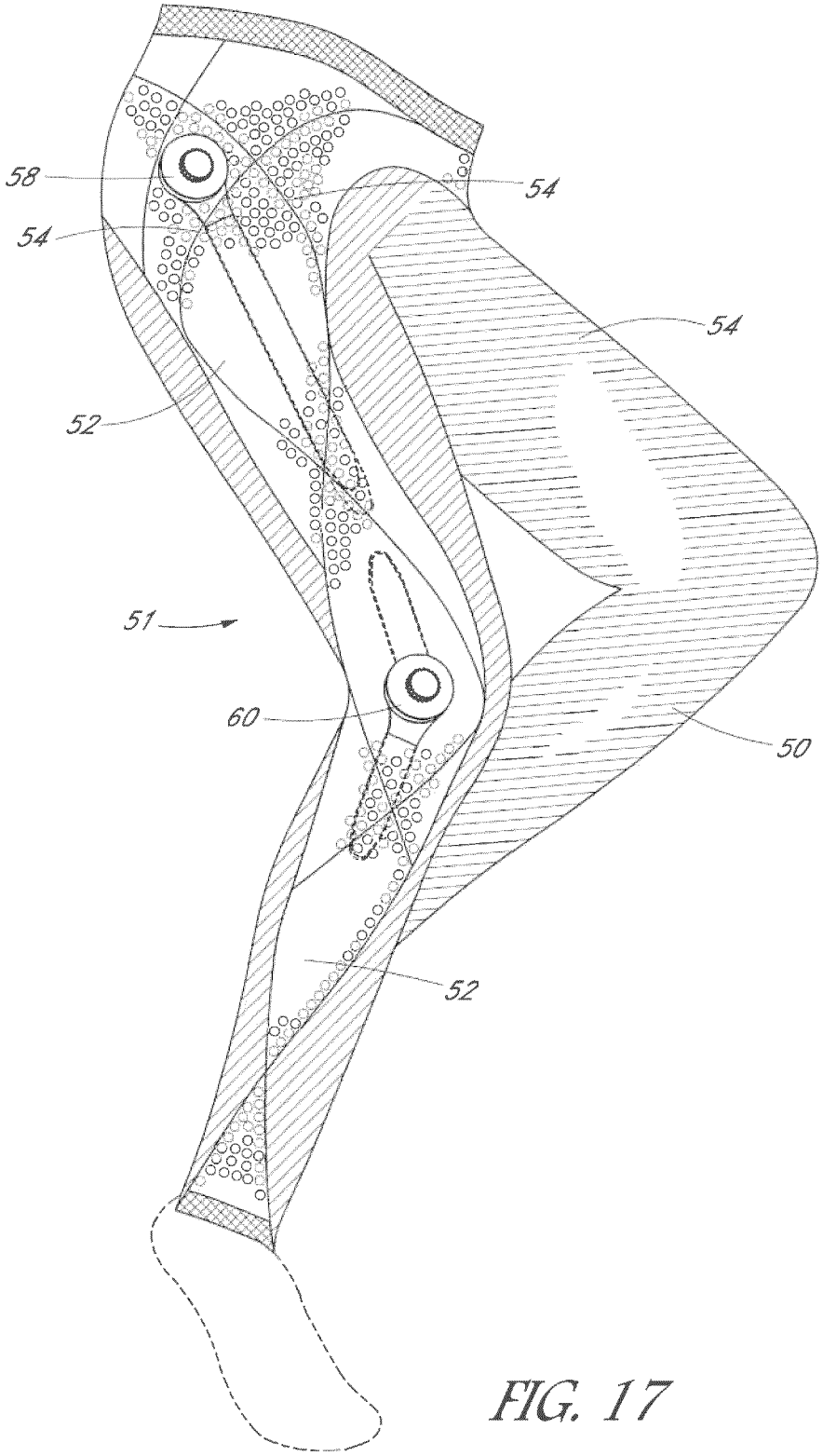
FIG. 17 is a side view of an athletic training garment incorporating hip and knee resistance units and technical fabric features of the present invention.

Referring to FIG. 17, at least one and in some implementations at least two or three or more technical fabric support panels 52 are provided on each of the right and left legs, to facilitate force transfer between the wearer and the hip resistance unit 58 and, when present, the knee resistance unit 60. The technical support panel 52 may be provided with at least one and normally a plurality of reinforcement strands 54 extending along a pattern to facilitate force transfer and maintaining fit of the garment throughout the range of motion in opposition to the resistance provided by the resistance unit. The technical fabric support panel 52 may be positioned over the entire height of the garment (as illustrated) or may be localized in the vicinity of the resistance units.

Thus, a panel of technical low stretch fabric may be provided on either lateral side of the wearer, extending up and down throughout at least the length of the femoral lever. In the illustrated embodiment, the technical fabric panel extends from the waist to approximately the ankle. In any event, the technical fabric preferably extends from approximately the rotational axis of the hip to at least about 50% and preferably entire length of the femoral lever. The technical fabric panel is preferably relatively low stretch in a circumferential direction around the leg of the weather, compared to the adjacent fabric which wraps around the medial side of the leg. Measured at at least one point along the length of the femoral lever, the width of the technical fabric layer 52 will generally be less than about 180° of the circumference of the pant leg. Typically, the width of the technical fabric layer will be greater than about 25°, often greater than about 45 degrees and in some implementations greater than 90° around the circumference of the leg, with an anterior and posterior edges of the technical panel joined to edges of a relatively high stretch panel which extends around the remainder of the circumference of the leg. The stretch in the circumferential direction of the technical fabric panel is preferably less than about 50%, and often less than about 30% or in some embodiments less than about 10% of the stretch of the adjacent panel of material measured in the same circumferential plane.

Yarns extending along a non-stretch or low stretch axis within non-stretch woven textile panel may be at least partially formed from any of polyamide, polyester, nylon, spandex, wool, silk, cotton or other high tensile strength strands disclosed herein. Depending upon the materials selected for the yarns, non-stretch woven textile may exhibit less than ten percent stretch prior to tensile failure, but may also exhibit less than five percent stretch or less than three percent stretch at least along the non-stretch axis prior to tensile failure.

A plurality of different panels of each of stretch woven or non-woven textile and non-stretch woven textile may be joined to form garment 51. That is, garment 51 may have various seams that are stitched or glued, for example, to join the various elements of stretch textile and non-stretch textile together. Edges of the various elements of stretch textile and non-stretch textile may be folded inward and secured with additional seams to limit fraying and impart a finished aspect to the garment. The garment 51 may be provided with one or more zippers, hook and loop fasteners or other releasable fasteners disclosed herein, such as one extending the full or partial length of one or both legs, to facilitate getting into and out of the garment. One or more non-stretch panels may be removably secured to the garment using a zipper or equivalent structure, hook and loop sections or otherwise. This enables the garment to be pulled on in a relatively stretchable mode. Following proper positioning of the garment on the wearer, force transfer features such as one or more low stretch features such as in the form of straps or panels can be secured to or tightened on the garment to reduce the stretch along the axes which will experience the most tensile force from the resistance units during motion of the wearer.

In general, the low stretch axis will be aligned in the anterior—posterior direction, or at least have a vector resolution component in the anterior posterior direction particularly for the femoral lever. Generally the low stretch axis will be within about 45 degrees up or 45 degrees down of horizontal, with the garment in the normal standing (vertical) orientation. The non stretch axis of the fabric at the hip will be oriented to resist rotation of the docking station, and thus will be oriented differently depending upon the presence or absence of an elongate, structural lever arm.

Stretch panels may be formed in the configuration of straps, having a length that exceeds the width, and constructed similar to the watersport waist band of U.S. Pat. No. 7,849,518 or U.S. Pat. No. 8,555,415, which are hereby incorporated by reference in their entireties herein. The longitudinal axis of the strap may extend circumferentially around the waist or leg above and or below each resistance unit to cooperate with the lever or other force transfer structure to shield the stretch fabric from tensile force. Alternatively, if less constriction on fit is desired, the axis of the strap may be angled up or down with respect to horizontal to extend in a spiral path which extends at least about 20%, often at least about 50% and in some embodiments at least about 75% or 100% or more of the circumference of the wearer's leg or waist. See FIGS. 6A-8 of US 2015/0190669 which can illustrate a non-stretch or low-stretch strap configuration or elastic straps which may be embedded within or over a multilayer stretch fabric panel garment. The garments of the present invention can also include elastic bands in the configurations illustrated in U.S. patent application Ser. No. 14/694,900 to Yao, published as US 2015/0306441, the entirety of which is hereby incorporated by reference herein.

Resistance generated by elastic stretch generally increases linearly as a function of elongation, assuming efficient force transfer between the wearer and the garment. Thus, at the beginning of a range of motion the resistance is relatively low, and at the end of the range of motion the resistance may be quite high. A combination of the (constant resistance at constant rotational velocity) resistance elements disclosed herein with an elastic restraint can have the effect of flattening out the change in resistance across the range of motion curve otherwise experienced by a purely elastic system. This is because the front end of the range of motion will be subject to a resistance imposed by the resistance unit. Supplemental resistance provided by the elastic band is thus additive to the resistance provided by the resistance element.

In a simple construction, a resistance band can be provided on the garment to resist forward swing at the hip or other joint, such as a panel extending generally vertically along the posterior of the garment. Alternatively or in addition, a resistance element may be provided to resist rearward swing at the hip or other joint such as a resistance element on the anterior side of the garment.

Figure 18:
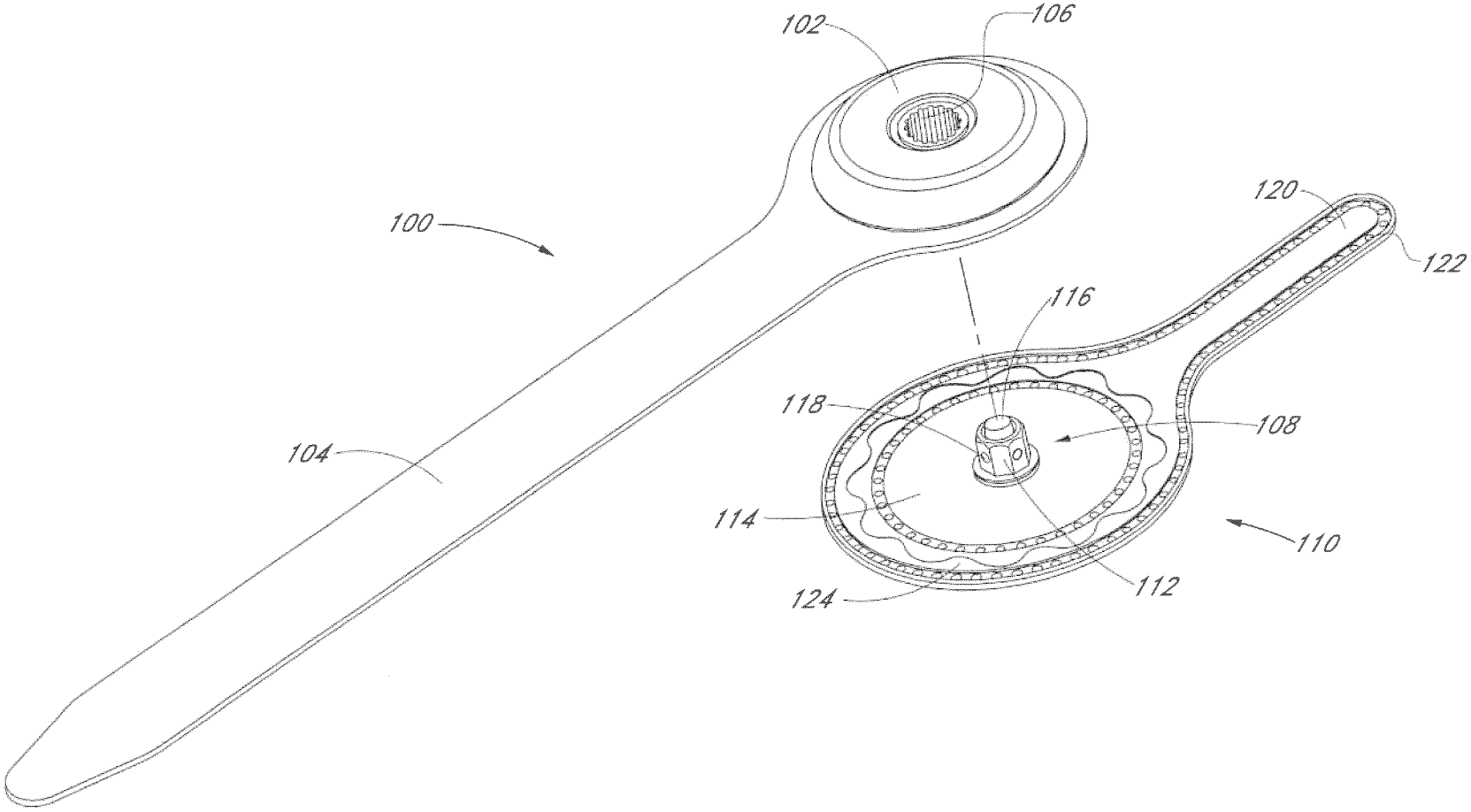
FIG. 18 is an exploded perspective view of a first lever having a resistance unit thereon, and a docking platform having a second lever.

Referring to FIG. 18, there is illustrated an exploded perspective view of a first lever having a resistance unit thereon, and a complementary docking platform having a second lever. The resistance unit 100 comprises a resistance element 102 and a femoral lever 104. The resistance element 102 comprises a connector 106, which, in the illustrated embodiment, comprises an aperture.

The aperture is configured to receive a complimentary connector 108 such as a post 112 on the docking platform 110. The post 112 comprises at least one axially extending slot, flat side or other key to provide rotational interlock with a complementary surface structure on the connector 106. In the illustrated embodiment, post 112 comprises a polygon, such as a hexagon or octagon. Alternatively, the post 112 may have a cylindrical configuration and the complementary aperture comprises the aperture through a spring clutch on the resistance unit 100. A control such as a lever, slider switch or button may be carried by the housing of resistance element 102 to change the inside diameter of the aperture of the spring clutch as is understood in the art. The relative location of the complementary connectors can be reversed between the docking platform 110 and the resistance element 102 depending upon the desired product design.

Connector 108 is carried by a docking platform 110, which includes a base plate 114 secured to the post 112. Post 112 is provided with a quick release button 116, depression of which allows a plurality of interference locks such as a ball or post 118 to retract radially inwardly to disengage a complementary recess within the connector 106. Preferably, the connector 108 is not able to rotate with respect to plate 114.

In use, movement of leg throughout a stride carries the femoral lever 104 through an arcuate path generally within the anterior posterior plane, which pivots about the axis of rotation extending through connector 108. The resistance unit transfers more or less rotational force to the post 112 depending upon the resistance rating of the resistance element 102. The docking platform 110 is configured to distribute rotational force transferred by the post 112 to a larger surface area of the underlying garment or to a point of greater distance from the axis of rotation to prevent the post 112 from rotating in a manner that twists or otherwise deforms the fabric of the compression garment.

Since the force applied to the garment at a given point is equal to the torque applied by the resistance element 102 during a stride times the radius or distance from the center of rotation to that point, a larger diameter docking platform 110 would more effectively distribute rotational force to the fabric without distortion. However, anatomical constraints due to the dynamic three dimensional configuration of the wearer and garment in the vicinity of the hip limit the diameter of the docking platform 110. Accordingly, one or more levers may extend radially outwardly or at a tangent or other angle to a circle concentric about the post 112 such as the best fit circle about the periphery of the docking platform 110.

In the illustrated embodiment, a lever 120 extends outwardly from the post 112 and docking platform 110 to increase the effective distance (radius) from the axis of rotation and better distribute rotational force. Lever 120 may extend at least about one or 2 inches from the periphery of the plate 114 or from the post 112 in an implementation where the plate is the same diameter as and/or an integral portion of the post 112 (effectively no distinct plate).

In some implementations, the lever 120 extends at least about four or 5 inches or more from the post 112. If the lever 120 is configured to reside on a coronal plane (approximately straight up and down) as illustrated, for example, in FIG. 1, extending upwardly when the wearer is in a standing position, the lever will typically be no more than about 6 inches, but at least about 5 inches or 4 inches from the axis of rotation, depending upon the distance between the rotational axis of the hip and the top of the wearer's belt line. The superior lever 120 may alternatively extend circumferentially part way or all the way around the wearer's leg, or in a spiral or angled orientation inclining upwardly or downwardly from the post 112.

The docking platform 110 in the illustrated the embodiment is intended to be permanently secured to the garment. For this purpose, a plurality of apertures 122 may be provided at least around the periphery of the superior lever 120 and an interface 124 for connecting to the plate 114. In the illustrated embodiment, the interface 124 comprises a ring which may be integrally formed with superior lever 120. The ring includes an aperture for receiving the plate 114. To minimize the risk of rotation of the plate 114 within the ring, the inner diameter of the ring may have one or more rotational locking keys such as flat surfaces or radially facing projections or recesses such as the illustrated sinusoidal periphery, which interlocks with a complementary exterior circumference of the plate 114. Alternatively, the lever 120, plate 114 and optionally connector 108 may be integrally formed such as through molding or machining techniques known in the art.

At least one lever 120 and optionally two or more levers may be mechanically linked to the post 112, and the length of the lever or levers can be optimized based upon the stretch of the fabric of the underlying garment, along with the rated torque for the resistance unit 100 intended to be used with that garment.

Figure 19:
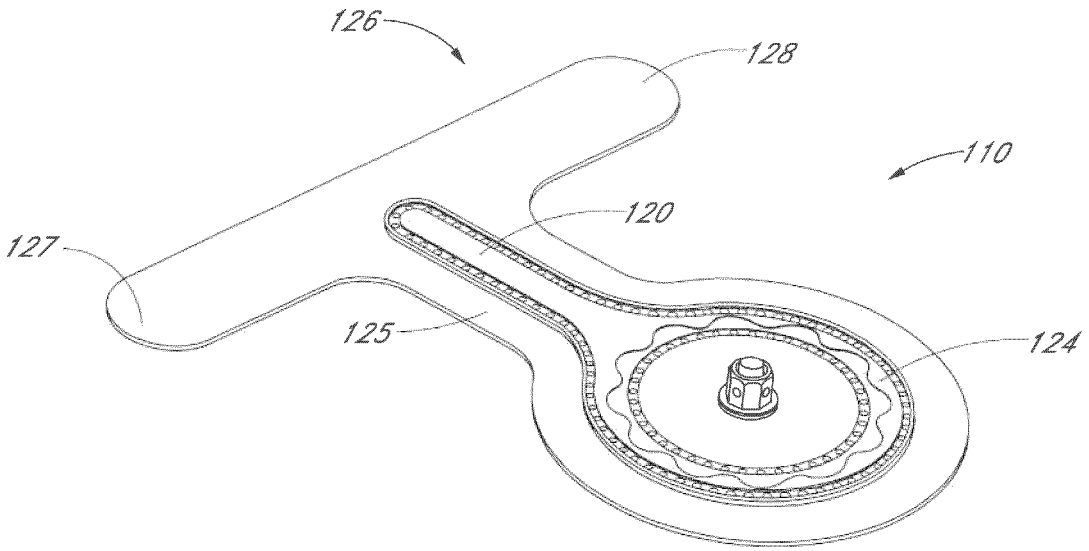
FIG. 19 is a perspective view of a docking platform having a second lever, attached to a force transfer layer.

FIG. 19 illustrates a docking platform 110 assembly as in FIG. 18, with the addition of a force transfer layer 125. As has been discussed, force transfer layer 125 is preferably a flexible fabric, molded mesh, metal mesh or other layer that provides a force transition between the superior lever 120 and the fabric of the garment. Force transfer layer 125 may be an integral part of the side wall of the garment, or may be an overlay, layered onto a garment.

In the illustrated embodiment, force transfer layer 125 extends outwardly beyond the periphery of the interface 124. This aspect of force transfer layer may be omitted. The most effective force transfer occurs at the superior end of superior lever 120, which is the greatest radius from the center of rotation. Thus, the force transfer layer 125 is preferably provided with a transverse band 126 which comprises or is attached to the waistband of the garment. Transverse band 126 may be provided with both a left strap 127 and right strap 128 which may each extend at least about 2 inches, and preferably at least about 4 inches or 6 inches or more from the midline of the superior lever 120. The transverse band 126 on the left resistance assembly may be connected with the transverse band 126 on a right resistance assembly either on the posterior side or the anterior side or both, of the wearer, to extend for a full circumference of the waist. In this configuration, the anterior connection between the left side and right side transverse bands is preferably provided with a releasable connector such as a buckle, or complementary hook and loop fastening straps for adjustable attachment to the wearer. The transverse band 126 may comprise a low stretch fabric or other material having sufficient structural integrity under tension that it resists movement of the superior lever 120 about the axis of rotation.

In one implementation of the invention, applicable to any of the embodiments described herein, the docking plate 114 is mounted with no direct attachment to the underlying garment. This allows the docking plate to float in response to anatomical movement, although not rotate relative to the axis of the post 112. The superior lever 120 will be securely attached to the garment, such as by transverse band 126 or other force transfer layer or attachment technique disclosed herein. Attachment may be constrained to an attachment zone within the upper 75%, upper 50%, upper 25% or less of the length of the superior lever, measured from the rotational axis. The attachment zone may extend inferiorly to the upper limit of the plate 114 or as far inferiorly as the level of the post 112. The remainder of the docking platform 110 below the attachment zone remains floating with respect to the garment. The upper lever 120 may be integrated into the garment or covered by a stretch panel and both the front and back sides remain unattached to the garment or cover layer outside of the attachment zone.

Figure 20:
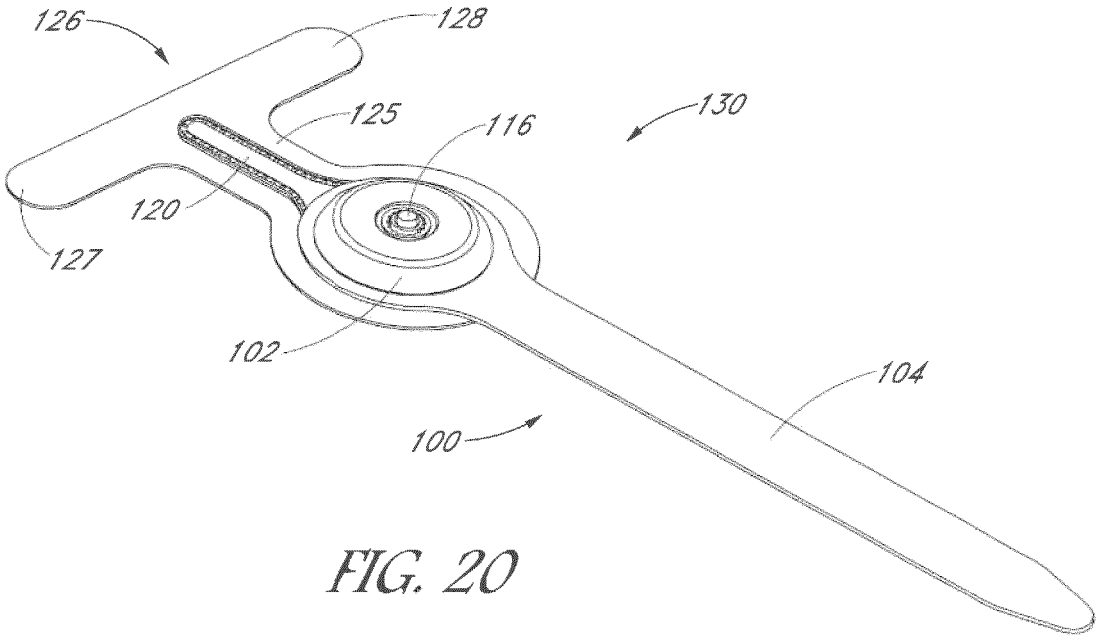
FIG. 20 is a perspective view of a resistance subassembly, including an upper lever attached to a force transfer layer, and a lower lever having a resistance unit pivotably mounted on the docking station.

Referring to FIG. 20, there is illustrated a perspective view of a complete resistance subassembly 130, including an upper lever 120 attached to a force transfer layer 125 and a lower resistance unit 100 pivotably mounted on the docking station.

The modular resistance unit 100 has generally been illustrated as having a resistance element 102 mounted on a femoral lever 104. It may in some circumstances be desirable to allow the resistance element 102 to be removed from the garment as a separate unit, leaving both of the upper and lower levers permanently or removably coupled to the garment.

Figure 21:
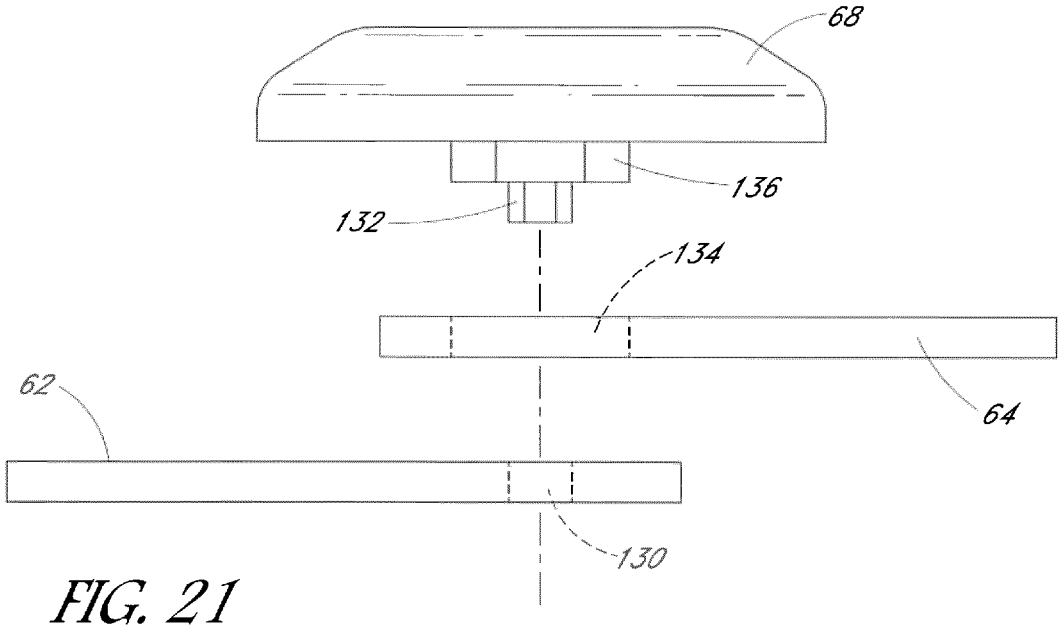
FIG. 21 is a side elevational view of first and second levers configured to receive a resistance unit having a compound post thereon.

Referring to FIG. 21, there is illustrated an exploded view of a first lever 62 having a first aperture 130. A second lever 64 is provided with a second aperture 134. Both levers 62 and 64 may be permanently carried by the garment. Alternatively, either or both of the levers 62 and 64 may be removably carried by the garment.

When mounted on the garment, the first aperture 130 and second aperture 134 are substantially coaxial. First aperture 130 is provided with a keyed cross-section such that it receives a first complementary projection 132 on resistance unit 68 so that rotation of first lever 62 will cause an equal rotation of first projection 132. Keyed projections and complementary apertures may comprise at least one flat side or spline, and in some embodiments comprise a polygon such as a hexagon or octagon or a greater number of rotational interlocking surface structures such as axially extending teeth on a gear and complementary axially extending grooves. At least 8 or 10 and depending upon construction materials at least 15 or 20 or more teeth and complementary grooves may be provided to increase the number of rotational alignments which will allow the resistance element to be mounted on the corresponding post.

The second aperture 134 is larger than the first aperture 130, and additionally comprises a keyed periphery so that it rotationally engages with a complementary second projection 136 carried by the resistance element 68.

The resistance element 68 is configured to provide resistance to relative motion of first projection 132 with respect to second projection 136. In this manner, the first lever 62 engages first projection 132 and second lever 64 engages second projection 136 so that rotation of first lever 62 with respect to second lever 64 about the axis of rotation is subject to the resistance provided by resistance element 68.

Figure 22:
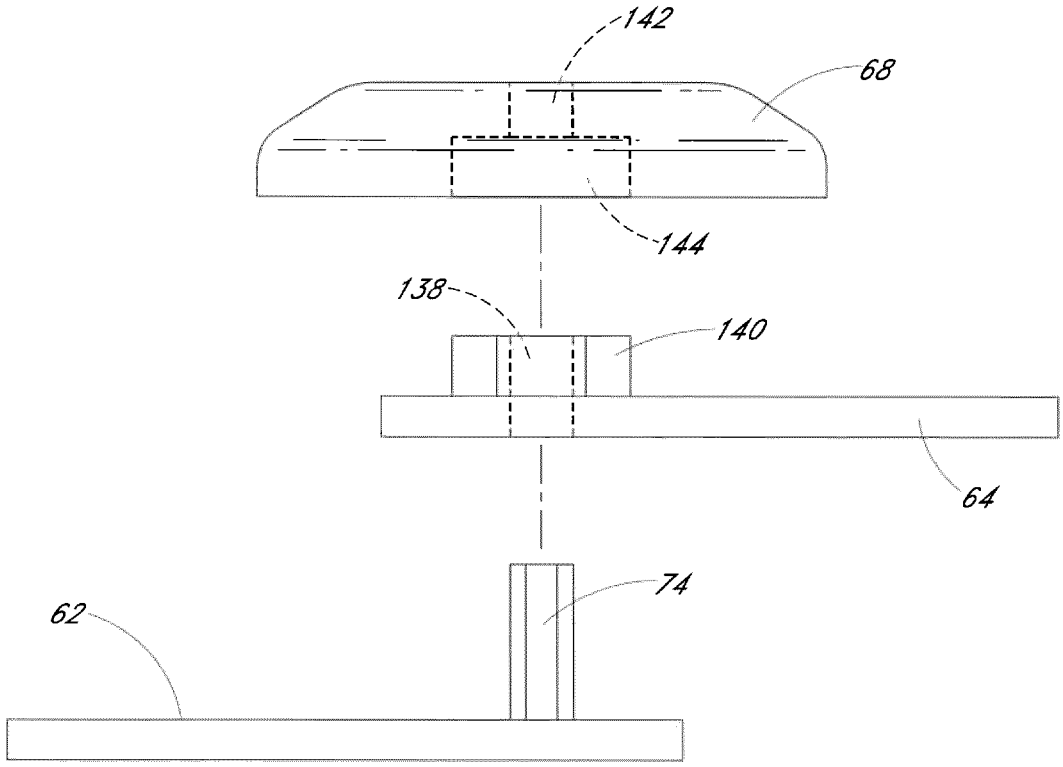
FIG. 22 is a side elevational view as in FIG. 21, of a first and second lever configured to receive a resistance unit having a compound aperture thereon.

FIG. 22 illustrates an inverse configuration, where the garment carries post 74, attached to first lever 62. The second lever 64 is provided with a keyed ring 140 having an interior passage 138 for receiving post 74. Post 74 is provided with a keyed surface, and the cross-sectional dimension of passage 138 is sufficiently large that post 74 can rotate freely therein. Keyed ring 140 has a keyed exterior surface.

Figure 23:
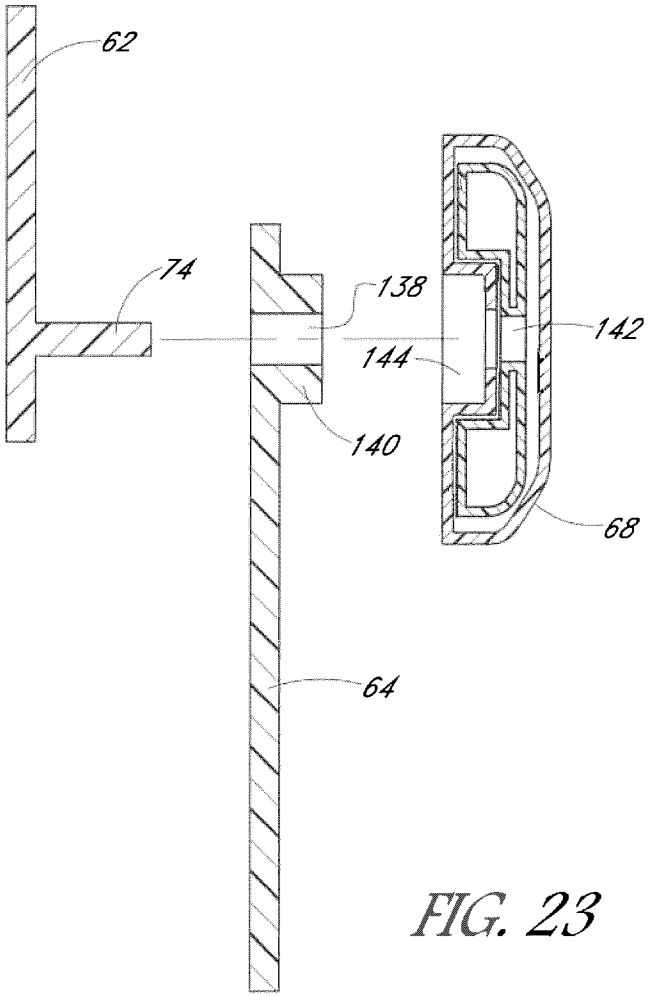
FIG. 23 is a cross-sectional view through the assembly of FIG. 22.

Post 74 extends through and beyond keyed ring 140 and is received within a first cavity 142 on the resistance element 68 and is rotationally locked therein. Keyed ring 140 is received within a complementary second cavity 144 and is rotationally locked therein. In one implementation of the invention, illustrated in FIG. 23, the keyed second cavity 144 is rotationally connected to the housing of the resistance element 68. Keyed post 74 is rotationally linked to an interior component of the resistance element 68 which rotates relative to the housing subject to the resistance provided by the resistance element.

Figure 24:
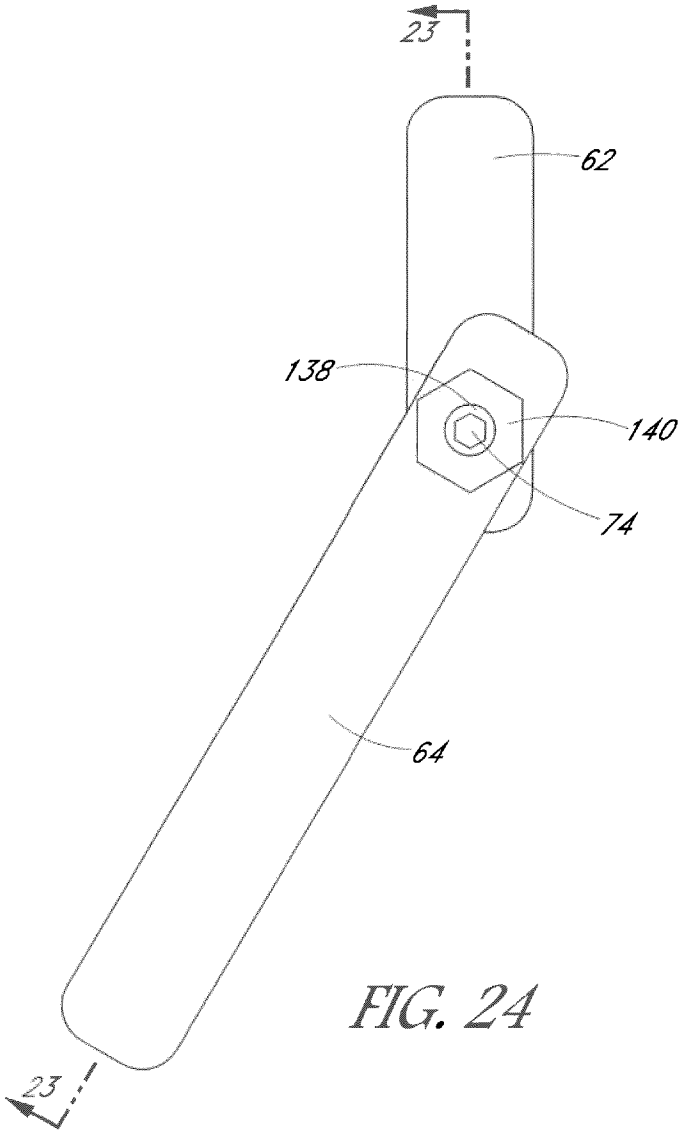
FIG. 24 is an elevational view of the embodiment of FIG. 22, assembled but without a resistance element.

FIG. 24 illustrates a plan view of the first and second levers with keyed ring 140 fully seated on post 74, and ready for attachment of the resistance element 68.

Figure 26:
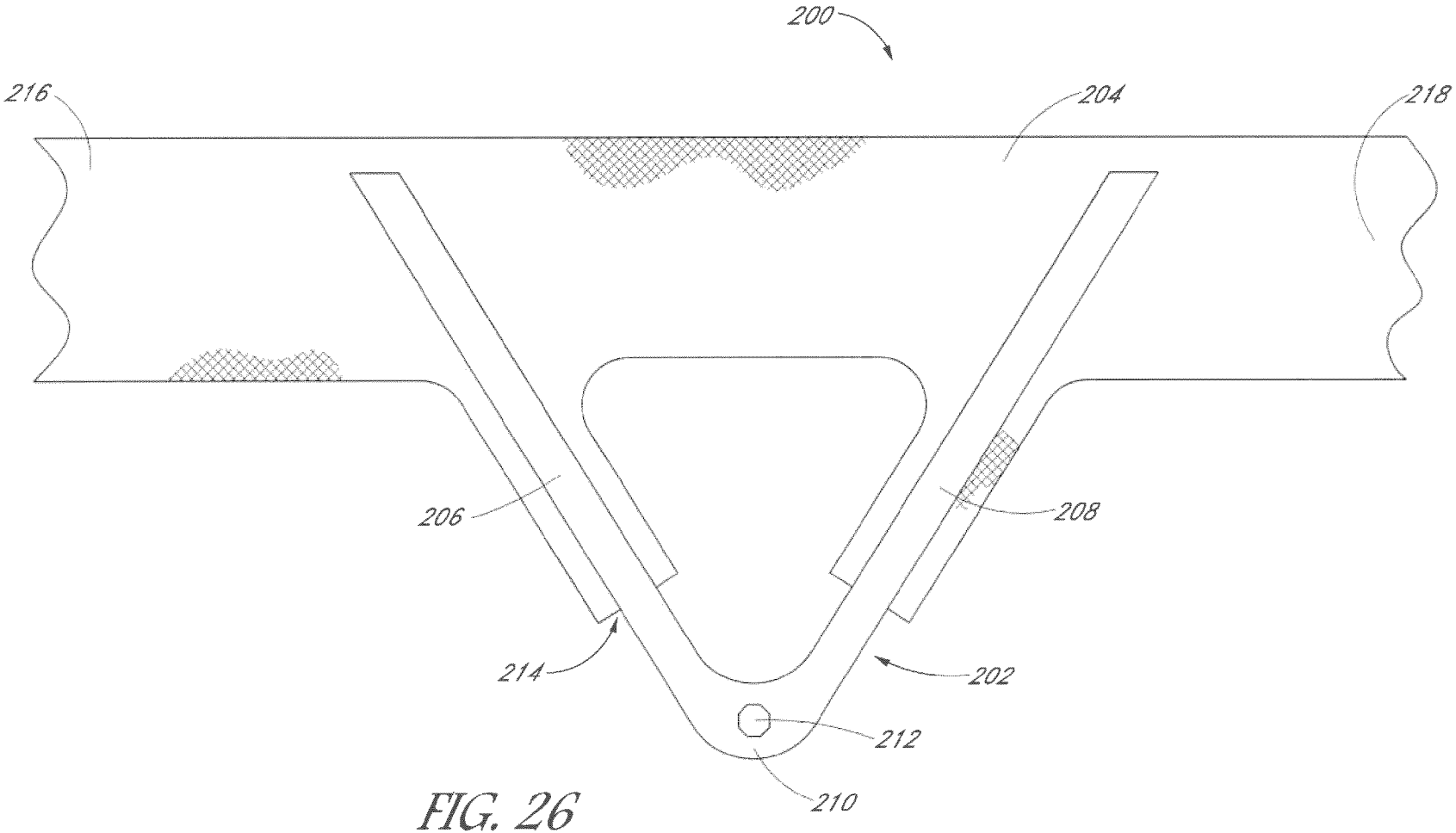
FIG. 26 is a side elevational view of a force transfer assembly have a "V" configuration.

Referring to FIG. 26, there is illustrated an alternative superior attachment assembly 200. The attachment assembly 200 comprises a lever 202 in the form of a "V", having at least a first strut 206 and at least a second strut 208. First strut 206 and second strut 208 are provided with a force transfer layer 204 as has been discussed.

First strut 206 and second strut 208 are joined at an apex 210, which is concave in an upward direction in the as worn orientation. Apex 210 and force transfer layer 204 are configured to place the apex 210 approximately in alignment with the axis of rotation of the wearer's hip or other joint. Apex 210 is provided with a connector 212, which may include an aperture or post as has been discussed.

Each of first strut 206 and second strut 208 have a length within the range of from about 3 inches to about 8 inches, depending upon garment design. Each strut may have a width within the range of about 0.25 inches and about 2 inches, typically between about 0.5 inches and 1.5 inches, depending upon garment design, construction material and the intended resistance rating. Three or four or more struts may be connected to apex 210, depending upon desired performance.

Force transfer layer 204 on a first side of the wearer may have extensions 216 and 218 which extend in a circumferential direction around the waist of the wearer. Extensions 216 and 218 may be integral with or connect with the extensions on the superior attachment assembly 200 on a second side of the wearer.

The force transfer layer 204 may extend inferiorly along the length of the first strut 206 and second strut 208 to a transition 214. Above the transition 214, the lever 202 is securely attached to the underlying garment such as by way of the force transfer layer 204. Below transition 214, the lever 202 is unattached to the underlying garment, so that the apex 210 can float with respect to the underlying garment.

Figure 27:
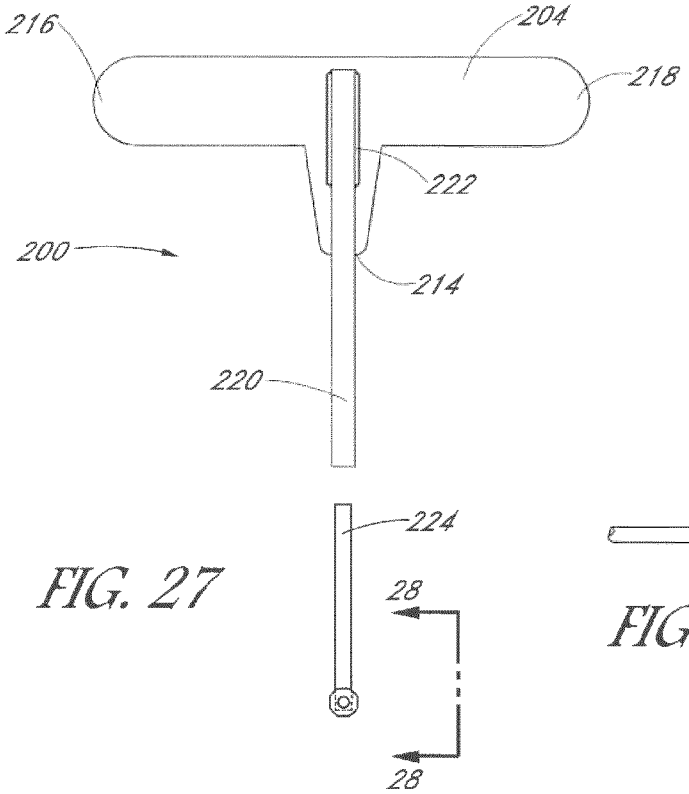
FIG. 27 is a side elevational view of a force transfer assembly having an adjustable docking station.
Figure 28:
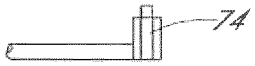
FIG. 28 is a detail view of the docking station of FIG. 27.
Figure 29:
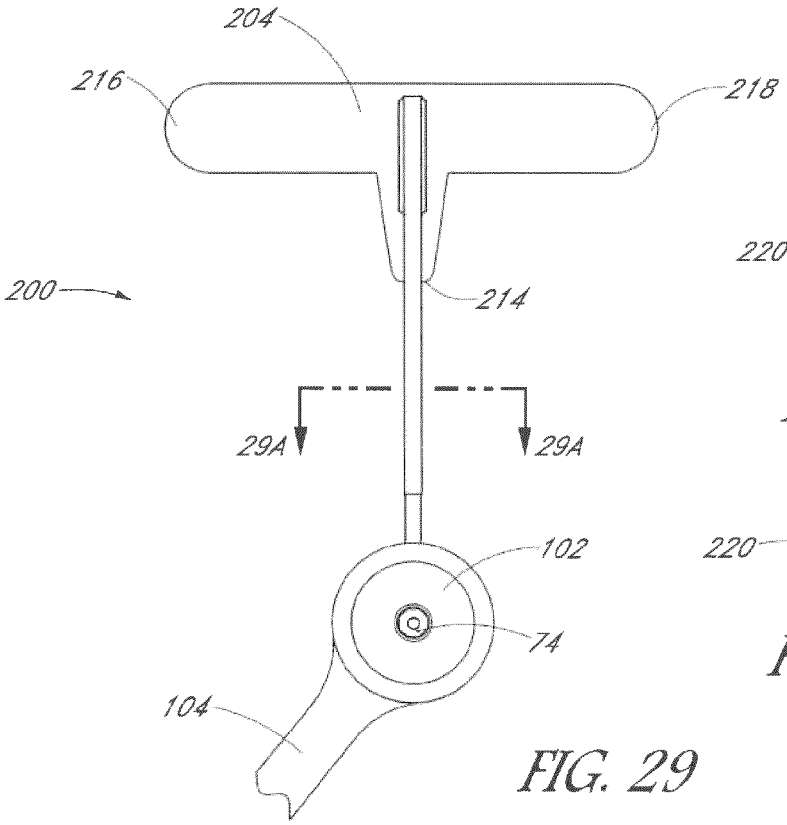
FIG. 29 is a side elevational view of the force transfer assembly of FIG. 27, having a resistance unit mounted thereon.
Figure 29A:
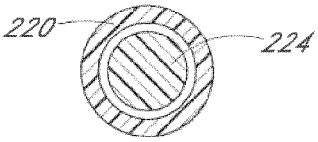
FIG. 29A is a cross section taken along the line 29 A-29 A in FIG. 28, of a dock support having two degrees of freedom.
Figure 29B:
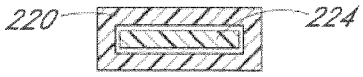
FIG. 29B is a cross section taken along the line 29 A-29 A in FIG. 28, of an alternative configuration restricted to one degree of freedom.

A superior attachment assembly 200 having multi axial adjustability is illustrated in FIG. 27. A tubular support 220 is securely bonded 222 to force transfer layer 204. Tubular support 220 is configured to axially slidably receive a rod 224 telescopically therein. The orientation of the sleeve and rod may be reversed as will be apparent to those of skill in the art. Rod 224 carries a connector such as a post 74, for engaging any of the resistance units describe elsewhere herein. The rod 224 may optionally also carry a docking plate from which the post extends. As illustrated in FIG. 29, a resistance assembly may be mounted on the post 74.

In an implementation illustrated in FIG. 29 A, at least the tube 220 and optionally the rod 224 have a circular cross-section. In this implementation, the rod 224 can rotate within the tube 220, allowing the resistance unit 102 to tilt from side to side. This allows the resistance unit 102 to accommodate movement of the wearer. If side to side adjustability is not desired, the tubular support 220 and corresponding rod 224 may be configured in a non-circular cross-section such as rectangular as illustrated in FIG. 29 B.

If the rod 224 remains axially slidably carried within tubular support 220, the post 74 is permitted to float up or down relative to the force transfer layer 204 and or tubular support 220. This adjustability along a vertical axis allows the resistance unit 102 to float, and adapt to minor movements of the wearer and/or initial misalignment between the rotational axis of the resistance unit 102 and the rotational axis of the underlying joint. The range of float may be limited such as by providing opposing interference surfaces on the rod and sleeve, spaced apart by the desired range of float.

Single or double or more axes of adjustability may be provided in any of the embodiments disclosed herein. For example, the apex 210 of lever 202 illustrated in FIG. 26 may be provided with a vertically extending guide such as a tube, for axially and/or rotatably receiving a rod 224 carrying a connector such as a post 74. The post 74 may be directly coupled to the rod 224, with or without a docking plate as has been discussed elsewhere herein.

Figure 30:
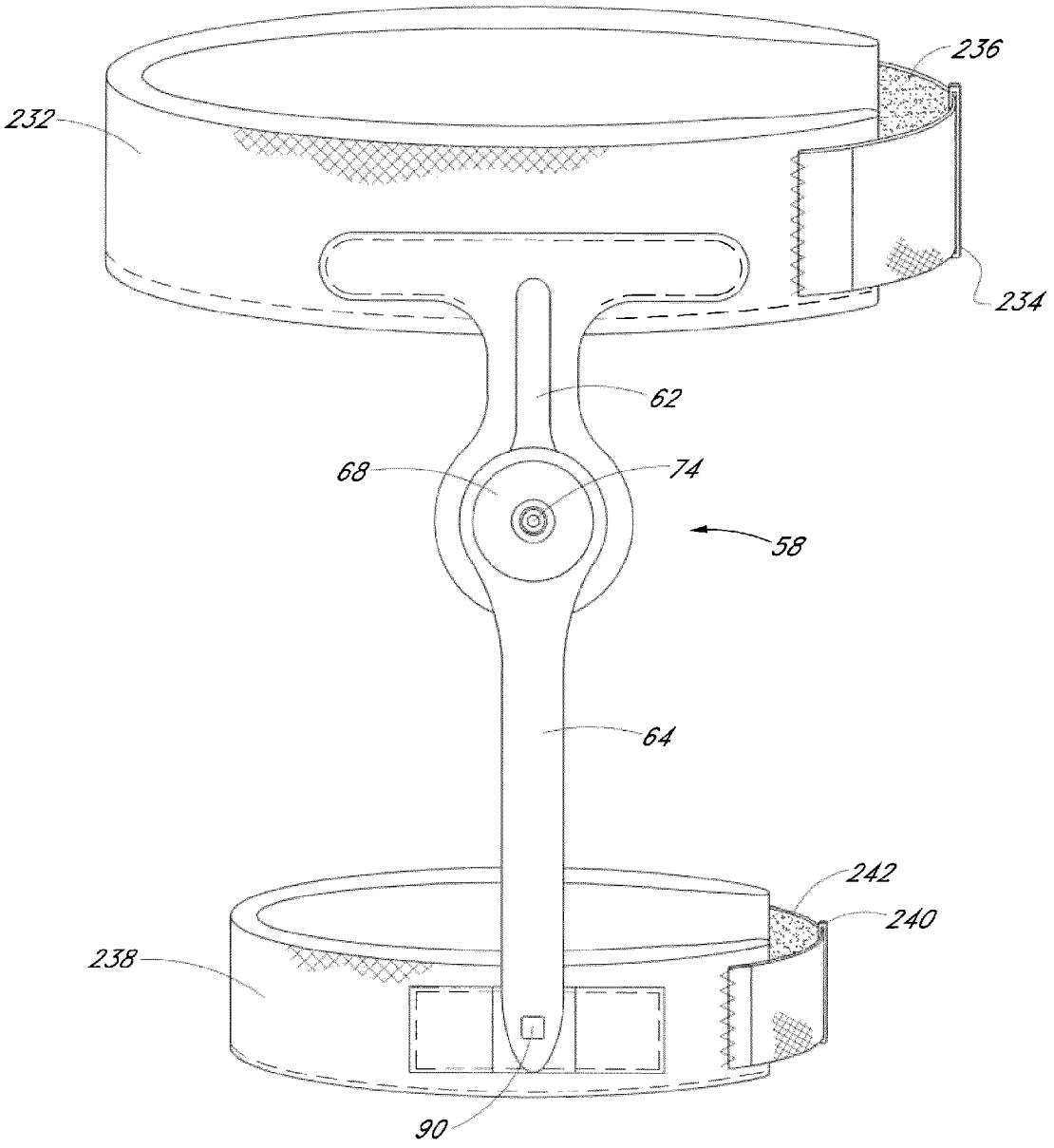
FIG. 30 is a side elevational view of a resistance harness in accordance with the present invention.

Referring to FIG. 30, there is illustrated a training harness in accordance with the present invention. The training harness may be configured for rapid attachment to the outside of a pair of pants or other athletic gear, or beneath clothing such as street clothing, or may represent a template for a subassembly to be integrated into a garment.

The harness 230 comprises a waistband 232, for removable attachment around the waist of the wearer. Waistband 232 may comprise a strap having foam padding. Waistband 232 is provided with an attachment strap 236 such as a Velcro strap attached to the waistband 232. An attachment structure such as a belt loop (buckle) 234 may be provided, for attachment using the Velcro strap. This construction enables a single device to be appropriately sized for any of a wide variety of wearers.

The harness 230 additionally comprises attachment structures for receiving a resistance unit 58. The resistance unit 58 in general includes a connector for receiving a resistance element 68, along with a first superior lever 62 and a second inferior lever 64 as has been discussed.

An inferior connector 90 connects the second lever 64 to a leg band 238. In the illustrated embodiment, the barriers 510 and 511 define a first portion 504 of the house interior 502 for containing viscous fluid, and enabling piston 514 to rotate throughout an angular range of motion. The hip normally rotates in the anterior posterior plane throughout a range which varies from individual to individual and based upon speed of travel, but is generally from about 35° to a maximum of no more than about 120°. The knee, elbow and other motion segments also have a limited range of motion. Thus a full 360° range of motion at the resistance unit is not necessary. The barriers 510 and 511 thus also define an electronics component chamber 520. Electronics component chamber 520 may include any of a variety of electronic components, depending upon the functionality of the device. For example, a power supply such as a battery 522 may be provided. Also illustrated is a central processing unit 524, a transmitter or transceiver 528 and potentially one or more sensors 526.

As will be apparent to those of skill in the art in view of the disclosure herein, certain sensors are preferably mounted elsewhere on the garment but other sensors may be or preferably are mounted at or near the axis of rotation on the damper or damper housing. These may include force sensors, angular displacement sensors, accelerometers, proximity sensors, (potentially depending upon the manner in which data is obtained for the calculation of power) and temperature sensors, such as to directly measure caloric burn accomplished by the resistance unit. An external electrical connector 530 such as a mini USB port may also be provided on the housing, for electrical connection to an external device such as to charge the battery 522, program the CPU, and or download data which has been obtained during an exercise period or other data collection period. The CPU module may contain memory, and or a separate memory module may be provided depending upon the intended length of the data collection period and or the complexity (i.e., data rate) of the data being recorded.

Leg band 238 is a flexible, padded band configured to wrap around and secure to the leg of the wearer. For this purpose, an attachment such as buckle loop 240 may be provided to cooperate with a flexible strap 242 such as an elastic strap with Velcro attachment. The strap may be pulled through the belt loop 240 and secured to itself, to wrap the leg band 238 firmly around the leg of the wearer. One or two or three or more leg bands 238 maybe provided, depending upon the intended load to be applied.

The harness 230 may be constructed of flexible, breathable lightweight materials which have relatively low stretch compared to some of the compression garments disclosed elsewhere herein. As such, the harness 230 may support resistance units having a much higher resistance to rotation, such as at least about 20 inch pounds, at least about 30 or 40 or 50 or more inch pounds of torque. As with other embodiments disclosed herein, the harness 230 is preferably bilaterally symmetrical although only a single side has been shown to simplify the drawing.

Figure 31:
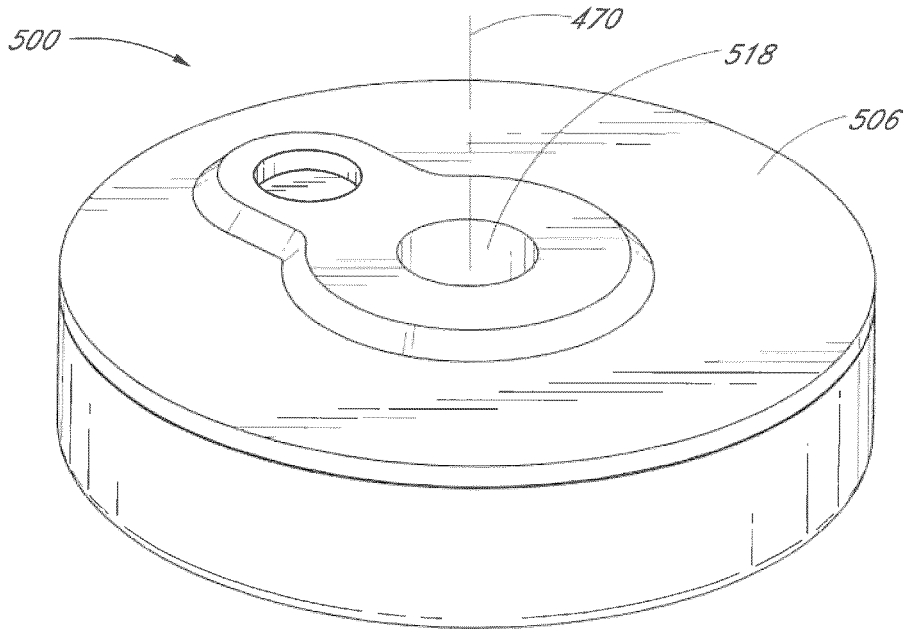
FIG. 31 is in enlarged perspective view of a rotary damper resistance unit useful in the present invention.
Figure 32:
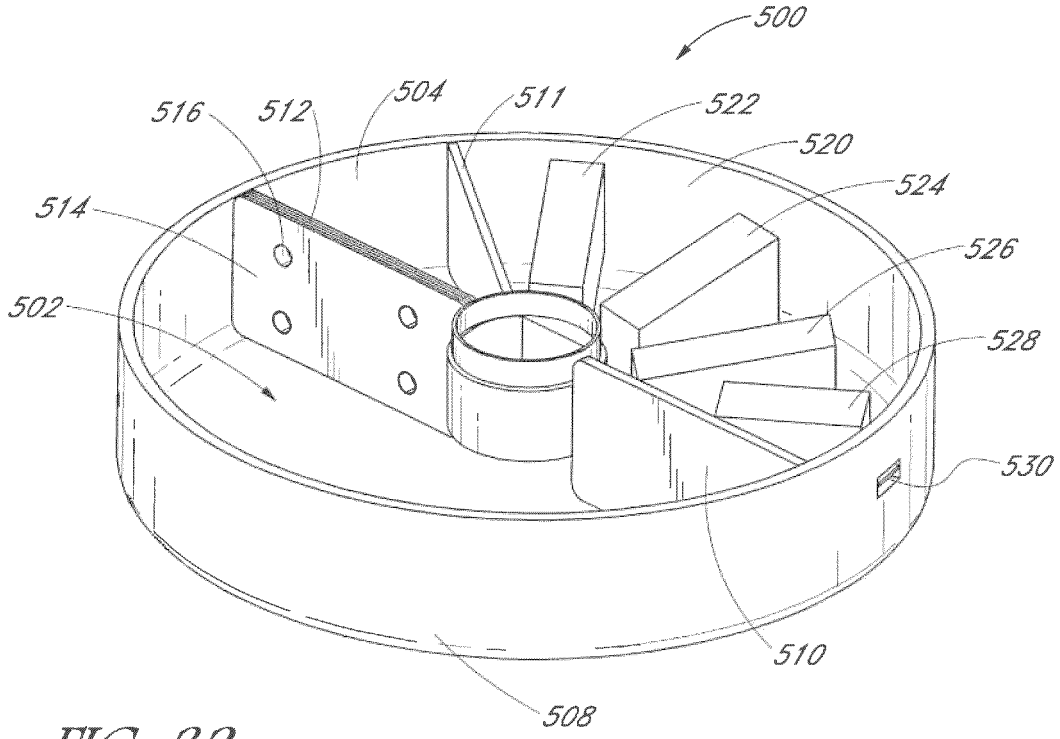
FIG. 32 is a perspective view of the rotary damper of FIG. 30, with a portion of the housing removed to reveal a rotational resistance subassembly and an electronically enabled subassembly.

Referring now to FIGS. 31-32, a rotary damper resistance element is illustrated. Any of a variety of alternative specific damper constructions may be utilized as will be apparent to those of skill in the art. Linear dampers may also be used, along with associated lever arms, or mounted in line in a pulley system. The apparatus includes a housing 500 defining a housing interior 502 for containing damper fluid (not shown) of any conventional nature, and optimally also electronic components. The housing interior has a substantially circular cross section and is formed by a toroidal or cylindrical (illustrated) inner housing surface 504 disposed about and spaced from a central axis 470. The housing 500 includes two adjoining housing members 506, 508, each housing member defining a portion of the housing interior.

A vane or piston 514 having an outer peripheral piston surface at which is located an outer seal 512 is in substantially fluid-tight, slidable engagement with the inner housing surface, spaced from axis 470 and disposed along a common plane with the axis 470. The housing 500 and the piston 514 are relatively rotatably moveable about the axis, as will be described in greater detail below.

A first fluid barrier 510 and a second fluid barrier 511 each in the form of a plate are immovably attached to the housing and positioned in the housing interior.

The vane 514 defines multiple flow control orifices or passageways 516 which permit restricted passage of damper fluid therethrough responsive to relative rotational movement of the vane 514 throughout an angular range between the first fixed barrier 510 and second fixed barrier 511 to dampen forces applied to the apparatus causing the relative rotational movement.

A shaft or aperture 518 extends through the housing interior along axis 470 and is exposed on at least one opposed side of the housing, for connection as has been discussed.

Piston 514 is secured with respect to shaft or a sidewall of aperture 518 such that relative rotational movement between the housing and the aperture 518 causes the piston 514 to rotate through an arc about axis 470. This will cause damper fluid in the housing interior to pass through flow control passageways 516 and thus resist the relative rotational movement.

In the illustrated embodiment, the barriers 510 and 511 define a first portion 504 of the housing interior 502 for containing viscous fluid, and enabling piston 514 to rotate throughout an angular range of motion. The hip normally rotates in the anterior posterior plane throughout a range which varies from individual to individual and based upon speed of travel, but is generally from about 35° for short walking strides to a maximum of no more than about 120° for most wearers. The knee, elbow and other motion segments also have a limited range of motion. Thus a full 360° range of motion at the resistance unit is not necessary. The barriers 510 and 511 thus also define an electronics component chamber 520 which is isolated from the damper chamber 504. Electronics component chamber 520 may include any of a variety of electronic components, depending upon the functionality of the device. For example, a power supply 522 such as a battery may be provided. Also illustrated is a central processing unit 524, a transmitter or transceiver 528 and potentially one or more sensors 526.

Figure 32A:
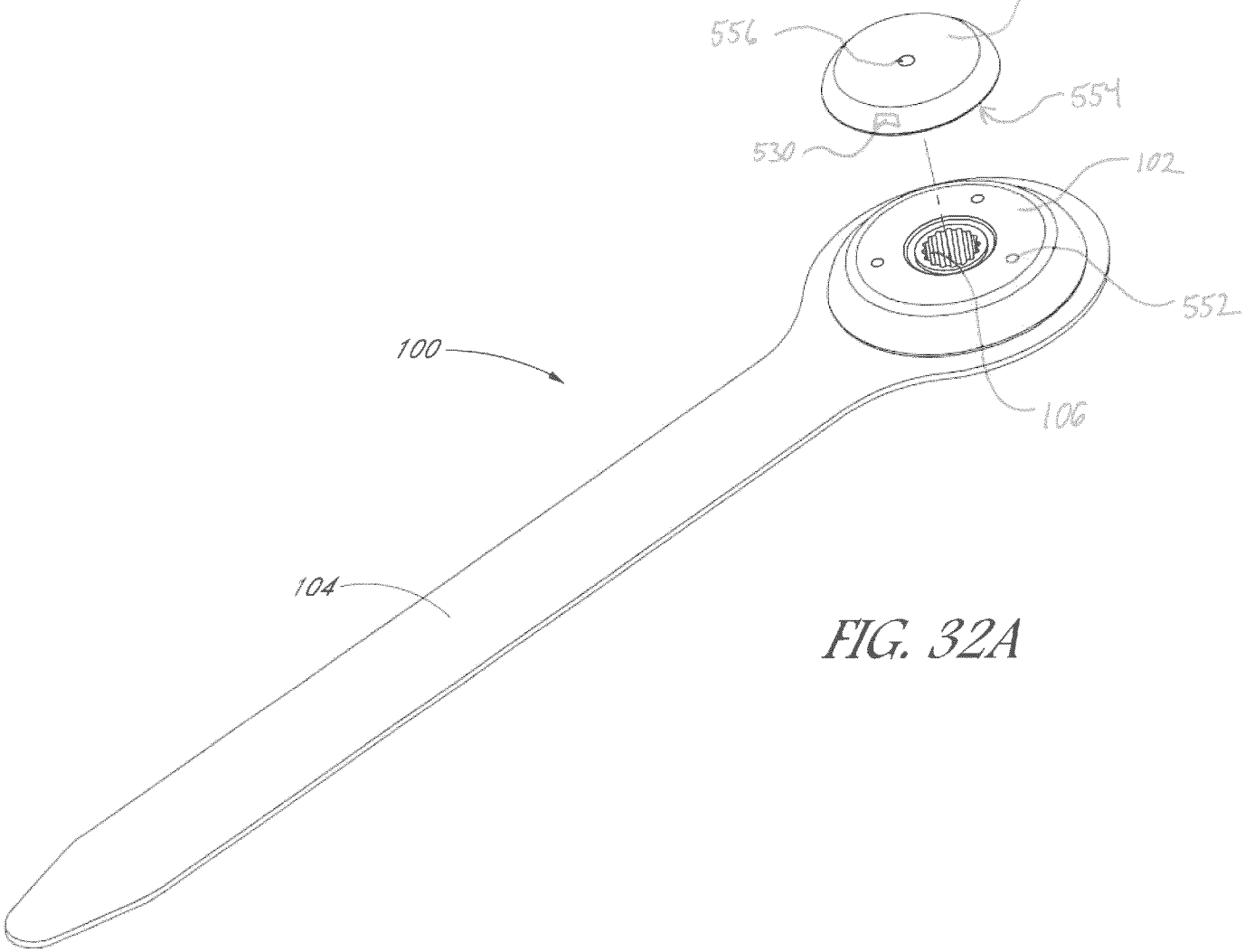
FIG. 32A is an exploded view of a resistance unit and an interchangeable electronic module.

The electronics component chamber 520 may alternatively or additionally be carried in a separate removable, interchangeable electronically enabled module 550 as illustrated in FIG. 32A. The electronics module comprises a housing having at least one chamber therein for containing any one or more of the electronic components or systems disclosed elsewhere herein. The housing has a lower docking surface 554 having at least a first connector (not illustrated) configured to releasably connect to a second, complementary connector 552 on a resistance unit 100 or resistance element 102. Any of a variety of mechanical interference fit structures may be used for snap fit, threaded fit or other releasable engagement. One or two or three or four or more complementary pairs of connectors may be utilized. Magnetic attachment may also be used, with magnets carried by the resistance element positioned to align with complementary magnets of opposite polarity in the electronics module 550. ElectroPermanent Magnets or EPM's may be desirable, since the external magnetic field can be turned on and off by applying a current pulse, but no current is required to maintain the magnetic field once the EPM has been activated.

The electronics module 550 is also provided with a rotatable shaft or other rotation sensing or transferring element 556, to couple to the rotatable aperture or shaft of the resistance element. One or more electrical connections may also be provided on the docking surface 554, for placing the electronics module into electrical connection with the resistance element. For example a multiple pogo pin connector on one docking surface can be brought into alignment with a complementary multi conductor connector on the other complementary docking surface. Inductive communication may be desirable since it may have better durability in a damp environment. Electrical communication between the electronics module and the resistance unit may be desirable if some electronics such as certain sensors are preferably located within the resistance module or elsewhere on the garment.

An electronics module 550 may be multipurpose, and include electronics to enable any combination of functions described elsewhere herein. Alternatively, application specific modules may be produced to help reduce cost and tailor functionality to a particular wearer's needs. For example, a module may be configured to report any one or combination of incremental power, stride rate, stride length, or derived metrics such as power to heart rate ratio; power to weight ratio; efficiency factor or more depending upon the intended use. The electronics module may be configured solely as a data capture device, to be downloaded following the exercise period. It may alternatively be configured as both a data capture and transmit device, such as to transmit raw or processed data to a remote receiver, with or without any direct feedback to the wearer. The remote receiver may be a smart phone or other device capable of receiving and displaying the data, for use by a coach, medical personnel, or anyone who has a desire to see performance metrics. Multiple players or athletes on a team may simultaneously transmit performance data to the coach, who can monitor power output and other metrics of the team members side by side as they go through similar activities, for various evaluation purposes.

Power supply 522 may comprise a battery pack, which may be carried within the housing in a permanent or detachable manner. The battery pack may represent a one-time-use, disposable battery or may represent a rechargeable battery pack (e.g., Lithium-Ion, Nickel Metal Hydride, or the like) to be recharged for use via a charging port (e.g., a micro USB connector 530) provided with a water resistant cap or plug. Charging may alternatively be accomplished via a wireless charging technology such as inductive charging via an induction coil carried by or within the housing. The battery pack (rechargeable or otherwise) may be configured to be replaceable (e.g., by the user) in the event the battery fails or to swap out a battery with low charge or no charge, with a freshly charged battery, for example. Battery pack may be configured to accept batteries with different amp-hour capacities to provide sufficient duration of operation of the garment and its associated electronics, such as 1500 mAh, 3000 mAh, etc. Power supply 522 may alternatively comprise an on board generator, such as a rotational generator positioned at the hip or knee to take advantage of reciprocating joint rotation. Other energy scavenging sources can take advantage of body temperature, respiration, stride (e.g., foot strike) temperature change representing calories burned as a result of movement at the hip, which elevates the temperature of the damper, or others as is understood in the art.

Communication module 528 to permit electronics on the resistance unit and/or carried elsewhere on the garment to communicate (e.g., wireless data) with one or more of external, remote devices such as a smart personal communication device (e.g., a smart phone, tablet, or pad), remote feedback device, on board feedback device such as a vibrator, compression pad or ring, electrical current or other feedback effector, or any of a variety of tracker systems such as those produced by Fitbit, Jawbone, Nike's Fuelband or Under Armour's Healthbox connected ecosystem. Typically, wireless communication among components of the wearable fitness ecosystem may employ any suitable air interface, including for example Bluetooth.TM. (in its various implementations, including low power Bluetooth), ANT.TM., ANT+, WiFi.TM., WiMAX.TM., 802.11(x), infrared, cellular technology (such as for example GSM.TM., CDMA.TM., 2G.TM., 3G.TM., 4G.TM., 5G.TM., LTE.TM., GPRS.TM.), etc. The selection of the appropriate air interface for communication depends on the air interface availability in the devices and/or at the location, cost, convenience, battery life and/or other factors.

The sensor module 526 can include any of a variety of sensors described elsewhere herein, depending upon the desired functionality. For example, temperature sensors may be provided both to enable correction of other sensor data or electronics due to thermal drift as the resistance unit rises in temperature, as well as to provide a metric of calories burned. Sensors for enabling the determination of force, power, stride length, stride velocity, stride rate among others may be conveniently placed on or within the resistance unit. For example. at least one or two or four or more accelerometers may be placed throughout the resistance unit, femoral lever or garment (e.g., left and right arm; left and right leg) and/or otherwise carried by the wearer's body (i.e., attached via any suitable manner to shoes, wrist bands, etc.) to collect multiple data points. Each of the additional accelerometers may be connected wirelessly or via electrical conductors back to the controller 524 and/or communication module 528. A suitable 3-axis accelerometer may be a model ADXL377 available from Analog Devices, Inc. of Norwood, Mass. or any equivalent. Likewise, a suitable 3-axis gyroscope may be a model ADXRS652 available from Analog Devices, Inc. of Norwood, Mass. or any equivalent. Raw data may be sent from both the 3-axis accelerometer and the 3-axis gyroscope to the controller 524 which can record acceleration, 3-axis gyroscope position in terms of x, y, and z coordinates. The controller 524 may obtain position point recordings multiple (e.g., 500 times) a second and is configured to automatically write the data points to memory along with transmitting the data over the communication interface to sensor data interpretation software which may be resident on a remote computing device (e.g., laptop, cell phone, etc.). Additional details of wearable gyroscope and accelerometer systems may be found in US patent publication 2014/03133049 to Doherty, the entirety of which is hereby incorporated by reference herein. Strain gauges, piezoelectric and proximity sensors may also be mounted on the resistance unit depending upon a variety of manufacturing choices and intended functionality.

The controller module 524 may also include processing electronics for performing some or all required signal processing on the sensed signals. In one or more embodiments, such signal processing (e.g., amplifying or filtering) may be performed locally in one or more of the sensors at the controller 524, or both, for example. Controller 524 may also include signal processing for performing data analysis and feedback data generation. In one or more embodiments, such data analysis and feedback data generation may be performed at one or more of controller 524, local remote device such as a fitness tracker or smart phone or the Internet. Signal processing for performing data analysis and feedback data generation may occur solely in the garment and its associated electronic circuitry, external to garment, or both where some portion of the processing is done in the garment and other portions are done external to the garment using processors and resources of external devices and/or systems.

Controller 524 may include one or more processors, multi-core processors, one or more digital signal processors (DSP), one or more micro-processors, one or more micro-controllers, one or more application specific integrated circuits (ASIC), one or more field programmable gate arrays (FPGA), one or more analog-to-digital converters (ADC), one or more digital-to-analog converters (DAC), a system on chip (SoC), one or more operational amplifiers, custom logic, programmable logic, analog circuitry, mixed analog and digital circuitry, or the like, just to name a few. Alternatively, raw or partially (incompletely) processed sensor data can be transmitted off board to a cellphone or other smart local remote device where data manipulation is accomplished. This shifts the weight, power consumption and expense of computational components off board of the garment.

Analysis performed either on board the controller 524 or off board may include, in one or more embodiments, comparing an exertion level with the reference exertion level as is discussed elsewhere herein. Other sensor data such as bend-angle sensor data or accelerometer sensor data may be used to compare parameters such as acceleration, velocity, other motion or position to the reference data.

Analysis may also include, alternatively or additionally updating a user profile and comparing against profiles of one or more other users. In one embodiment, user profile data may include a history of workout sessions including overall exertion as well as individually monitored muscles. In another embodiment, profile data may include goals set by the user and additionally or alternatively challenges from other users (e.g., to motivate the user). For example, the challenges may come from other persons or users who may be associated with a social network (e.g., Facebook.RTM., Twitter.RTM.), professional network (e.g., LinkedIn.RTM.), training partner, training team, or the like. Through social and/or professional networking of user profiles including historical workout data, motivation is increased by the competitive environment created. Additionally, challenges or goals may be proposed by the system (e.g., controller 524 and/or other system in communication with controller 524). A combination of progressive challenges (e.g., a series of challenges, each with higher goals to be achieved) may lead the user to higher and higher levels as in a gaming scenario where gameificaiton of the challenges may comprise the user taking on progressive challenges against goals set by the user, the system, others, or by other competitors in the game, for example.

As will be apparent to those of skill in the art in view of the disclosure herein, certain sensors are preferably mounted elsewhere on the garment but other sensors may be or preferably are mounted at or near the axis of rotation on the damper or damper housing. These may include force sensors, angular displacement sensors, accelerometers, proximity sensors, (potentially depending upon the manner in which data is obtained for the calculation of power) and temperature sensors, such as to directly measure caloric burn accomplished by the resistance unit. An external electrical connector 530 such as a mini USB port may also be provided on the housing, for electrical connection to an external device such as to charge the battery 522, program the CPU, and or download data which has been obtained during an exercise period or other data collection period. The CPU module may contain memory, and or a separate memory module may be provided depending upon the intended length of the data collection period and or the complexity (i.e., data rate) of the data being recorded.

Figure 33:
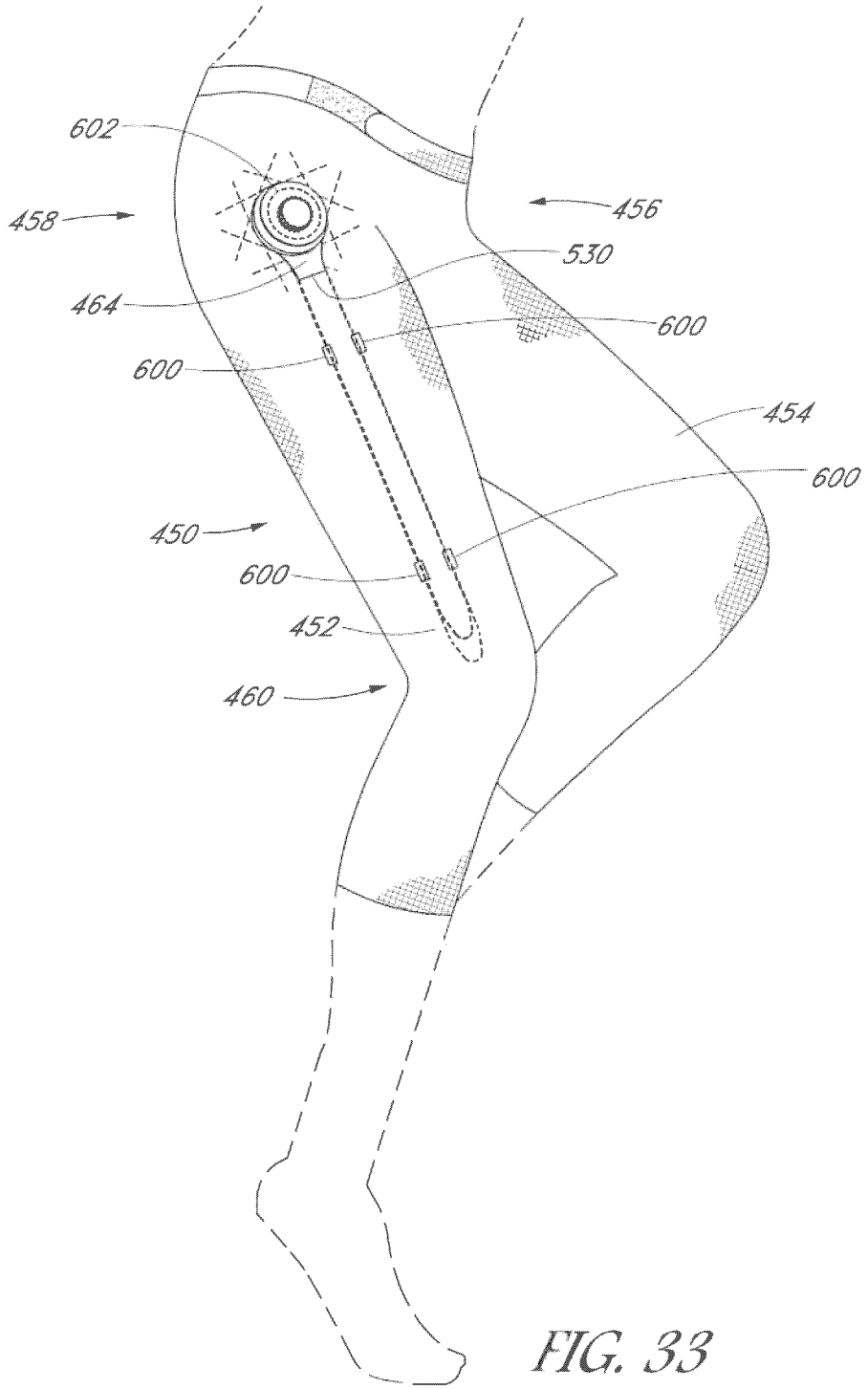
FIG. 33 is a side elevational view of a garment having a modular resistance unit interacting with four sensors to measure force or proximity to determine power exerted and/or calories burned.

Referring to FIG. 33, there is illustrated a training garment 450 having a right leg 452 and a left leg 454. The training garment preferably comprises at least one stretch panel, for providing a snug fit and optional compression. The panel may exhibit stretch in at least a circumferential direction around the leg and waist. Stretch panel may comprise any of a variety of fabrics disclosed elsewhere herein. The panel may include woven textile having yarns at least partially formed from any of polyamide, polyester, nylon, spandex, wool, silk, or cotton materials, for example. More particularly, the yarns may be eighty percent polyamide and twenty percent spandex in some configurations. When formed from a combination of polyamide and spandex, for example, the stretch woven textile may exhibit at least thirty percent stretch prior to tensile failure, but may also exhibit at least fifty percent or at least eighty percent stretch prior to tensile failure. In some configurations of garment 451, the stretch in stretch woven textile may equal or exceed one-hundred percent prior to tensile failure. The optimal amount of stretch will normally be the maximum stretch that still allows the wearer to move comfortably with maximum force transfer between the wearer's movement and movement of the resistance units. Too much stretch in a direction of force imposed by the resistance unit will allow the fabric to stretch rather than transfer all of the wearer's motion to the resistance unit.

At least one and in some implementations at least two or three or more technical fabric support panels are provided on each of the right and left legs, to facilitate force transfer between the wearer and the hip resistance unit 458 and, when present, the knee resistance unit. The technical support panel may be provided with at least one and normally a plurality of reinforcement strands extending along a pattern to facilitate force transfer and maintaining fit of the garment throughout the range of motion in opposition to the resistance provided by the resistance unit. The technical fabric support panel may be positioned over the entire height of the garment or may be localized in the vicinity of the resistance units.

Yarns extending along a non-stretch or low stretch axis within non-stretch woven textile panel may be at least partially formed from any of polyamide, polyester, nylon, spandex, wool, silk, cotton or other high tensile strength strands disclosed herein. Depending upon the materials selected for the yarns, non-stretch woven textile may exhibit less than ten percent stretch prior to tensile failure, but may also exhibit less than five percent stretch or less than three percent stretch at least along the non-stretch axis prior to tensile failure.

A plurality of different panels of each of stretch woven textile and non-stretch woven textile may be joined to form garment 450. That is, garment 450 may have various seams that are stitched or glued, for example, to join the various elements of stretch woven textile and non-stretch woven textile together. Edges of the various elements of stretch woven textile and non-stretch woven textile may be folded inward and secured with additional seams to limit fraying and impart a finished aspect to the garment. The garment 451 may be provided with one or more zippers, hook and loop fasteners or other releasable fasteners disclosed herein, such as one extending the full or partial length of one or both legs, to facilitate getting into and out of the garment. One or more non-stretch panels may be removably secured to the garment using a zipper or equivalent structure, hook and loop sections or otherwise. This enables the garment to be pulled on in a relatively stretchable mode. Following proper positioning of the garment on the wearer, force transfer features such as one or more low stretch features such as in the form of straps or panels can be secured to or tightened on the garment to reduce the stretch along the axes which will experience the most tensile force from the resistance units during motion of the wearer.

In general, the low stretch axis will be aligned in the anterior—posterior direction, or at least have a vector resolution component in the anterior posterior direction particularly for the femoral lever. Generally the low stretch axis will be within about 45 degrees up or 45 degrees down of horizontal, with the garment in the normal standing (vertical) orientation. The non stretch axis of the fabric at the hip will be oriented to resist rotation of the docking station, and thus will be oriented differently depending upon the presence or absence of an elongate, structural lever arm.

Stretch panels may be formed in the configuration of straps, having a length that exceeds the width, and constructed similar to the watersport waist band of U.S. Pat. No. 7,849,518 or U.S. Pat. No. 8,555,415, previously incorporated herein. The longitudinal axis of the strap may extend circumferentially around the waist or leg above and or below each resistance unit to cooperate with the lever or other force transfer structure to shield the stretch fabric from tensile force. Alternatively, if less constriction on fit is desired, the axis of the strap may be angled up or down with respect to horizontal to extend in a spiral path which extends at least about 20%, often at least about 50% and in some embodiments at least about 75% or 100% or more of the circumference of the wearer's leg or waist. See FIG. 13 which can illustrate a non-stretch strap configuration which may be embedded within or over a multilayer stretch fabric panel garment.

Resistance garments in accordance with the present invention can be configured as independent biometric sensing and feedback devices, or can be configured to communicate and/or cooperate with external electronic systems and devices, such as cell phones, the internet, local area networked devices and particularly activity tracking devices such as those produced by Fitbit, Inc., San Francisco, Calif. (see, for example, U.S. patent application Ser. No. 13/156,304, filed on Jun. 8, 2011, entitled "Portable Monitoring Devices and Methods of Operating Same" which is incorporated herein by reference in its entirety).

Biometric and/or ambient condition, spatial location, motion or other sensors and processing circuitry may be carried by the resistance unit (e.g., within the resistance element or within a detachable module attached to the resistance unit or resistance element), integrated into the garment or other support associated with the resistance element, or may be separately worn by the wearer such as when the garment is configured to pair with a wearable activity tracker such as any of a variety of Fitbit models. One or more sensors carried by the electronics module, resistance unit, garment or the wearer of the garment can include, for example, electromyography (EMG), electrocardiograph (ECG), respiration, galvanic skin response (GSR), temperature, acceleration, bend angle, pressure, force, torque, GPS, accelerometer (single or multi axis), respiration, perspiration, bioimpedence, gyroscopes, various rate measurements such as stride rate, flex rate, pulse (heart) rate, spatial orientation, deviation or position, oxygen saturation, blood glucose, or others described elsewhere herein. Sensors may also be provided to detect, measure and/or sense data which is representative of hydration, height, weight, sun exposure, blood pressure and/or arterial stiffness. See, for example, U.S. patent application Ser. No. 14/476,128, filed on Sep. 3, 2014, entitled "Biometric Monitoring Device Having a Body Weight Sensor and Methods of Operating Same" which is incorporated herein by reference in its entirety). The use of multiple sensors for the same parameter or multiple sensors for multiple parameters may provide a level of insight that is not available by measuring only a single metric such as heart rate (HR) or motion based on accelerometers or other types of motion sensors (e.g., a gyroscope). Sensors may be incorporated in a permanent manner into the fabric of the form-fitting interactive garment itself or in a detachable manner such as with zippers, snap fit connectors, clasps, hook and loop (Velcro) or other releasable connectors and/or in pockets or under or on top of flaps if desired, to allow removal and/or repositioning of the sensors.

Biometric or other data parameters and/or data derived from biometric or other parameters can be displayed and/or stored for subsequent display in a form that indicates an incremental effect of the resistance provided by a resistance element in accordance with the present invention. For example, a wearer might walk for 1,000 actual steps. If those steps were taken while wearing a resistance garment as disclosed herein, a 'steps equivalent' may be calculated and displayed indicating the equivalent number of steps that would have been required to have been taken to have burned an equivalent amount of calories or perform an equivalent amount of work. So the 1,000 steps with a first resistance level rating might be an equivalent amount of work to 1,100 actual steps without the resistance unit. Thus the resistance garment produced an incremental 10% energy burn or effort over steps taken without the resistance elements. A second resistance level unit might enable 1,000 steps to be equivalent to 1200 steps without the resistance unit. Fixed resistance units can be provided at a variety of resistance levels, configured to produce an incremental burden of at least about 10%, 20% 30%, 50% 75% or more in excess of the burden incurred by the activity such as walking in the absence of the resistance unit. In configurations designed more for athletic training than toning, potentially incremental loads of at least about 100% or 150% or 200% or more over the unburdened baseline may be desirable.

The incremental effect of the resistance units can be expressed in various other ways, such as incremental power (Watts) or incremental calories burned. So if 2,500 steps would normally burn 1100 calories for a particular wearer in the absence of a resistance garment, the same 2500 steps might burn at least about 10% or 20% or 30% or 50% or more incremental calories for the same 2500 steps while wearing a resistance garment. The incremental effect can alternatively be calculated as an effective slope equivalent. A baseline slope can be selected, such as horizontal. Walking along a substantially horizontal surface while wearing a resistance garment, depending upon the resistance level, might be the equivalent of walking uphill along a slope of plus at least about 4 degrees, at least about 10 degrees, at least about 15 degrees at least about 20 degrees or more.

Incremental elevation or change of respiration rate, pulse rate, blood gas such as CO2 or O2, temperature, blood glucose may be measured or calculated, so that the wearer, care provider or friends connected via social media or other networking environment can see the physiological benefit provided by wearing the resistance units of the present invention.

Synchronization between the wearable resistance device and a wearable activity tracker can be accomplished either automatically (e.g. wirelessly) or manually. For example, in the example above of a resistance garment carrying a resistance unit which is rated to provide an incremental 20% calorie burn or resistance to walking, a code carried by the resistance unit corresponding to the level of resistance can be input into the activity tracker, and the activity tracker programmed to calculate the parameter equivalent accomplished by the wearer while utilizing that resistance element. So the activity tracker can reflect that the actual 1000 steps with the resistance unit was the equivalent of 1200 steps without the resistance unit.

More simply, the activity tracker can be programmed to receive an input of a factor corresponding to the resistance value of a particular resistance unit. The factor would cause the activity tracker to report the effective value (e.g., 115 steps) rather than or in addition to the actual value (e.g., 100 steps) for the parameter of interest.

Alternatively, the activity tracker may be caused to periodically or on-demand ping an interrogator signal. The resistance element or the garment carrying the resistance element may be provided with a RFID or other identification tag or circuit which can reflect a signal back to the activity tracker, indicating the resistance rating. The activity tracker can then calculate an equivalent value for a parameter of interest being displayed or available for display, indicating the incremental change relating to that parameter caused by the resistance element. In more complex systems, the resistance element, activity tracker and optionally sensors carried by the garment can be in communication using any of a variety of wired or wireless protocols such as ANT, ANT+, Bluetooth, WiFi, ZigBee or others known in the art.

Thus, an activity tracker configured to pair with the resistance garment of the present invention may be provided with an input, configured to receive a compensation factor which will enable conversion of a measured or calculated parameter into an equivalent, taking into account the effect of the resistance units on the measured parameter. The input may be configured for the user to manually input the compensation factor. Alternatively, the input may be configured to wirelessly receive the compensation factor from the resistance unit. The activity tracker may be configured to record and or display or output the equivalent value, and optionally also the actual value of the parameter of interest. For example, the activity tracker may be configured for receiving an input indicating that each actual step will require the wearer to exert 1.2 steps worth of effort. The activity tracker will therefore display 120 step equivalents for every one hundred actual steps taken by the wearer, while the corresponding resistance element is engaged.

For embodiments of the present invention utilizing a viscous damper, the resistance to movement will vary as a function of angular velocity. For any of the embodiments disclosed herein, and particularly for viscous damper embodiments, it may therefore be desirable to measure actual power rather than merely calculating a metric of work based upon the number of repetitions. Preferably, the level of exertion will be described in terms of wattage (intensity) and Joules of work (quantity) being done, from which calories burned can be determined and displayed or saved.

A variety of power sensors are known in the performance bicycle arts, which may be readily adapted for use in the present context. Typically, a power sensor such as a strain gauge will be positioned such that it captures force exerted by the wearer. Power sensors maybe positioned in a variety of locations on the garment, such as on the anterior side and or posterior side of the lower limit of the garment (knee or ankle), and/or carried by the resistance unit and its attachment structures. Torque or other angular sensors may be attached to the resistance unit, and/or the mounting station for receiving the resistance unit. All may be provided with wired or wireless communication back to a central processing unit carried by the garment, or to a remote device such as the activity tracker, cell phone, or other as has been described. Although power output by the wearer is perhaps most conveniently measured by utilizing the relative rotation of the femoral lever with respect to the hip, wireless power output sensors may be positioned elsewhere in the garment, and configured such as those disclosed in United States patent publication 2015/0057128 to Ishii, the disclosure of which is hereby incorporated in its entirety herein.

Any of the configurations disclosed herein may additionally be configured to determine and display a metric of total or incremental power (e.g., in Watts) expended by the wearer, or incremental calories burned, as a result of movement against the resistance provided by the resistance unit. For example, referring to FIG. 33, at least one or two or more sensors 600 may be positioned in the force path between a first surface connected to the resistance element such as on the femoral lever arm, and a second surface mechanically connected to the wearer, such as an interior opposing force transmission surface within the sleeve. Split lever arms may also be provided with a sensor positioned to be under compression or shear between a first and second surfaces on corresponding first and second portions of the lever arm when the wearer moves against the resistance.

In one configuration, at least a first, anterior sensor is provided on an anteriorly facing surface carried by the lever arm. The first anterior sensor will be under compression as the wearer moves their leg rearward (in extension). At least a first posterior sensor is provided on a posteriorly facing surface carried by the lever arm. The first posterior sensor will be under compression as the wearer moves their leg forward (in flexion). Two or three or more sensors may be provided to measure force upon flexion or extension such as to improve accuracy of the reading.

Alternatively, force sensors 602 may be mechanically connected to the damper connector such as the aperture or shaft or otherwise configured to measure force at the point of rotation as in understood in the art. Signals from any or a combination of sensors 600 and 602 may be used to calculate a metric of power (e.g. force or proximity) expended by the wearer to move against resistance provided by the resistance element. One system having strain gauges embedded in the hub of a rotating construct for the purpose of measuring power is disclosed in U.S. Pat. No. 6,418,797 to Ambrosina et al., the disclosure of which is hereby incorporated in its entirety herein by reference. In another construction, the axel or post 474 is configured to undergo slight deformation in response to applied torque, and sensors are positioned to measure strain as that deformation occurs. Additional details may be found in U.S. Pat. No. 6,356,847 to Gerlitzki, the disclosure of which is hereby incorporated in its entirety herein by reference. Force or power data can alternatively be sent to the processing electronics from other sensors such as sensors carried by or mounted within the wearer's shoes.

The determination of expended power can be accomplished on only one of the right side or left side of the wearer, such as at the right hip or hip plus knee but not the opposing side. The value can be doubled, under the assumption that the wearer's exertion will be bilaterally symmetrical. Preferably, the force sensor system will be bilaterally symmetrical on both the right and left side of the wearer, to allow the wearer to evaluate any asymmetries in power output.

Based at least in part on torque and angular velocity of the leg of the wearer, instantaneous, average, peak, maximum, and/or minimum power exerted by the wearer can be determined and displayed or utilized for further data processing operations such as to generate ratios as is discussed elsewhere herein. Total energy or power exerted by the wearer can be approximated based at least in part on one or more of the wearer's weight, stride rate, stride length, height, running speed, or any combination of these. These values can be provided to the wearer to provide feedback regarding power exertion during exercise.

Resistive torque (e.g., a resistance to movement of the thigh of the wearer) provided by RVD type resistance units is related to the angular velocity and/or angular acceleration at the hip. One or more sensors can be provided to measure the angular velocity. These measurements can be used to determine the resistive torque applied by the resistance unit (e.g., the torque that the wearer needs to overcome to move their thigh). For example, the resistance unit can have a look-up table or other function that maps angular velocity to resistance or resistive torque.

Figure 37:
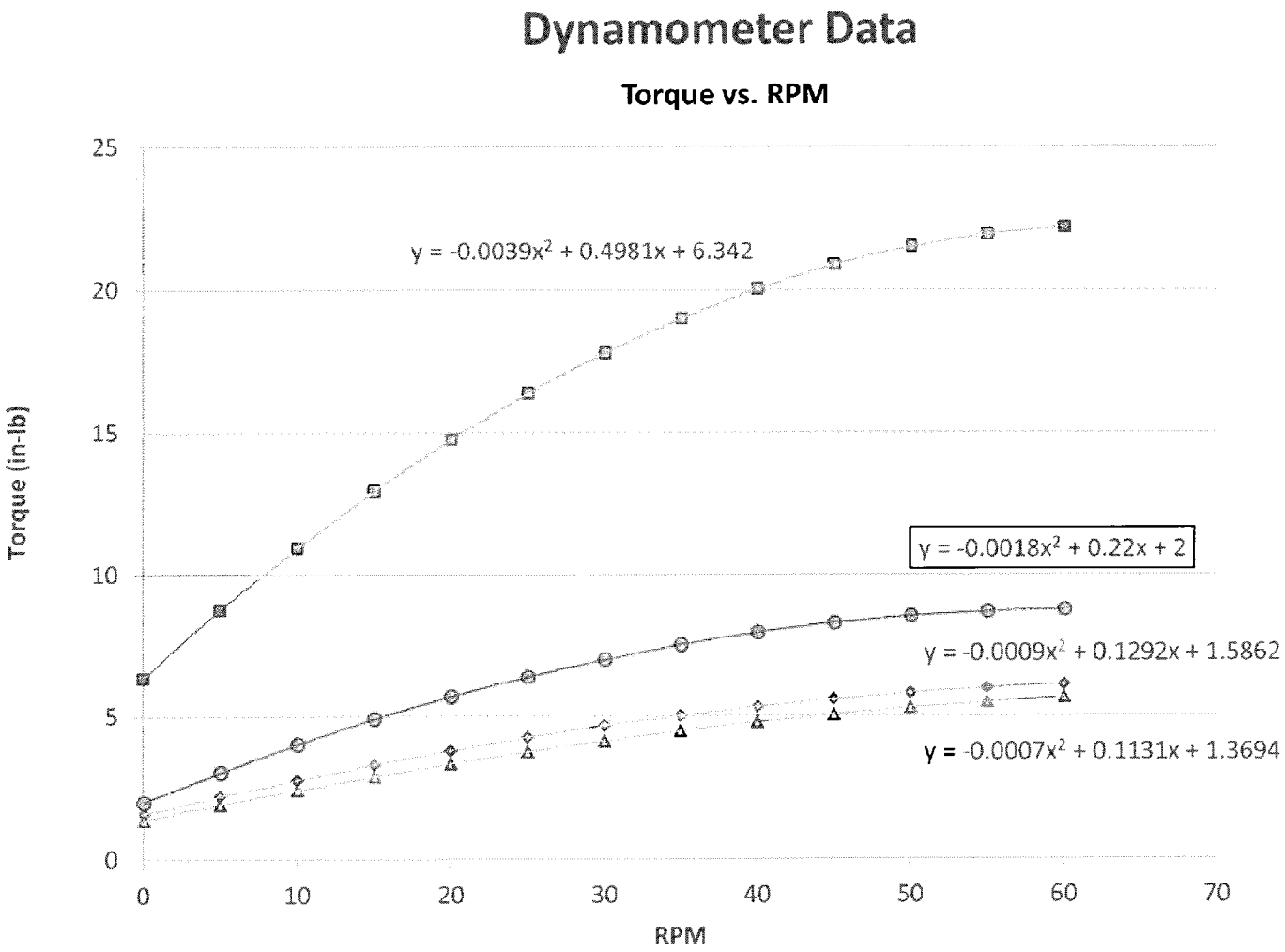
FIG. 37 shows torque as a function of angular velocity (expressed as RPM) for three resistance elements in accordance with the present invention.

For example, FIG. 37 illustrates the torque characteristics for three resistance elements in accordance with the present invention, plotted against RPM (which can be readily converted to degrees per second, a unit used elsewhere herein).

So at any point throughout the stride, the angular velocity can be measured and the torque applied by the resistance unit at that velocity can be determined from the torque v RPM data for that resistance unit. The torque data can be built into software carried by the electronics module, or maintained off board such as on the smart phone, activity tracker or other remote device.

As described herein, strain gauges or other measurement devices can be provided that measure force and/or torque applied by the wearer on the resistance unit. If the torque applied by the wearer exceeds the resistive torque, then the wearer's thigh can move. The difference between the applied torque (torque applied by the wearer) and the resistive torque (torque applied by the resistance unit) is the net torque. This net torque can be used at least in part to determine the mechanical power or energy being provided by the wearer.

In some embodiments, the net torque can be used to determine, measure, or estimate the energy or power exerted by the wearer. The instantaneous power can be determined as the product of the net torque and the instantaneous angular velocity of the wearer's thigh (e.g., $P=\tau*\omega$, where $\tau$ is the net torque and $\omega$ is the instantaneous angular velocity of the thigh). The peak or maximum power can be determined by sampling the instantaneous power over time (e.g., over at least about 1, 2, 5, 10, 20, 50, etc., strides) and determining a maximum power over that time. Similarly, the peak or maximum power can be determined by sampling the instantaneous power over a number of strides, determining a maximum power within each stride, and determining an average or median of the maximum power over the number of strides. The average (median) power can be determined by averaging (determining the median of) measurements of the instantaneous power. Similar processes can be employed to determine other statistical properties of the power. Furthermore, similar calculations and procedures can be followed for determinations of energy or mechanical work exerted by the wearer.

If the angular velocity is not measured or otherwise determine, the instantaneous angular velocity can be estimated in a variety of ways. Some methods for determining instantaneous angular velocity include determining a stride rate and then calculating an estimated instantaneous angular velocity based at least in part on statistical models associating stride rate with thigh position. In certain implementations, the stride rate can be estimated based on a plurality of measurements of torque. The measurements of the torque can be used to estimate the stride rate of the wearer by identifying cyclical patterns within the torque measurements to determine the beginning and endings of strides of the wearer. In various implementations, sensors can be used to determine the stride rate of the wearer (e.g., sensors such as accelerometers, gyroscopes, pressure sensors, or the like can be used). In some implementations, the stride rate can be entered or provided by another system or by the wearer.

As an alternative to direct measurement, the stride rate can be estimated based on predicted or typical stride rates of runners. For example, a typical recreational runner has a stride rate between about 150 and about 170 steps per minute. As another example, competitive runners typically have a stride rate between about 180 and about 200 steps per minute. As another example, sprinters can have a stride rate that exceeds about 200 steps per minute. The typical stride rate for a person walking can range between about 100 steps per minute to about 150 steps per minute.

With the stride rate determined or estimated, the instantaneous angular velocity can be determined based at least in part on a statistical model of the relationship between a phase of the stride and thigh position. For example, the thigh position at various relative times within a stride is statistically similar across adults. This can depend at least in part on the speed of the wearer's gait (e.g., walking, running, sprinting, etc.). A walking adult typically has a thigh angle that varies about 50 degrees (e.g., between about 45 and about 55 degrees, or between about 40 degrees and about 60 degrees) over a single stride. A running or jogging adult typically has a thigh angle that various about 55 degrees (e.g., between about 50 and about 60 degrees, or between about 45 degrees and about 65 degrees) over a single stride. A sprinting adult typically has a thigh angle that various about 60 degrees (e.g., between about 55 and about 65 degrees, or between about 50 degrees and about 70 degrees) over a single stride. A competitive sprinter may have a thigh angle that various about 80 degrees (e.g., between about 75 and about 85 degrees, or between about 70 degrees and about 90 degrees) over a single stride. The thigh position as a function of percentage of a stride is typically similar for similar speeds as well. Based on the function of the thigh position as a function of stride, the angular velocity can be estimated (e.g., as a derivative or an approximation of the derivate of the function of the thigh position).

Figure 38:
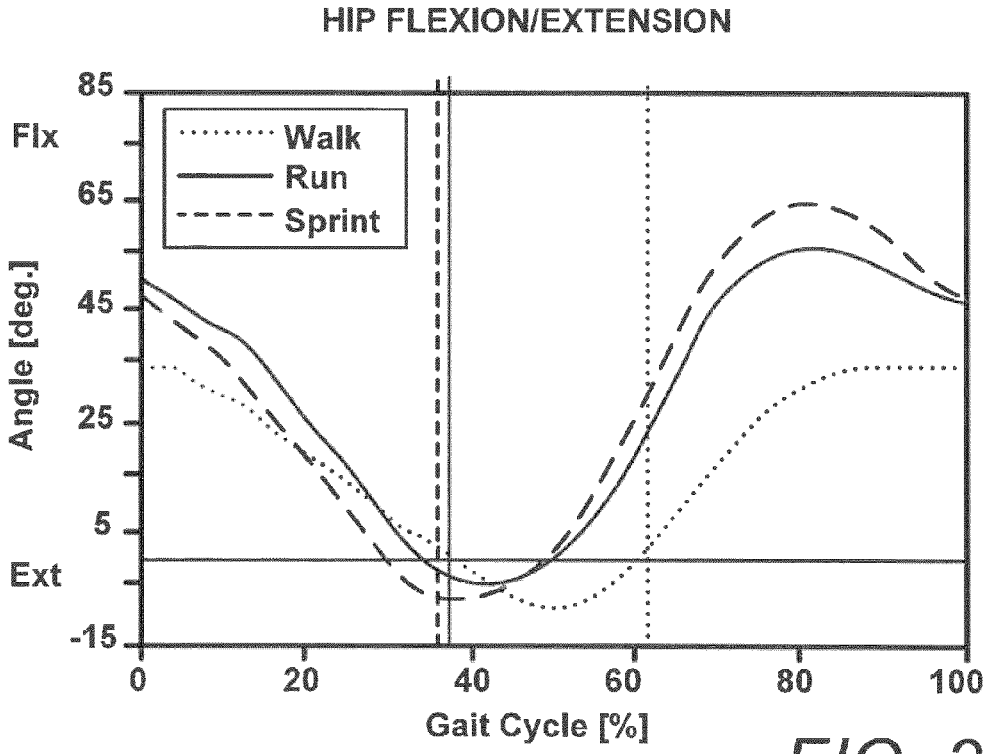
FIG. 38 shows hip flexion and extension angle throughout a stride, relative to the pelvis.
Figure 39:
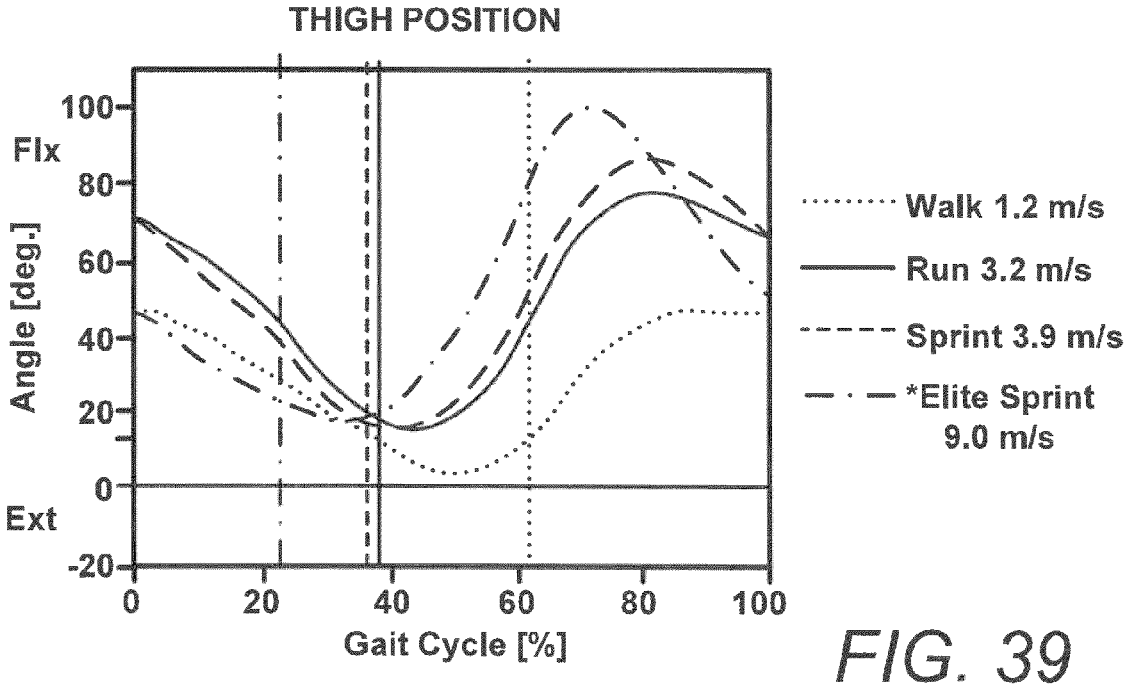
FIG. 39 shows hip flexion and extension angle throughout a stride, relative to a vertical.

For example, FIGS. 38 and 39 illustrate typical behavior of a thigh during a stride or gait cycle as a function of percentage of the gait cycle. In each of the figures, each graph begins and ends at initial contact, representing one full gait cycle along the x-axis. Additionally, in each of the figures, walking is represented by the dotted line, running is represented by the solid line, and sprinting is represented by the dashed line. Similarly, the toe off point for each gait is represented by a vertical line of the same line style. FIG. 38 illustrates a graph of the hip flexion and extension where the angle represents the position of the femur relative to the position of the pelvis. FIG. 39 illustrates a graph of the position of the thigh relative to the vertical. For this graph, 0 degrees indicates that the thigh is in a vertical position. In FIG. 39, an additional gait is included, that of an elite sprinter. As can be seen from FIGS. 38 and 39, the typical thigh position of an adult varies smoothly and predictably for walkers (dotted line), runners (solid line), and sprinters (dashed line).

The resistance units can be configured to provide an indication of differences in average or instantaneous power. For example, the instantaneous power determined with the resistance unit can be provided as an indication of the difference in power being exerted relative to the power being exerted at a previous reference time. As another example, the instantaneous power determined with the resistance unit can be provided as an addition to an estimate of the total power exerted by a wearer while walking, running, or sprinting. Basic trend information such as increasing, decreasing or steady power output can be displayed to the athlete and/or the coach.

In various implementations, an estimate or determination of the total power or energy exerted by a wearer while walking, running, or sprinting can be provided by an equation that relates typical mechanical energy exerted by a person to running speed. The running (or walking) speed of the wearer can be estimated based on a stride rate and a stride length of the wearer. The stride length can be directly measured by measuring a distance run and measuring a number of strides taken over the distance. The stride length is then the distance divided by the number of strides. As another example, the stride length can be estimated based on average stride lengths of runners based on a runner's height.

The stride length of a walking adult can be estimated as about 62 inches (where stride refers to two steps), or between about 52 and about 62 inches, between about 48 and about 66 inches, between about 45 and about 70 inches, or between about 44 and about 72 inches. The stride length of a walking adult can be estimated as the height of the person multiplied by 0.413-0.415. For sprinters, the stride length can be estimated as typically between about 1.14 times the person's height to about 1.35 times the person's height. The stride length of a running adult can be estimated to be between about 50 inches and about 100 inches, between about 55 inches and about 95 inches, between about 58 inches and about 93 inches, or between about 60 inches and about 90 inches. In some embodiments, the estimated stride length for a female can be different from an estimated stride length for a male. For example, for long distance runners, the average stride length for a female can be estimated to be between about 53 inches and about 63 inches and for a male it can be between about 72 inches and about 88 inches. Similarly, for sprinters, the average stride length for a female can be estimated to be between about 67 inches and about 81 inches and for a male it can be between about 83 inches and about 103 inches.

The typical total mechanical energy exerted by a person while running can be determined based on the speed of the runner, the weight of the runner, and/or the stride rate of the runner. In various implementations, the mechanical energy exerted by a person while running can be calculated based on a speed of the runner using a statistical relationship. An example statistical relationship of the work done by a person's body, W (in Joules), running at a speed, x (in meters per second), can be: $W=440+170(x-3.3)$. The variation on this relationship can be between about 10% to about 15% (e.g., the actual mechanical energy has a 68% likelihood of being within 15% of the calculated value using the above relationship). Another example statistical relationship of the work done by a person's body normalized to the weight of the person, Wkg (in Joules/kg), can be: $Wkg=7.5+3(x-3.3)$. The variation on this relationship can be between about 8% to about 12% (e.g., the actual mechanical energy has a 68% likelihood of being within 12% of the calculated value using the above relationship). Another example statistical relationship of the work done by a person's body normalized to the weight of the person and to their stride rate, Wtime (in Joules/kg/s), can be: $Wtime=10.5+5.5(x-3.3)$. The variation on this relationship can be between about 7% to about 10% (e.g., the actual mechanical energy has a 68% likelihood of being within 10% of the calculated value using the above relationship).

In some embodiments, the mechanical energy can be used to determine estimated total power exerted while running. This value can be used as a baseline energy or power and the measurements provided by the resistance units can be used as an addition to this calculated energy or power to provide to the wearer an estimate of the energy or power exerted while walking, running, and/or sprinting. In certain embodiments, the measurements provided by the resistance units can be provided as a percentage of the total mechanical energy exerted by the wearer.

In general, a wide variety of information can be calculated on board and relayed to the wearer, to the wearer and a coach, or to the coach alone for display. Alternatively raw data or partially processed data may be exported to a wearer's remote device, and computations performed thereon. In either event, information such as actual step count, actual distance traveled for walking, near actual distance traveled for running, actual stride length, actual stride rate and real time ratios discussed below can be displayed to the wearer, in many instances more accurately than conventional activity trackers which must in many cases estimate metrics with more or less accuracy.

Certain ratio's or relationships can be determined and displayed in real time, and/or saved for later study. For example, power to weight ratio, expressed as watts per kilogram can really be derived and displayed. The controller may be configured to generate for display the trend line over a time interval such as one week, one month, over the season or longer. An athlete can observe an improvement resulting from either a weight loss, an increase in power output, or probably most likely some of both.

Power to heart rate ratio may also be derived and displayed, and utilized for example to determine aerobic decoupling. Aerobic endurance is a critical factor in achieving success as an endurance athlete. Thus, it can be an important training tool to understand whether you have reached an optimal aerobic fitness level. When aerobic endurance improves, there is a reduced upward heart rate drift relative to a constant power output. The reverse is also true that when heart rate is held steady during extensive endurance training, output may be expected to drift downward. This relationship between heart rate and power output is referred to as coupling. The extent of decoupling can be quantitatively evaluated during workout in two different ways. If an endurance event is undertaken in such a manner that maintains a steady heart rate, the rate of downward power drift can be monitored. Alternatively, since incremental power (power drift) can be determined essentially in real time in accordance with the present invention, an athlete can focus on maintaining a steady power output and view what happens to heart rate over the measurement period. Excessive decoupling (too steep a heart rate climb at constant power output or too steep a power decline at constant heart rate) would indicate a lack of aerobic endurance fitness. The controller may be configured to generate comparative displays of most recent efficiency test with the same test on a prior occasion. The prior occasion may be at least one day, one week, one month, one season or one year or more (e.g., lifetime to date) previously. This information can be utilized to reinforce the value of or modify any of a variety of variables ranging from different types and intensities of training to diet, body weight among others.

An athlete can also utilize the present invention to determine an ideal (e.g., running or cycling) pace. If an athlete is exerting a constant power output, but heart rate is climbing, that exertion level may be acceptable for a short burst but is not sustainable over the long term. Thus the athlete should back down to a lower exertion level. Alternatively, if at a constant power heart rate is declining, the athlete knows that they have a reserve and can afford the energy expense of elevating their exertion level.

Another derived metric that can be determined by the controller for display is efficiency factor. Efficiency factor is normalized power divided by average heart rate over a set interval. By comparing efficiency factor data points over time, such as comparing a present value to a value determined at least one week ago, one month ago, from the beginning of the season, at least a year ago or other interval, one would hope to see an improvement in efficiency factor and can also observe the rate of improvement over time. One will see an improvement in efficiency factor either by experiencing a lower average heart rate for a given steady power output, or an increased power output for a given steady heart rate.

A block diagram showing functional components of an electronics unit 590 is shown in FIG. 33. Force sensor 600 is connected via wire or wireless interface 604. A sensor such as a Flexiforce sensor (obtained from Tekscan of South Boston, Mass., www.tekscan.com) may be used, having a conductance which is linear with force, and an analog interface 606 is used to generate an output voltage that is linear with the applied force. Other analog interfaces may not generate an output voltage that is linear with force, but they will generate a voltage that has a predetermined relationship to a force sensed by the force sensor. The analog interface 606 may contain a variable reference circuit for adjusting a range of the output voltage, depending on the desired performance. The voltage output by the analog interface 606 drives an analog-to-digital converter 608, which is controlled by a central processing unit (CPU) 610 and sampled at a known and constant rate. The CPU 610 may be, for example, a microprocessor or a digital signal processor. The CPU 610 is responsible for executing a power algorithm 612 that calculates the wearer's power exerted to overcome the resistance element based on force sensed by the force sensor 600. Data resulting from the calculation is transmitted to a remote electronics unit (activity tracker, cell phone, heads up display, wrist worn display, internet, etc.) by a radio frequency transmitter 614 and antenna 616 via a data channel. During calibration mode, calibration port 618 is used to interface to electronics unit 590. EEPROM memory 620 stores data generated during calibration. Operating power is supplied, for example, by a battery driven power supply, which is not shown but is very well known in the art. Some sensors are preferably calibrated (zeroed) and may be susceptible to drift with changing temperature. A temperature compensation circuit (not shown) is preferably included, to determine the temperature of the sensor and compensate for thermally induced error.

Figure 34:
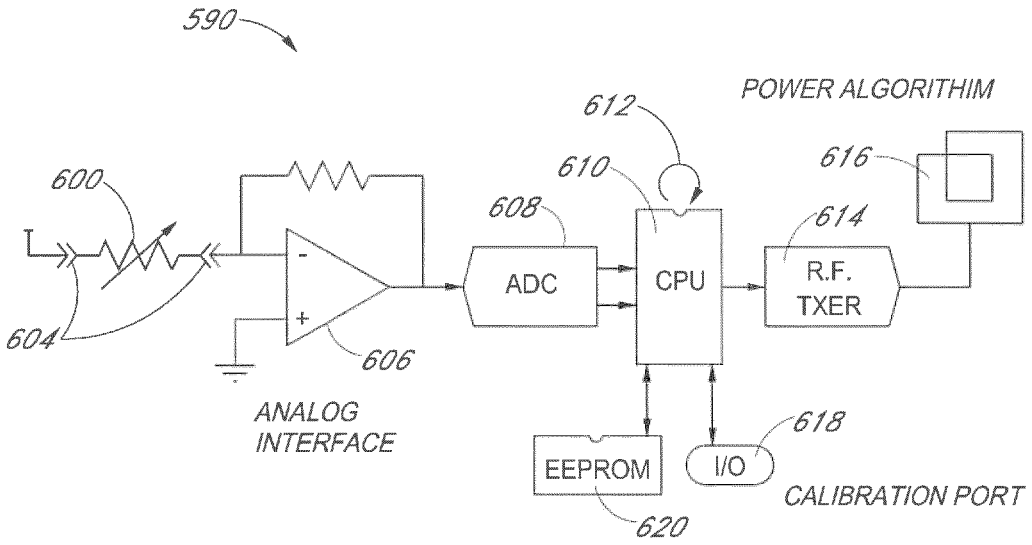
FIG. 34 is a block diagram of sensor electronics, which may be carried within or attached to the resistance unit housing.

FIG. 34 is a block diagram showing functional components of a remote electronics unit that may display power or calories burned data to the wearer, coach or other application. An antenna 622 and a radio frequency receiver 624 receive data transmitted via the data channel. A CPU 626 controls the user interface, which may include a display 628 and potentially controls such as switches 630. Calibration data and user data are stored in EEPROM memory 632. During calibration mode, calibration port 634 is used to interface to the electronics unit. Operating power for the electronics unit may be supplied, for example, by a battery driven power supply, which is not shown but is very well known in the art. Additional details may be found in U.S. Pat. No. 7,599,806 to Hauschildt, the disclosure of which is hereby incorporated in its entirety herein by reference.

Power may be displayed as real time data, peak, average, rolling average or integrated over a predetermined interval of time (e.g., 10 second, 30 second, I minute or more). Display may be visual, such as on a smart phone, activity tracker or other hand held, wrist worn or mounted device. Power may alternatively be displayed on a heads up display such as an eyeglass with heads up display, or audibly over an audio output using a text to voice converter. Display may alternatively be configured to provide an indication of crossing a preset value such as when power output moves either above or below a preset upper or lower alarm limit.

Figure 35:
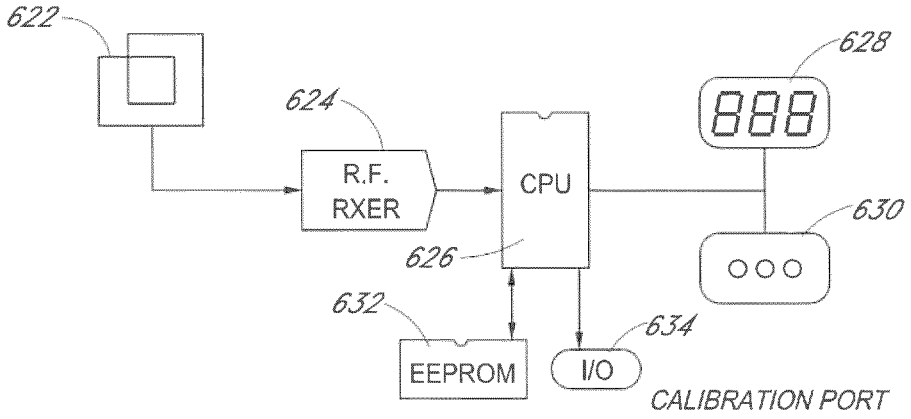
FIG. 35 is a block diagram of a remote display unit.
Figure 36:
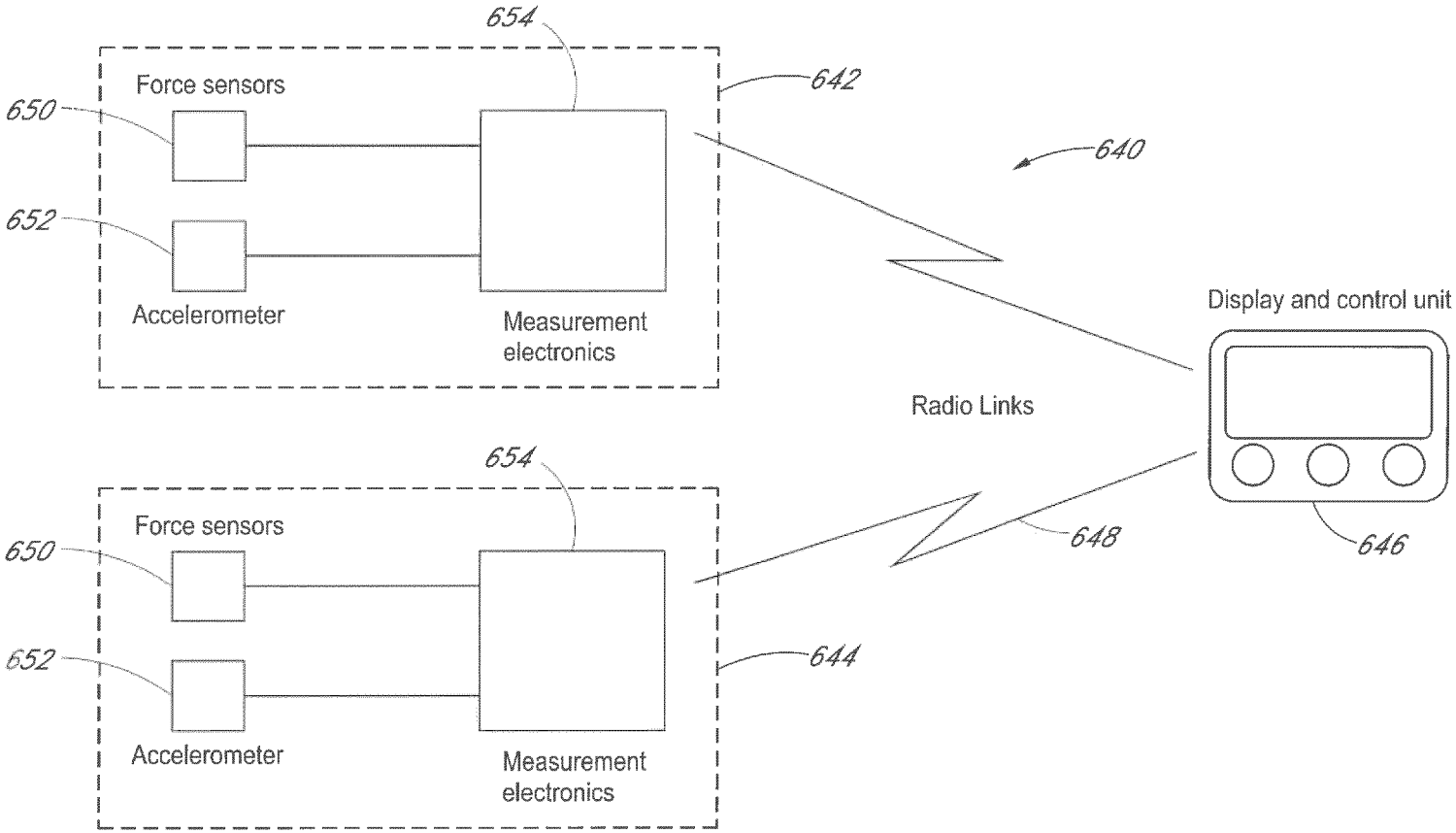
FIG. 36 is a block diagram of a bilateral power measurement system.

Referring to FIG. 35 there is illustrated a simplified bilateral system to implement the present invention indicated generally by the reference numeral 640. A left leg power module 642 and a right leg power module 644 are indicated by dotted lines and are in communication with a control and display unit 646, for example over a radio link 648 (e.g., ANT+, Bluetooth, Zigbee or others disclosed elsewhere herein). Each module 642, 644 comprises of one or more force sensor(s) 650, an accelerometer 652 and related measurement electronics 654 carried by each module. The display and control unit 646, usually battery powered, can be attached to any convenient place such as the wrist of the wearer, handlebar or other display as has been discussed. The connection between the sensors and electronics in the module and the sensors and electronics elsewhere on or in communication with the garment or wearer may be by wired conductors on or integrated into the garment, or may be by a wireless link such as radio protocols described elsewhere herein or by electromagnetic induction.

In a preferred embodiment the communication between the power module electronics embedded in the resistance module and the display and control unit is by a radio link 648. Each of left leg power module 642 and right leg power module 644 uses the radio to transmit a set of measurement data at one or more fixed points on each stride. In operation each of the power modules 642, 644 transmits its data in a short burst when the stride reaches a fixed point in its cycle, such as at the heel strike or toe roll off. Because the two strides are 180 degrees away from each other, data transmission can be timed to ensure that the transmissions from each power module assembly will never interfere with each other. Each burst of data contains a set of samples or measurements taken at regular intervals during the stride cycle, and may include force, proximity, cadence, femoral (or other) extension angle, heel strike, toe off, and accelerometer information. Each sample has an associated timestamp, which may be explicit or implicit, to specify its time relationship to the other samples in the set and to other sets of samples. The electronics in the power modules may include processing of the data before it is transmitted to the control unit 646. Additional details may be found in U.S. Pat. No. 8,762,077 to Redmond, et al., the disclosure of which is hereby incorporated in its entirety herein by reference.

It may be desirable to monitor the wearer's oxygen saturation, and/or $CO_2$, to evaluate the transition between aerobic and anaerobic threshold as well as the effect on that threshold of varying the degree of resistance provided by the resistance unit (by adjusting an adjustable resistance unit or switching resistance units having different resistance levels). A sensor may be configured to be placed in contact with the wearer such as by permanent or removable attachment to the garment, or independent attachment to the wearer. The sensor may be configured to obtain a plethysmography signal, although it should be understood that any device configured to obtain oxygen saturation and/or heart rate data may be used in accordance with the techniques of the present disclosure. The system may include a monitor in communication with the sensor. The sensor and the monitor may communicate wirelessly as shown, or may communicate via one or more cables (e.g., the sensor and the monitor may be coupled via one or more cables). The sensor may include a sensor body, which may support one or more optical components, such as one or more emitters configured to emit light at certain wavelengths through a tissue of the subject and/or one or more detectors configured to detect the light after it is transmitted through the tissue of the subject.

The sensor may include one or more emitters and/or one or more detectors. The emitter may be configured to transmit light, and the detector may be configured to detect light transmitted from the emitter into a patient's tissue after the light has passed through the blood perfused tissue. The detector may generate a photoelectrical signal correlative to the amount of light detected. The emitter may be a light emitting diode, a superluminescent light emitting diode, a laser diode or a vertical cavity surface emitting laser (VCSEL). Generally, the light passed through the tissue is selected to be of one or more wavelengths that are absorbed by the blood in an amount representative of the amount of the blood constituent present in the blood. The amount of light passed through the tissue varies in accordance with the changing amount of blood constituent and the related light absorption. For example, the light from the emitter may be used to measure blood oxygen saturation, water fractions, hematocrit, or other physiological parameters of the patient. In certain embodiments, the emitter may emit at least two (e.g., red and infrared) wavelengths of light. The red wavelength may be between about 600 nanometers (nm) and about 700 nm, and the IR wavelength may be between about 800 nm and about 1000 nm. However, any appropriate wavelength (e.g., green, yellow, etc.) and/or any number of wavelengths (e.g., three or more) may be used. It should be understood that, as used herein, the term "light" may refer to one or more of ultrasound, radio, microwave, millimeter wave, infrared, visible, ultraviolet, gamma ray or X-ray electromagnetic radiation, and may also include any wavelength within the radio, microwave, infrared, visible, ultraviolet, or X-ray spectra, and that any suitable wavelength of light may be appropriate for use with the present disclosure.

The detector may be an array of detector elements that may be capable of detecting light at various intensities and wavelengths. In one embodiment, light enters the detector after passing through the tissue of the wearer. In another embodiment, light emitted from the emitter may be reflected by elements in the wearer's tissue to enter the detector. The detector may convert the received light at a given intensity, which may be directly related to the absorbance and/or reflectance of light in the tissue of the wearer, into an electrical signal. That is, when more light at a certain wavelength is absorbed, less light of that wavelength is typically received from the tissue by the detector, and when more light at a certain wavelength is transmitted, more light of that wavelength is typically received from the tissue by the detector. After converting the received light to an electrical signal, the detector may send the signal to the monitor, where physiological characteristics may be calculated based at least in part on the absorption and/or reflection of light by the tissue of the wearer.

As indicated above, the monitoring system may be configured to monitor the wearer's oxygen saturation and/or heart rate during exercise. The system may also be configured to determine whether the wearer is utilizing an aerobic or an anaerobic pathway based at least in part on the athlete's oxygen saturation and/or heart rate. For example, the monitoring system may compare the athlete's oxygen saturation and/or heart rate to one or more zones corresponding to various types of exercise (e.g., aerobic exercise and anaerobic exercise) to determine whether the wearer is utilizing the aerobic or the anaerobic pathways. Each of the one or more zones may be defined by a percentage or a range of percentages of oxygen saturation and/or a value or a range of values of heart rate, and each of the one or more zones may have an upper limit and a lower limit for oxygen saturation and/or heart rate. For example, a first zone may include an oxygen saturation range and/or a heart rate range corresponding to aerobic exercise, while a second zone may include an oxygen saturation range and/or heart rate range corresponding to anaerobic exercise. A visual, audio and/or tactile display or feedback may be provided to the wearer to indicate status and/or change in status between an aerobic metabolism level of activity and an anaerobic metabolism level of activity. Additional implementation details may be found in US patent publication No. 2015/0031970 to Lain, entitled Systems and Methods for Monitoring Oxygen Saturation During Exercise, the disclosure of which is hereby incorporated by reference in its entirety herein.

Although disclosed primarily in the context of lower body garments, any of the resistance elements and attachment fabrics and structures disclosed herein can be adopted for use for any other motion segment on the body, including the shoulder, elbow, wrist, neck, abdomen (core) and various other motion segments of the upper body. Any of the various resistance elements and attachment structures disclosed herein can be interchanged with any other, depending upon the desired performance. In addition, the present invention has been primarily disclosed as coupled to a type of garment resembling a complete article of clothing. However any of the resistance systems disclosed herein may be carried by any of a variety of braces, wearable clothing subassemblies, straps, cuffs or other wearable support construct that is sufficient to mechanically couple one or more resistance elements to the body and achieve the force transfer described herein, that may be worn over or under conventional clothing.

What is claimed is:

1. A wearable garment training system for increasing physiological load and monitoring power exerted to overcome the load, comprising:

a waist portion;

a left leg portion;

a right leg portion;

a left hip resistance unit removably carried by a connector on the garment and aligned with a rotational axis of the leg such that movement of the left leg portion relative to the waist portion is resisted by the left hip resistance unit;

a right hip resistance unit removably carried by a connector on the garment and aligned with a rotational axis of the leg such that movement of the right leg portion relative to the waist portion is resisted by the right hip resistance unit;

a left sensor;

a right sensor;

wherein the left and right sensors each capture data for enabling the determination of force exerted by a wearer against the respective left and right resistance units throughout a range of motion.

2. A training system as in claim 1, wherein at least one of the sensors is configured to measure force applied against a resistance unit during extension.

3. A training system as in claim 1, wherein at least one of the sensors is configured to measure force applied against a resistance unit during flexion.

4. A training system as in claim 1, wherein at least a left sensor and a right sensor are configured to measure force applied against the respective resistance units during extension.

5. A training system as in claim 4, wherein at least a left sensor and a right sensor are configured to measure force applied against the respective resistance units during flexion.

6. A training system as in claim 1, further comprising a sensor for determining angular velocity of a wearer's leg throughout the range of motion.

7. A training system as in claim 6, further comprising a processor, for determining power exerted throughout the range of motion.

8. A training system as in claim 1, further comprising a transmitter, for transmitting force data to a remote device.

9. A training system as in claim 6, further comprising a transmitter, for transmitting force data and angular velocity data to a remote device.

10. A training system as in claim 1, further comprising a left knee resistance unit and a right knee resistance unit.

11. A training system as in claim 1, wherein the left and right hip resistance units comprise rotatable viscous dampers.

12. A training system as in claim 10, wherein the system imposes a first level of resistance to movement across a hip and a second level of resistance across a knee, and the first level is greater than the second level.

13. A training system as in claim 1, wherein each resistance unit comprises a housing and a femoral lever extending from the housing.

14. A training system as in claim 1, wherein each sensor is in force transmitting contact with a femoral lever.

15. A training system as in claim 1, comprising electronics for capturing data related to angular position of at least one of the left and right leg.

16. A training system as in claim 1, wherein the garment comprises a compression fabric.

17. A training system as in claim 16, wherein the fabric comprises a polyester elastane fabric with moisture wicking properties.

18. A training system as in claim 1, wherein the left and right resistance units each impose a resistance of at least about 5 inch pounds.

19. A training system as in claim 18, wherein the left and right resistance units each impose a resistance of at least about 10 inch pounds.

20. A training system as in claim 18, wherein the left and right resistance units each impose a resistance of at least about 15 inch pounds.

21. A training system as in claim 1, wherein the garment comprises a wearable harness.

22. A training system as in claim 21, wherein the harness comprises a waist band and left and right leg bands.

23. A training system as in claim 1, further comprising an ANT+transmitter.

24. A training system as in claim 1, wherein each sensor is configured to capture data for enabling the determination of stride length.

25. A training system as in claim 1, wherein each sensor is configured to capture data for enabling the determination of stride rate.

26. A training system as in claim 1, wherein at least one sensor comprises a strain gauge.

27. A training system as in claim 1, wherein at least one sensor comprises a torque sensor.

28. A training system as in claim 1, wherein each sensor is configured to capture angular velocity data.

29. A training system as in claim 1, wherein the left sensor and right sensors are configured to capture data reflecting left side and right side asymmetries in performance.

30. A training system as in claim 1, further comprising a processor configured to determine power to heart rate ratio.

31. A training system as in claim 1, further comprising a processor configured to determine power to weight ratio.

32. A training system as in claim 1, further comprising a processor configured to determine efficiency factor.

* * * * *